US009191768B2

(12) United States Patent
Kano

(10) Patent No.: US 9,191,768 B2
(45) Date of Patent: Nov. 17, 2015

(54) DIFFRACTED SOUND REDUCTION DEVICE, DIFFRACTED SOUND REDUCTION METHOD, AND FILTER COEFFICIENT DETERMINATION METHOD

(75) Inventor: Hiroyuki Kano, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 400 days.

(21) Appl. No.: 13/641,250

(22) PCT Filed: Feb. 17, 2012

(86) PCT No.: PCT/JP2012/001061

§ 371 (c)(1),
(2), (4) Date: Oct. 15, 2012

(87) PCT Pub. No.: WO2012/114696

PCT Pub. Date: Aug. 30, 2012

(65) Prior Publication Data

US 2013/0034246 A1 Feb. 7, 2013

(30) Foreign Application Priority Data

Feb. 24, 2011 (JP) ..... 2011-039077

(51) Int. Cl.
*H04S 7/00* (2006.01)
*H04R 3/12* (2006.01)
*H04R 1/40* (2006.01)

(52) U.S. Cl.
CPC ..... *H04S 7/305* (2013.01); *H04R 3/12* (2013.01); *H04R 1/403* (2013.01); *H04R 2217/03* (2013.01); *H04R 2499/15* (2013.01)

(58) Field of Classification Search
None
See application file for complete search history.

(56) References Cited

U.S. PATENT DOCUMENTS 5,315,661 A 5/1994 Gossman et al.
5,809,153 A 9/1998 Aylward et al.

(Continued)

FOREIGN PATENT DOCUMENTS

JP 60-201799 10/1985
JP 2-239798 9/1990

(Continued)

OTHER PUBLICATIONS

International Search Report issued May 15, 2012 in corresponding International Application No. PCT/JP2012/001061.

(Continued)

*Primary Examiner* — Curtis Kuntz
*Assistant Examiner* — Qin Zhu
(74) *Attorney, Agent, or Firm* — Wenderoth, Lind & Ponack, L.L.P.

(57) ABSTRACT

A diffracted sound reduction device includes: a reproduction speaker that outputs reproduced sound having properties indicated by an input signal; control speakers each of which reproduces corresponding one of control signals, the diffracted sound being a part of the reproduced sound and arriving at corresponding one of the control points except the control point at the listener's position; and control filters each of which filters the input signal to generate corresponding one of the control signals. Each of the control points faces a corresponding speaker from among the reproduction speaker and the control speakers. Each of the control filters generates the corresponding one of the control signals so that a sound pressure of the diffracted sound at corresponding one of the control points is lower than a sound pressure of direct sound that is a part of the reproduced sound which arrives at the control point of the listener's position.

8 Claims, 50 Drawing Sheets

(56) References Cited

U.S. PATENT DOCUMENTS

| | | | | |
|---|---|---|---|---|
| 8,116,483 | B2 * | 2/2012 | Mitsuhashi | 381/97 |
| 8,175,317 | B2 * | 5/2012 | Nakano | 381/387 |
| 8,199,932 | B2 * | 6/2012 | Nakano | 381/103 |
| 2007/0092099 | A1 | 4/2007 | Nakano | |
| 2007/0291959 | A1 * | 12/2007 | Seefeldt | 381/104 |
| 2008/0025518 | A1 * | 1/2008 | Mizuno et al. | 381/17 |
| 2008/0260170 | A1 | 10/2008 | Nakano | |
| 2008/0317254 | A1 * | 12/2008 | Kano | 381/71.4 |
| 2009/0129604 | A1 * | 5/2009 | Enamito et al. | 381/58 |
| 2010/0124341 | A1 * | 5/2010 | Kano | 381/94.1 |
| 2010/0220871 | A1 | 9/2010 | Mitsuhashi | |
| 2011/0249825 | A1 * | 10/2011 | Ise | 381/56 |
| 2012/0033821 | A1 * | 2/2012 | Ohta et al. | 381/71.1 |

FOREIGN PATENT DOCUMENTS

| | | |
|---|---|---|
| JP | 6-149271 | 5/1994 |
| JP | 8-500193 | 1/1996 |
| JP | 9-247784 | 9/1997 |
| JP | 10-271596 | 10/1998 |
| JP | 2007-124129 | 5/2007 |
| JP | 2008-136112 | 6/2008 |
| JP | 2009-206818 | 9/2009 |
| WO | 94/05005 | 3/1994 |
| WO | 2007/116658 | 10/2007 |

OTHER PUBLICATIONS

P. A. Nelson et al., "Active Control of Sound", Academic Press, Jun. 24, 1993, pp. 397-410.

* cited by examiner

DIFFRACTED SOUND REDUCTION DEVICE, DIFFRACTED SOUND REDUCTION METHOD, AND FILTER COEFFICIENT DETERMINATION METHOD

TECHNICAL FIELD

The present invention relates to diffracted sound reduction devices and the like. More particularly, the present invention relates to a diffracted sound reduction device and the like which reduces sound transferred to positions that are not a listening position.

BACKGROUND ART

In order to reduce unpleasant noise, there has been the old idea of reproducing antiphase sound by a control speaker to cancel the noise, namely, active noise control (see Patent Literatures 1 to 4, for example).

CITATION LIST

Patent Literature

[PTL 1] Japanese Unexamined Patent Application Publication No. 6-149271
[PTL 2] Japanese Unexamined Patent Application Publication No. 8-500193
[PTL 3] Japanese Unexamined Patent Application Publication No. 60-201799
[PTL 4] Japanese Unexamined Patent Application Publication No. 2-239798

SUMMARY OF INVENTION

Technical Problem

However, the above-described conventional art has a problem that a device for reducing noise needs to have a large and complicated structure.

Therefore, in order to address the problem, an object of the present invention is to provide a diffracted sound reduction device having a compact structure capable of reducing a sound pressure produced by a speaker in an undesired direction and correctly transferring the sound in a desired direction.

Solution to Problem

According to an aspect of the present invention, there is provided a diffracted sound reduction device that controls sound pressures at a plurality of control points which are positions including a listener's position, the diffracted sound reduction device including: a reproduction speaker that outputs reproduced sound having properties indicated by an input signal; at least two control speakers each of which reproduces corresponding one of control signals which indicates properties of control sound to reduce a sound pressure of diffracted sound, the diffracted sound being a part of the reproduced sound and arriving at corresponding one of the control points except the control point at the listener's position; and control filters each of which filters the input signal to generate corresponding one of the control signals, wherein the reproduction speaker faces a listener, the control speakers do not face the listener, each of the control points faces a corresponding speaker from among the reproduction speaker and the control speakers, and each of the control filters generates the corresponding one of the control signals to cause a sound pressure of the diffracted sound at corresponding one of the control points to be lower than a sound pressure of direct sound that is a part of the reproduced sound and arriving at the control point at the listener's position.

The present invention can be implemented not only as the above-described diffracted sound reduction device, but also as a diffracted sound reduction method having steps performed by the characteristic units included in the diffracted sound reduction device or as a filter coefficient determination method of determining a coefficient of a filter included in the diffracted sound reduction device. The present invention can be implemented as a program causing a computer to execute these characteristic steps. Of course, the program can be distributed via a recording medium such as a Compact Disc-Read Only Memory (CD-ROM) or via a transmission medium such as the Internet.

Furthermore, for the present invention, a part or all of the functions of the diffracted sound reduction device can be implemented into a semiconductor integrated circuit (LSI), or as a diffracted sound reduction system including the diffracted sound reduction device.

Advantageous Effects of Invention

The present invention can provide a diffracted sound reduction device having a compact structure capable of reducing a sound pressure reproduced by a speaker in an undesired direction and correctly transferring the sound in a desired direction.

DESCRIPTION OF EMBODIMENTS

Figure 1:
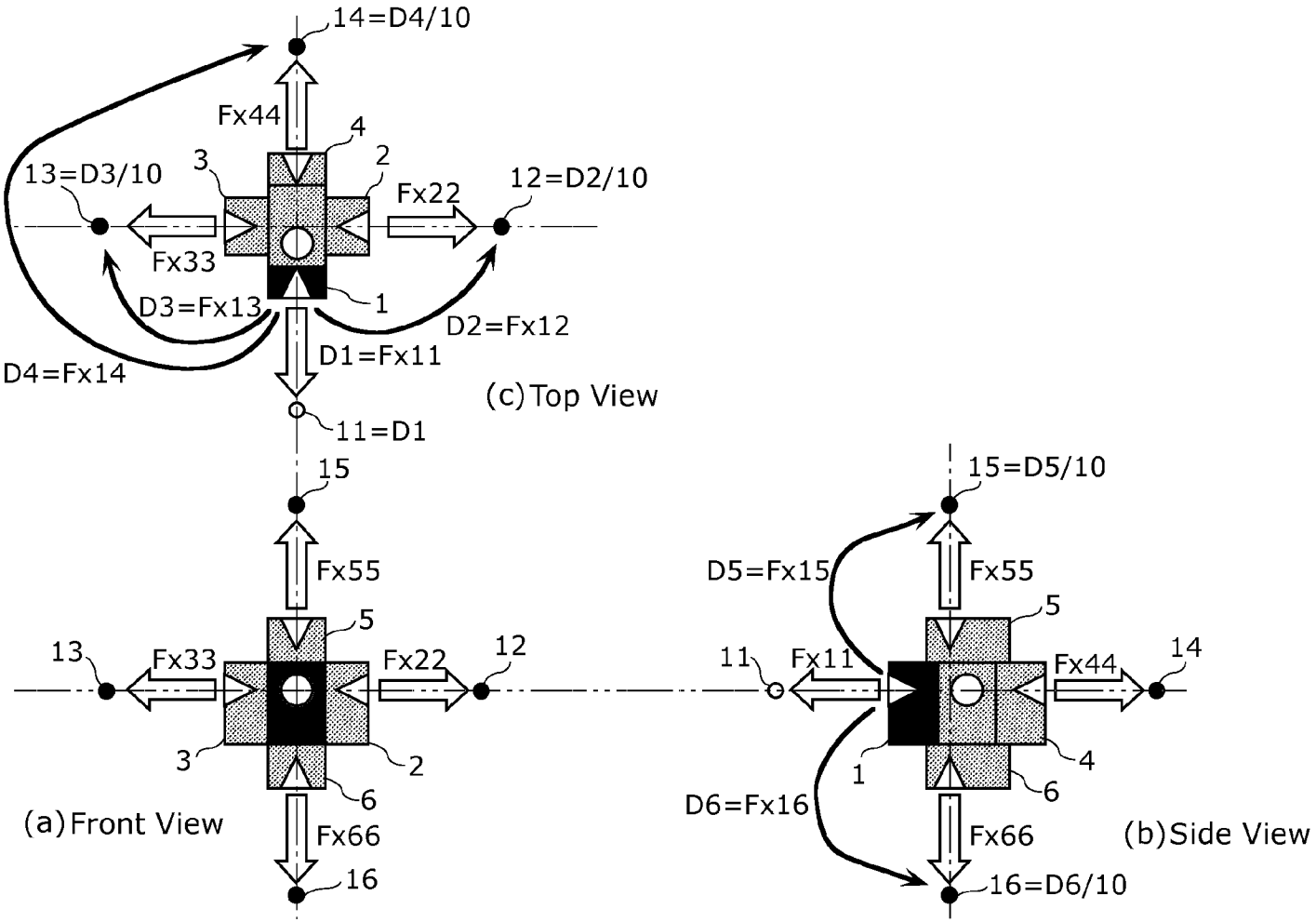
FIG. 1 is a diagram showing a configuration of speakers and microphones in a diffracted sound reduction device according to Embodiment 1.

According to an aspect of the present invention, there is provided a diffracted sound reduction device that controls sound pressures at a plurality of control points which are positions including a listener's position, the diffracted sound reduction device including: a reproduction speaker that outputs reproduced sound having properties indicated by an input signal; at least two control speakers each of which reproduces corresponding one of control signals which indicates properties of control sound to reduce a sound pressure of diffracted sound, the diffracted sound being a part of the reproduced sound and arriving at corresponding one of the control points except the control point at the listener's position; and control filters each of which filters the input signal to generate corresponding one of the control signals, wherein the reproduction speaker faces a listener, the control speakers do not face the listener, each of the control points faces a corresponding speaker from among the reproduction speaker and the control speakers, and each of the control filters generates the corresponding one of the control signals to cause a sound pressure of the diffracted sound at corresponding one of the control points to be lower than a sound pressure of direct sound that is a part of the reproduced sound and arriving at the control point at the listener's position.

With the above structure, the diffracted sound reduction device can be implemented by two speakers and control filters (for example, a circuit including a digital signal processor) at minimum according to the present embodiment. As a result, the diffracted sound reduction device according to the present embodiment has a compact structure in comparison to the conventional arts. In addition, even if the target space to be controlled is expanded, an arithmetic operation amount is not increased. Therefore, it is possible to provide the diffracted sound reduction device that has a compact shape and that reduces a sound pressure of sound reproduced by a speaker in an undesired direction and correctly transfers the sound in a desired direction.

It is also possible that one of the control speakers serves also as the reproduction speaker, and the control filters filter the input signal to cause at the control point at the listener's position, the sound pressure of the direct sound to be equal to the sound pressure of the reproduced sound which is generated by directly reproducing the input signal by the reproduction speaker without reproducing the control signals, and at each of the control points at the positions except the listener's position, the sound pressure of the diffracted sound to be lower by a predetermined amount than the sound pressure of the reproduced sound which is generated by directly reproducing the input signal by the reproduction speaker without reproducing the control signals.

With the above structure, the diffracted sound reduction device can decrease a sound pressure level of diffracted sound without preventing the listener from listening to the reproduced sound.

It is further possible that each of the control filters has a filter coefficient determined by a filter coefficient determination method including: performing signal processing on the input signal to determine, for each of the control points, a desired signal indicating properties of desired sound to be eventually reproduced at the each of the control points; applying, for each of the control speakers, corresponding one of the control filters on the input signal to generate corresponding one of the control signals to be reproduced by the each of the control speakers; calculating, for each of the control points as acoustic simulation, a reproduction signal indicating properties of the desired sound based on the generated corresponding one of the control signals; synthesizing, for each of the control points, the desired signal and the reproduction signal to generate an error signal; updating a filter coefficient of the corresponding one of the control filters to minimize the error signal, when the generated error signal is greater than or equal to a predetermined threshold value; and determining the filter coefficient of the corresponding one of the control filters to be used, when the error signal is smaller than the predetermined threshold value.

With the above structure, it is possible to specifically determine filter coefficients of the control filters in the diffracted sound reduction device.

More specifically, it is further possible that in the performing of the signal processing to determine the desired signal, the desired signal is determined, for each of the control points, from the input signal by using corresponding one of level adjusters and corresponding one of desired property filters, for a first desired property filter from among the desired property filters, a transfer characteristic of sound transfer from the reproduction speaker to the control point at the listener's position is set, and for each of the desired property filters except the first desired property filter, a transfer characteristic of sound transfer from the reproduction speaker to corresponding one of the control points at the positions except the listener's position is set, and each of the level adjusters adjusts a gain of the input signal according to a setting value.

With the above structure, it is possible to separately adjust a gain of the level adjuster corresponding to the control speaker serving also as the reproduction speaker and gains of the level adjusters corresponding to the other control speakers.

More specifically, it is further possible that each of setting values of gains which are set for the level adjusters except the level adjuster corresponding to the first desired property filter is smaller than a setting value of a gain which is set for the level adjuster corresponding to the first desired property filter.

With the above structure, the gain of the level adjuster corresponding to the control speaker serving also as the reproduction speaker is set to greater than each of the gains of the level adjusters corresponding to the other control speakers, so that it is possible to allow the reproduced sound of the reproduction speaker to be easily listened to by the listener. In addition, diffracted sound in the reproduced sound can be reduced.

It is further possible that the calculating the reproduction signal as the acoustic simulation includes: applying, on each of the control signals, an acoustic simulation filter for setting a transfer characteristic of a path to corresponding one of the control points; and performing, for each of the control points, an addition operation using the control signals applied with the acoustic simulation filter to generate the reproduction signal for the each of the control points.

With the above structure, it is possible to calculate, by an arithmetic operation device, effects of reducing the diffracted sound by using control sound while keeping the desired transfer characteristic.

It is further possible that the determining of the coefficient includes: applying, on the input signal, an acoustic simulation filter for setting a transfer characteristic of sound from each of the control speakers to each of the control points; and when the error signal is greater than or equal to the predetermined threshold value, updating the filter coefficient of the corresponding one of the control filters based on an output signal of the acoustic simulation filter and the error signal to cause a next calculated error signal to be smaller than the error signal.

With the above structure, the control unit can determine filter coefficients of the control filters to minimize next error signals as feedback.

It is further possible that the diffracted sound reduction device further includes: a desired property unit configured to perform signal processing on the input signal to generate a plurality of desired signals Dn; a control unit configured to perform signal processing on the input signal to generate a plurality of control signals Cn; an acoustic simulation unit configured to perform signal processing on each of the control signals Cn generated by the control unit to generate reproduction signals On corresponding to the control signals Cn, respectively; and an arithmetic operation unit configured to synthesize each of the desired signals Dn and the reproduction signal On corresponding to the each of the desired signals Dn to generate a plurality of error signals En, wherein the diffracted sound reduction device determines control properties of corresponding one of the control filters as $$Cn=Dn/On$$

to cause each of the error signals to be smaller than a predetermined threshold value.

With the above structure, the diffracted sound reduction device includes structural elements that performs arithmetic operations to calculate the filter coefficients. Therefore, it is possible to determine more appropriate filter coefficients for each set space.

It is further possible that the diffracted sound reduction device further includes: correction filters each of which receives corresponding one of the control signals generated by corresponding one of the control filters; and an adder, wherein the reproduction speaker is different from the control speakers, a first control speaker from among the control speakers has a diaphragm facing the listener, and the control speakers except the first control speakers do not face the listener, each of the correction filters has a correction filter coefficient to reduce a level of control sound not to affect properties of the reproduced sound at the listener's position, the control sound being generated by reproducing the control signal applied with the each of the correction filters, and the adder performs, for each of the control speakers, consolidation operation using the control signals applied with the correction filters, and provides the consolidated control signal to the each of the control speakers.

With the above structure, if the control speaker is later added to an existing reproduction speaker, it is possible to reduce the diffracted sound in the reproduced sound reproduced by the reproduction speaker.

According to another aspect of the present invention, there is provided a filter coefficient determination method of determining filter coefficients of control filters included in a diffracted sound reduction device including: a reproduction speaker that outputs reproduced sound having properties indicated by an input signal; at least two control speakers each of which reproduces corresponding one of control signals which indicates properties of control sound to reduce a sound pressure of diffracted sound, the diffracted sound being a part of the reproduced sound and arriving at corresponding one of control points; and the control filters each of which filters the input signal to generate corresponding one of the control signals, the filter coefficient determination method including: performing signal processing on the input signal to determine, for each of the control points, a desired signal indicating properties of desired sound to be eventually reproduced at the each of the control points; applying, for each of the control speakers, corresponding one of the control filters on the input signal to generate corresponding one of the control signals to be reproduced by the each of the control speakers; calculating, for each of the control points as acoustic simulation, a reproduction signal indicating properties of the desired sound based on the generated corresponding one of the control signals; synthesizing, for each of the control points, the desired signal and the reproduction signal to generate an error signal; updating a filter coefficient of the corresponding one of the control filters to minimize the error signal, when the generated error signal is greater than or equal to a predetermined threshold value; and determining the filter coefficient of the corresponding one of the control filters to be used, when the error signal is smaller than the predetermined threshold value.

According to still another aspect of the present invention, there is provided a diffracted sound reduction method of reducing diffracted sound by a diffracted sound reduction device including: a reproduction speaker that outputs reproduced sound having properties indicated by an input signal; at least two control speakers each of which reproduces corresponding one of control signals which indicates properties of control sound to reduce a sound pressure of diffracted sound, the diffracted sound being a part of the reproduced sound and arriving at corresponding one of control points; and the control filters each of which filters the input signal to generate corresponding one of the control signals, the diffracted sound reduction method including: performing signal processing on the input signal to generate a plurality of desired signals Dn; performing signal processing on the input signal to generate a plurality of control signals Cn; performing, as acoustic simulation, signal processing on each of the generated control signals Cn so as to generate reproduction signals On corresponding to the control signals Cn, respectively; synthesizing, as arithmetic operation, each of the desired signals Dn and the reproduction signal On corresponding to the each of the desired signals Dn, so as to generate a plurality of error signals En; and determining control properties of corresponding one of the control filters as $$Cn=Dn/On$$

to cause each of the error signals to be smaller than a predetermined threshold value.

Prior to the detailed description of the present invention, the following describes related arts of the present invention and their problems in detail.

Conventionally, in a one-dimensional space, such as a headphone or a duct (pipe line), which has a limited small size of space, there have been application examples of active noise control, and their control methods have been digital as well as analog. This is because that the control can be achieved with relatively less arithmetic operations in the one-dimensional control, it is possible to offer a low cost even in digital method. However, in a three-dimensional space having a large space size, such as a general home room, an office, or a vehicle interior, it is impossible to offer desired effects in a wide area without a large number of control points to obtain the results. Therefore, the arithmetic operations are increased, and implementation with a low cost is difficult.

The above-mentioned noise is not limited to so-called noise such as industrial noise and car engine sound. For example, sound from an audio headphone is comfortable for a person listening to it in a train, but the same sound leaked from the headphone is unpleasant as noise for other people. There have been problems that when someone listens to sound of an audio device or watches TV, the sound leaks into a next-door room and bothers other people as unpleasant noise. The person enjoying sound by the audio device or TV wants to listen to the sound with a large volume, which naturally increases the leaked sound and sometimes causing a trouble with neighbors.

Figure 38:
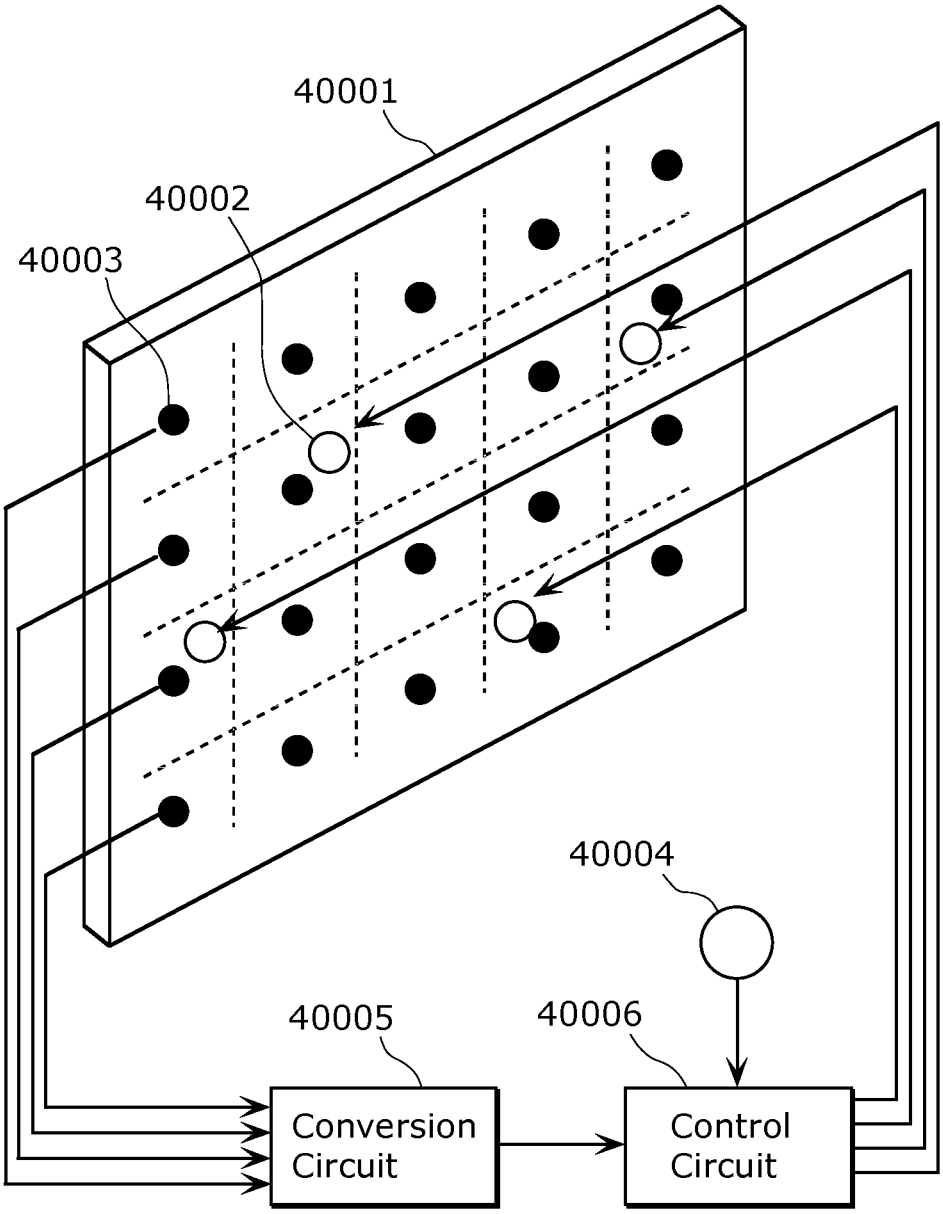
FIG. 38 is a diagram showing a first related art.

FIG. 38 shows the first related art disclosed in Patent Literature 1, providing an active vibration (noise) control device to a wall of a house, for example, to suppress vibration of the wall to reduce emitted noise transferring through the wall. In FIG. 38, 40001 denotes a sound blocking wall, 40002 denotes an actuator provided to excite the sound blocking wall 40001, 40003 denotes vibration sensors each detecting vibration of the sound blocking wall 40001, 40004 denotes a noise sensor, 40005 denotes a conversion circuit that receives output signals of the vibration sensors 40003, and 40006 denotes a control circuit that obtains an output signal of the conversion circuit 40005 and an output signal of the noise sensor 40004 to provide a control signal to the actuator 40002.

The conversion circuit 40005 converts the electric signal provided from a plurality of the vibration sensors 40003 to acoustic emission power to be emitted from the sound blocking wall 40001. The control circuit 40006 generates a control signal from the output signal of the noise sensor 40004 and the output signal of the conversion circuit 40005 so as to decrease an emission sound pressure conversion value that is an output signal of the conversion circuit 40005, and then provides the control signal to the actuator 40002. At the sound blocking wall 40001 having the above-described structure, the actuator 40002 performs vibration deadening on vibration caused by noise at respective points where the vibration sensors 40003 are provided. As a result, a transfer amount of noise is reduced, thereby improving sound blocking performance.

Figure 39:
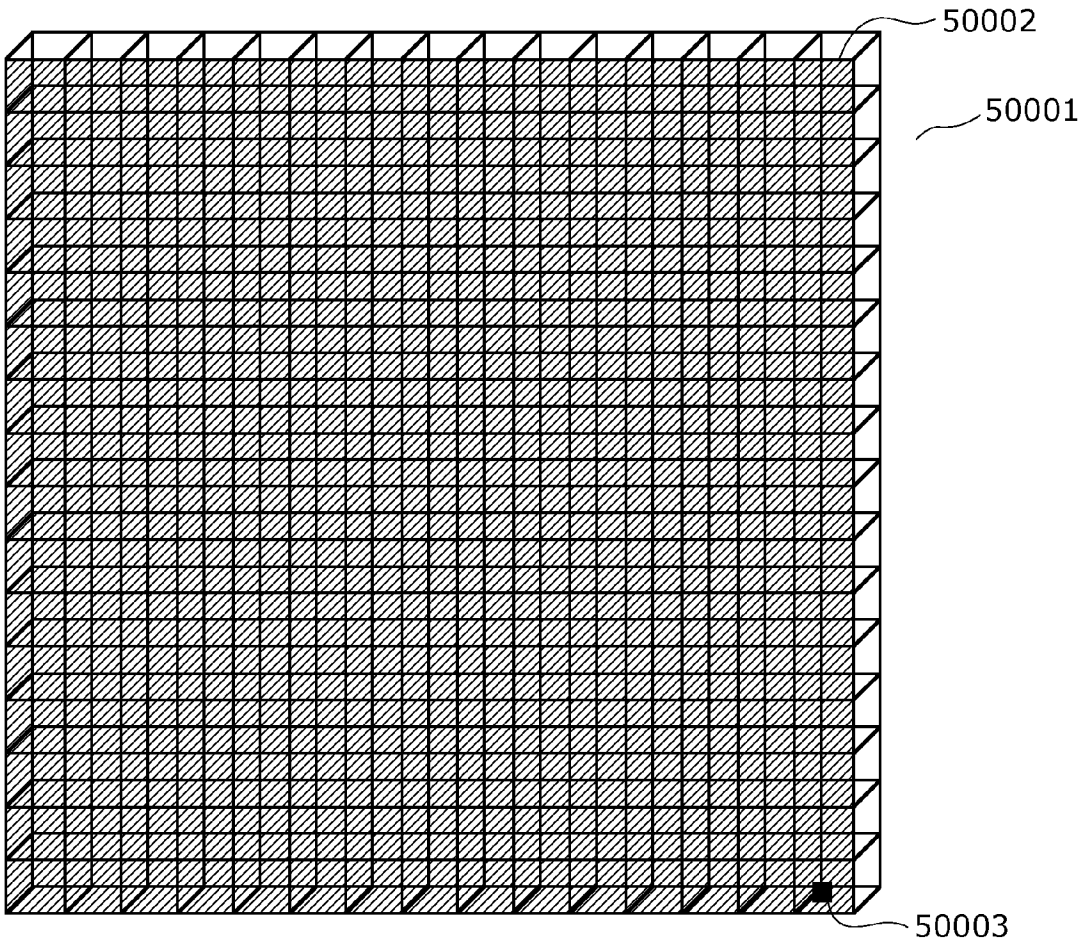
FIG. 39 is the first diagram showing a second related art.
Figure 40:
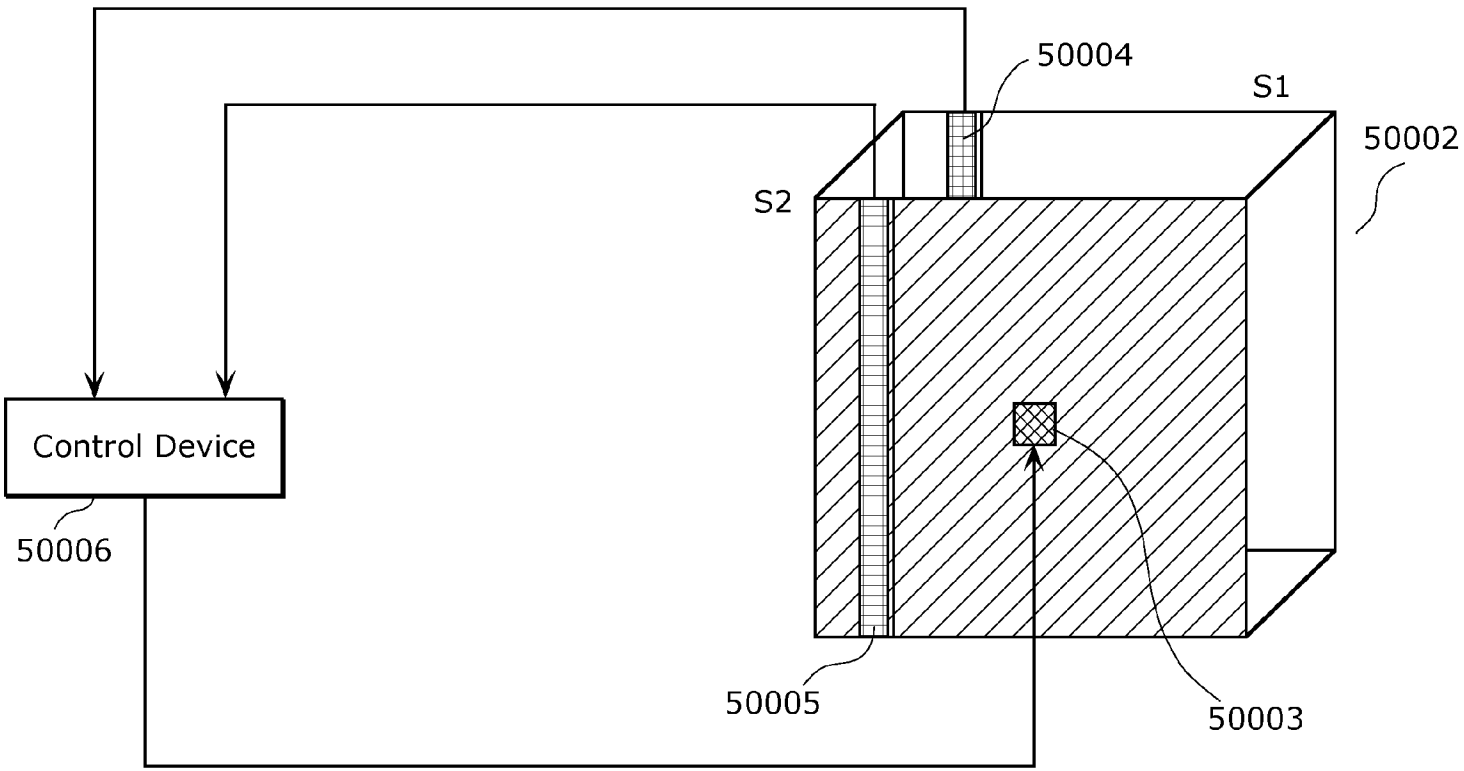
FIG. 40 is the second diagram showing the second related art.

The second related art disclosed in Patent Literature 2 is described with reference to FIGS. 39 and 40. In FIG. 39, 50001 denotes a high transmission loss panel, 50002 denotes a cell, and 50003 denotes an actuator. In FIG. 40, 50004 denotes a first sensor provided to a wall surface S1 of the cell 50002, 50005 denotes a second sensor provided to a wall surface S2 of the cell 50002, and 50006 denotes a control device.

The high transmission loss panel 50001 includes a plurality of arranged cells 5002. Each of the cells 50002 reduces received noise by the feed forward control technique. More specifically, based on output signals of the first sensor 50004 and the second sensor 50005, the actuator 50003 is driven by the control signal calculated by the control device 50006. Therefore, the noise passing the high transmission loss panel 50001 is reduced. As a result, sound blocking performance is improved.

On the other hand, besides the technique of reducing noise (unnecessary sound) transferring a wall, there is another technique of transferring necessary sound (TV sound or the like) to a listening position only. It is so-called directionality control.

There have been old basic directionality control techniques using a geometric shape, such as a horn speaker. This technique relatively easily obtains a directionality in a high-frequency band. However, in order to obtain a sharp directionality in a low-frequency band, a speaker having a large bore or a long depth is necessary. A size of the speaker is therefore increased. In order to address the problem, the following technique is recently often used as the third related art.

(1) Parametric Speaker (Ultrasonic Speaker)

It is a method of demodulating original audio signal in air from ultrasound modulated from audio signal, by using non-linearity of air with respect to ultrasound. This method can obtain a sharp directionality. (See Patent Literature 3)

(2) Array Speaker (Tone Saule Speaker)

This method can obtain a directionality by synthesizing sound emitted from a plurality of speakers arranged in a straight line. In analog method, a directionality in a low-frequency band is determined based on an array length. It is therefore impossible to decrease a speaker size in controlling a directionality in a low frequency band. However, in digital method, it is possible to control a directionality in a wide frequency band from a low frequency band to a high frequency band (see Patent Literature 4).

Figure 41A:
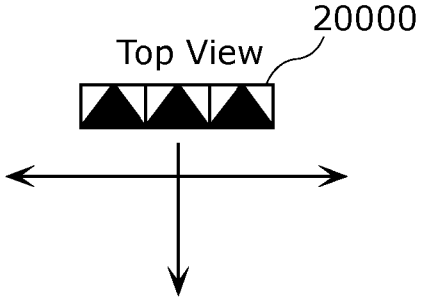
FIG. 41A is a top view of a third related art.
Figure 41B:
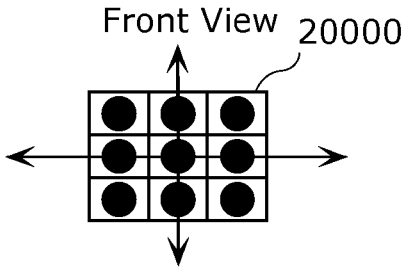
FIG. 41B is a front view of the third related art.
Figure 41C:
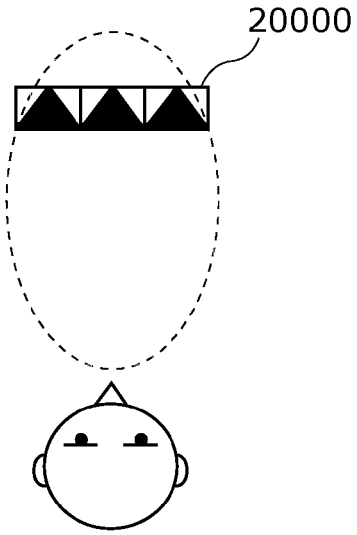
FIG. 41C is a diagram showing a use state of the third related art.

Each of FIGS. 41A to 41C shows an example of an arrangement of speakers in an array speaker. Each arrow in FIGS. 41A and 41B shows a direction to which a directionality can be controlled. Since it is generally assumed that a listener is in front of the speakers, FIG. 41C shows that a sharp directionality is set in front of the speakers.

In general, speakers in an array speaker are arranged in a straight line. However, since parametric speakers are commonly arranged in a planar shape (in a matrix), the planar arrangement is used in the description. A speaker array 20000 is a set of a plurality of speakers. If the speakers are arranged in a planar manner, it is possible to control directionalities leftwards, rightwards, upwards, downwards, and forwards. Basically, the directionality control is performed to intensify sound in a desired direction (as a result, relatively, a reproduced sound pressure is decreased in an undesired direction). In general, control is performed to offer a sharp directionality forwards, namely, in a direction to the listener. As a result, it is possible to transfer necessary sound such as TV sound to the listener, and prevent the sound from transferring to other directions except the direction of the listener.

Meanwhile, in the first and second related arts, in order to reduce noise transferring a wall, it is basically necessary to perform noise control on the entire wall. In this case, in the case of FIG. 38, a large number of the vibration sensors 40003 and the actuators 40002 are necessary. Even in the cases of FIGS. 39 and 40, a large number of the first sensors 50004, the second sensors 50005, and the actuators 50003 are necessary. As a result, an arithmetic operation amount is increased.

Here, in order to clarify the problems in the first and second related arts, an area of a wall blocking noise is varied, and the resulting reduced noise amounts in a target space to be controlled are compared to one another by using acoustic simulation.

Figure 42:
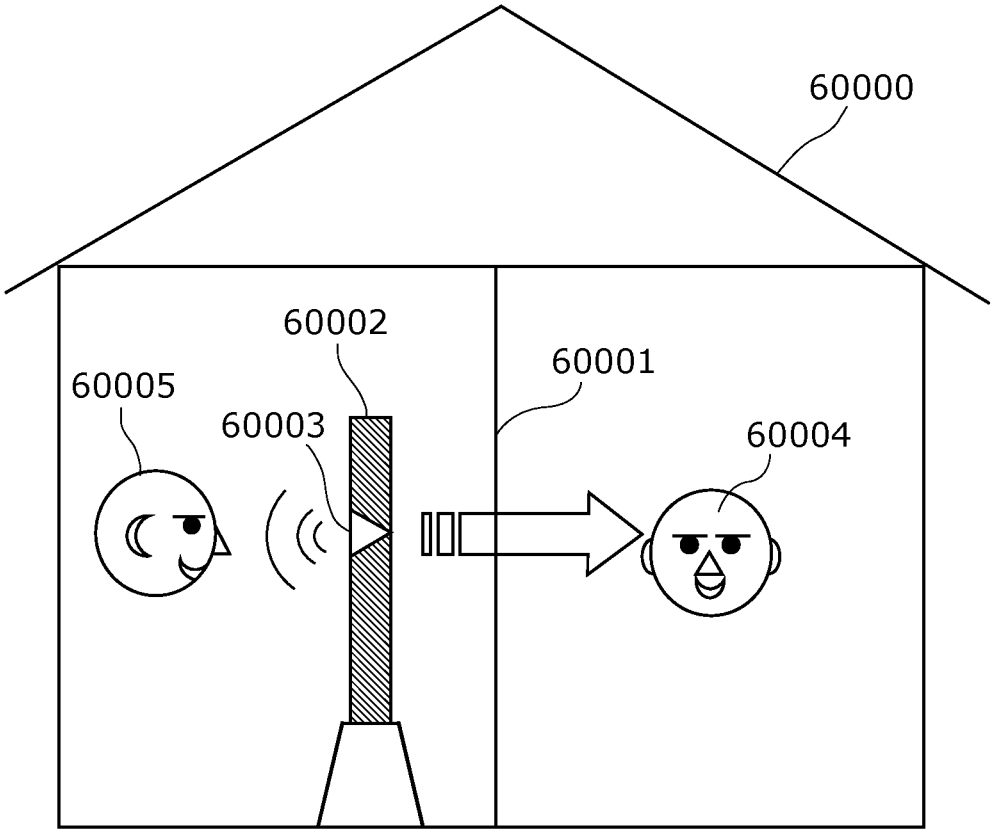
FIG. 42 is a diagram showing a situation where TV sound in a house leaks to a next-door room.

FIG. 42 shows an example where when a person 60005 in a room in a house 60000 watches a TV 60002, the sound reproduced from a speaker 60003 in the TV 60002 enters a next-door room through a wall 60001. Therefore, the next-door room where a person 60004 stays is the target space for which the noise is to be reduced to be quiet. Since noise (TV sound) enters the next-door room through the wall 60001, if the noise from the wall 60001 can be blocked, it is supposed to be possible to reduce noise in the entire target space where the person 60004 is.

Figure 43A:
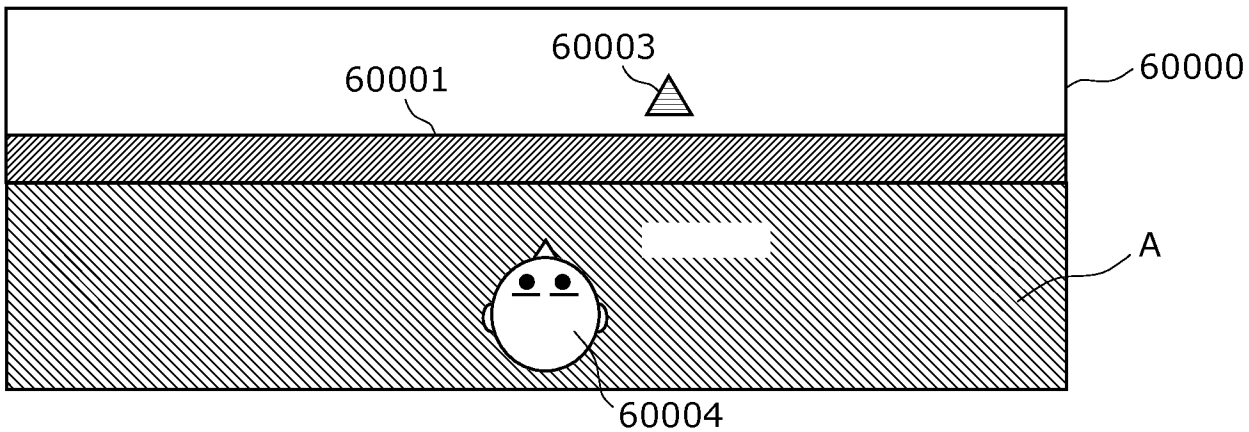
FIG. 43A is the first diagram showing acoustic simulation based on FIG. 42.
Figure 43B:
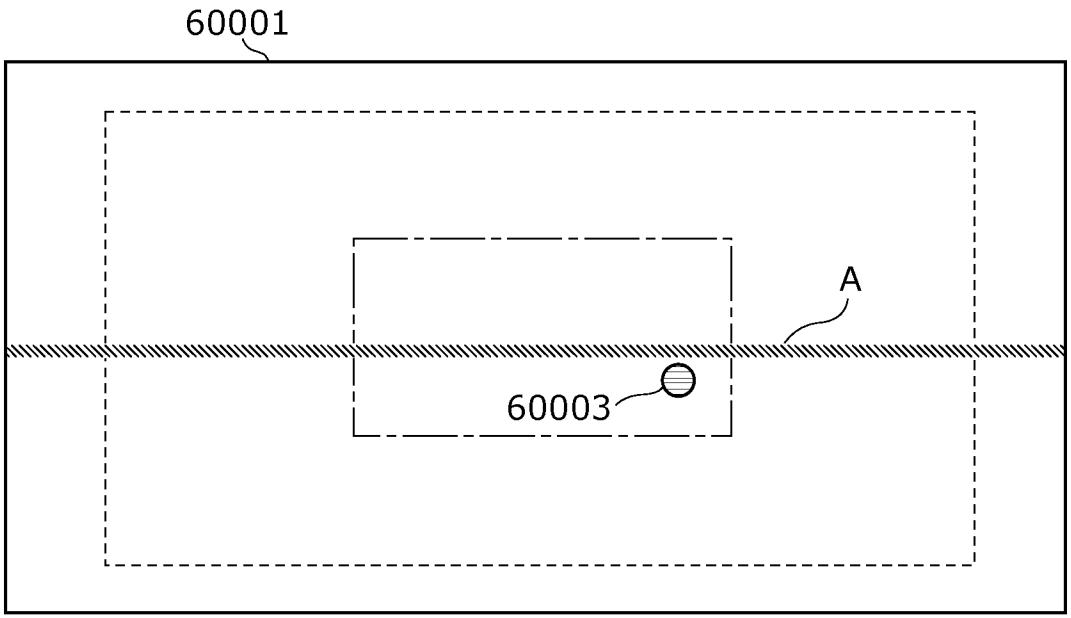
FIG. 43B is the second diagram showing acoustic simulation model based on FIG. 42.

Each of FIGS. 43A and 43B shows an analysis model based on FIG. 42. More specifically, FIG. 43A is a top view of the house 60000 (a length-to-breadth ratio is not specific but just an example), and FIG. 43B shows the wall 60001 viewing from the target space. More specifically, the speaker 60003 corresponding to a reproduction speaker embedded in a TV is used as a sound source to produce noise. A noise reduction amount is determined by calculating a difference between (a) sound pressure distribution in the target space which is caused by vibration of the wall 60001 and (b) sound pressure distribution in the target space when the noise transferring through the wall 60001 is blocked by a predetermined amount (in other words, when vibration of the wall 60001 is reduced by a predetermined amount). Here, the situation where a relatively small region surrounded by a broken line on the wall 60001 is a noise-blocking region, the situation where a relatively large region surrounded by a dotted line is a noise-blocking region, and the situation where the entire wall 60001 surrounded by a solid line is a noise-blocking region are compared to one another. Here, the analysis surface is shown as a plane A (hatched) in FIGS. 43A and 43B.

Figure 44A:
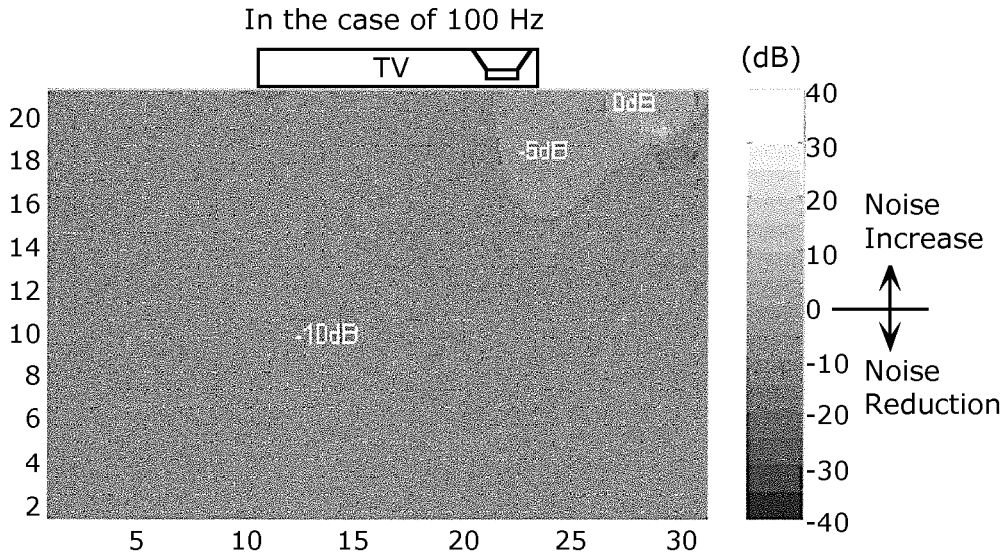
FIG. 44A is the first graph showing analysis results of acoustic simulation model (in the case of 100 Hz).
Figure 44B:
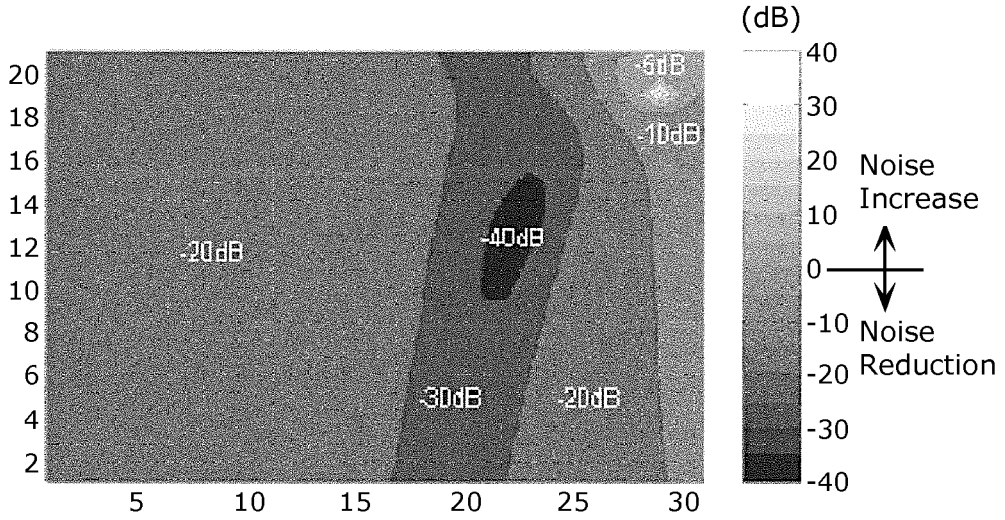
FIG. 44B is the second graph showing analysis results of acoustic simulation (in the case of 100 Hz).
Figure 45A:
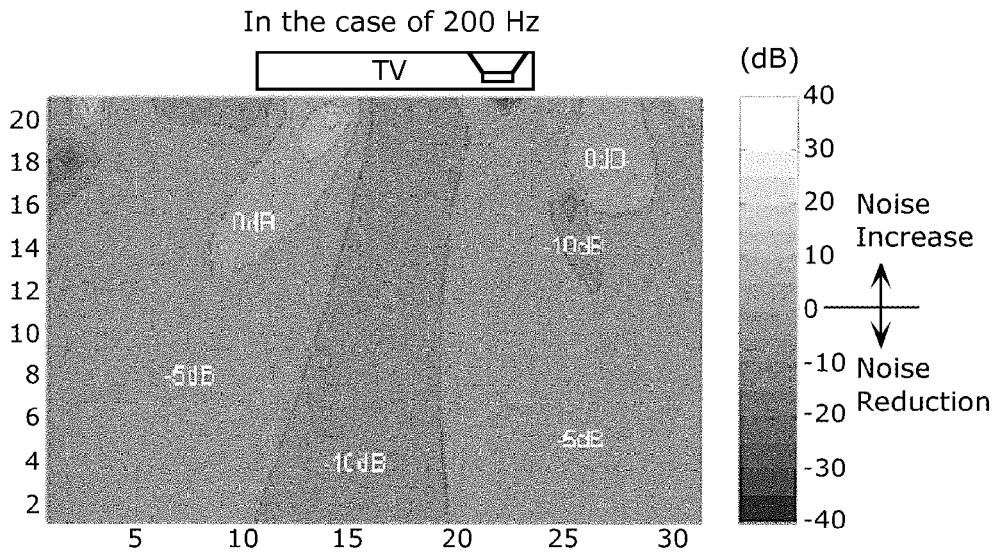
FIG. 45A is the first graph showing analysis results of acoustic simulation (in the case of 200 Hz).
Figure 45B:
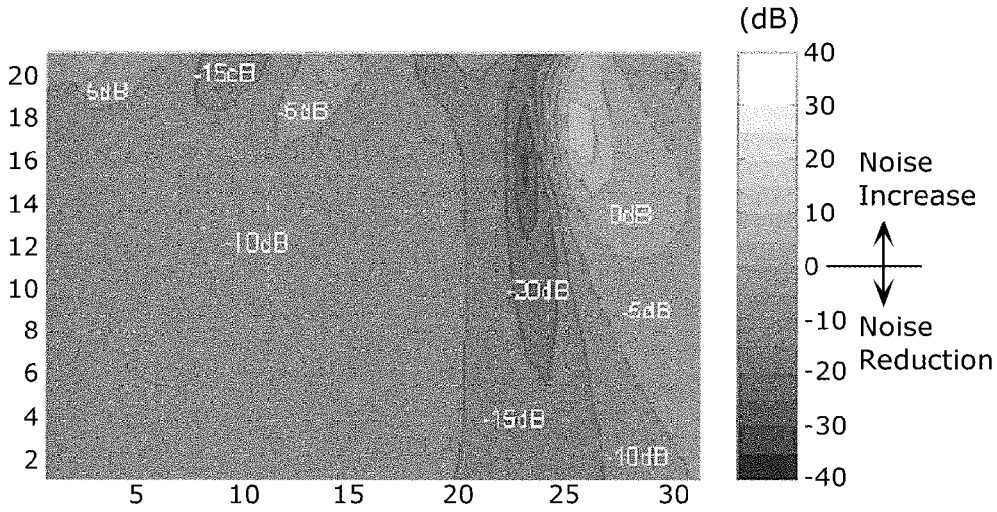
FIG. 45B is the second graph showing analysis results of acoustic simulation (in the case of 200 Hz).
Figure 46A:
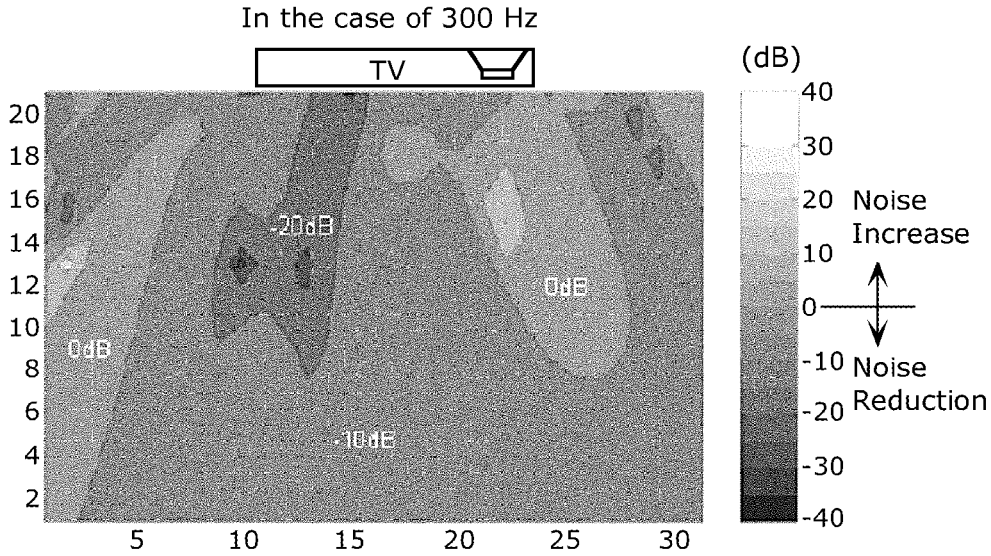
FIG. 46A is the first graph showing analysis results of acoustic simulation (in the case of 300 Hz).
Figure 46B:
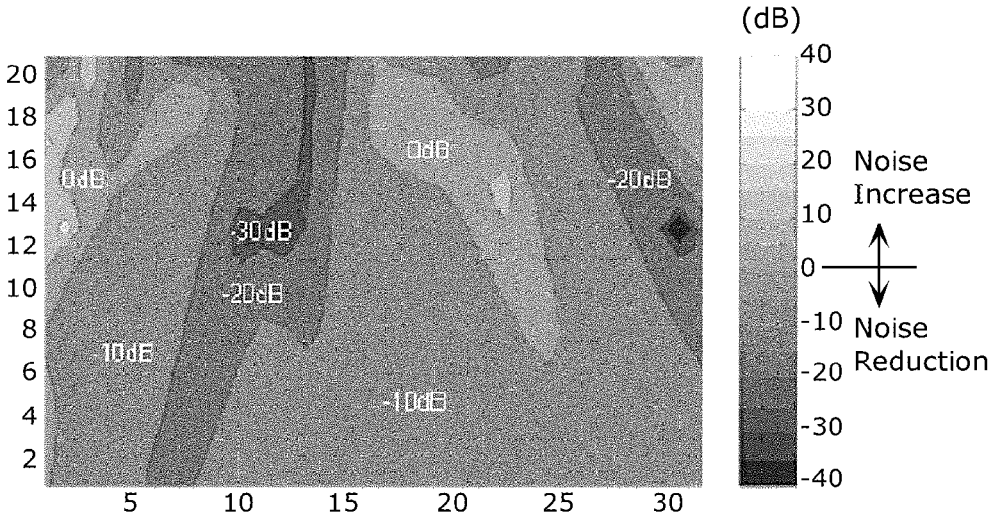
FIG. 46B is the second graph showing analysis results of acoustic simulation (in the case of 300 Hz).
Figure 47A:
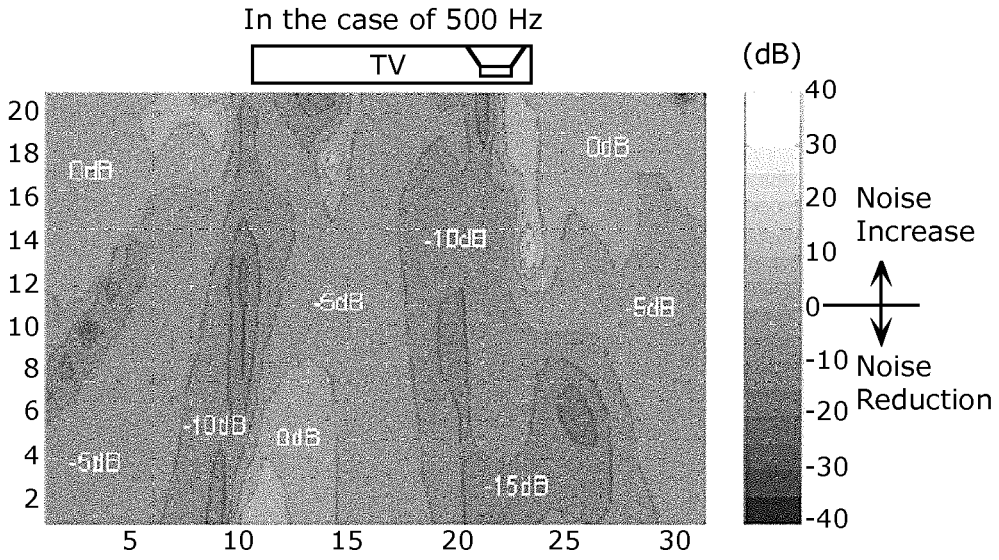
FIG. 47A is the first graph showing analysis results of acoustic simulation (in the case of 500 Hz).
Figure 47B:
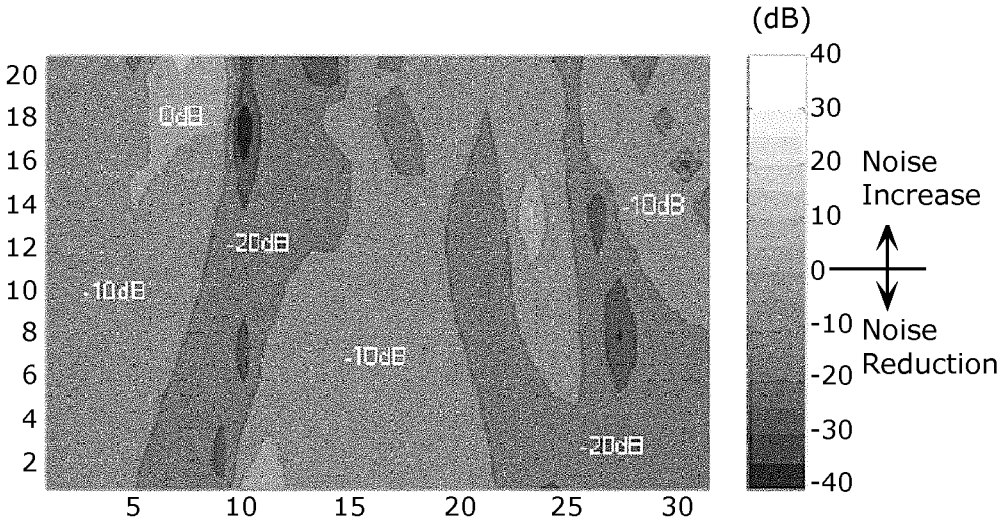
FIG. 47B is the second graph showing analysis results of acoustic simulation (in the case of 500 Hz).

FIGS. 44A and 44B show the case where a frequency of noise is 100 Hz. FIGS. 45A and 45B show the case where a frequency of noise is 200 Hz. FIGS. 46A and 46B show the case where a frequency of noise is 300 Hz. FIGS. 47A and 47B show the case where a frequency of noise is 500 Hz. Each of FIGS. 44A, 45A, 46A, and 47A shows a result of blocking noise by 20 dB on the region (small area) surrounded by the broken line in FIG. 43B. Each of FIGS. 44B, 45B, 46B, and 47B shows a result of blocking noise by 20 dB on the region (middle-size area) surrounded by the dotted line in FIG. 43B.

The sound pressure distribution shows a sound pressure after noise blocking, with reference to 0 dB as a sound pressure before the blocking. More specifically, a minus value (such as −20 dB) indicates noise reduction, while a darker display indicates higher reduction effects (numeral values of reduction effects are inserted in white to be eligible). At any frequency, the situation where noise blocking is performed on the region (middle-size area) surrounded by the dotted line) offers higher noise reduction effects in a wider area, in comparison to the area (small area) surrounded by the broken line.

Figure 48A:
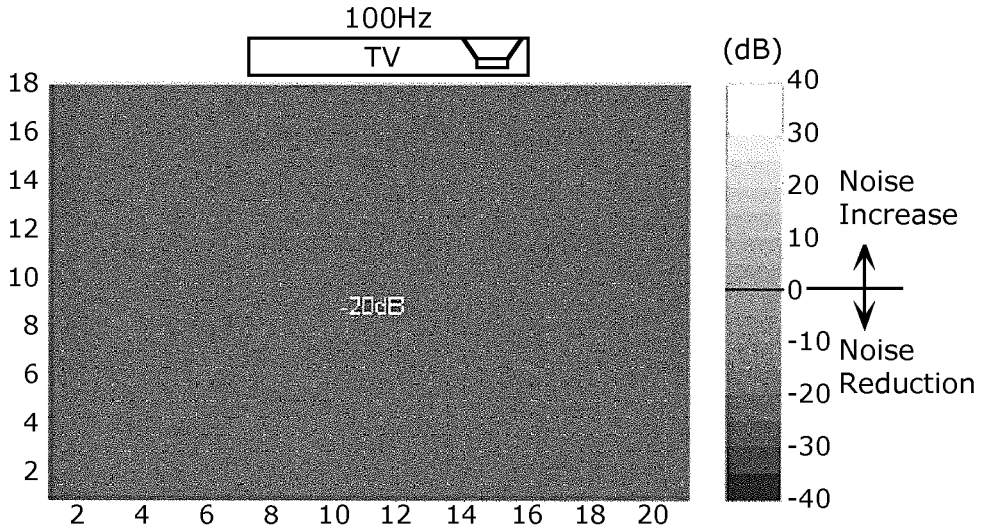
FIG. 48A is the third graph showing analysis results of acoustic simulation (in the case of 100 Hz).
Figure 48B:
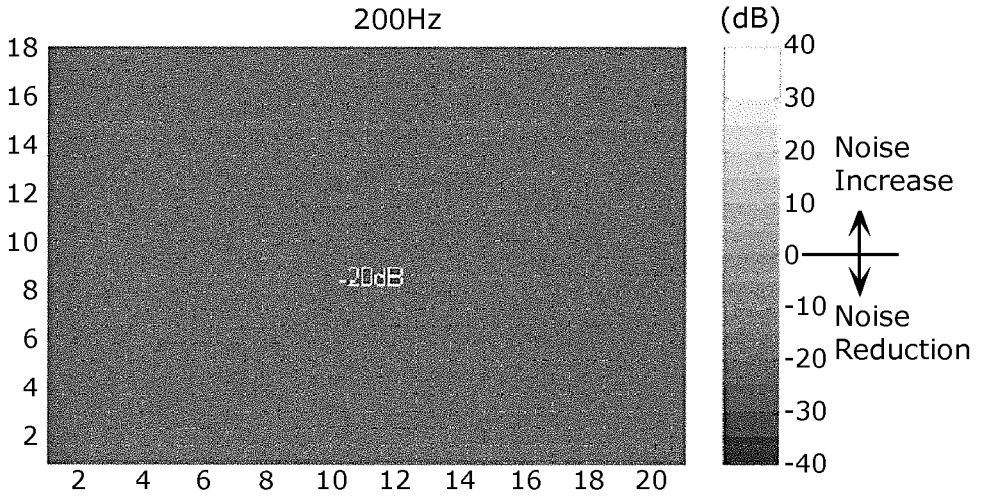
FIG. 48B is the third graph showing analysis results of acoustic simulation (in the case of 200 Hz).

FIGS. 48A to 48D show results of blocking noise by 20 dB on the entire wall 60001 (large area). In more detail, FIG. 48A shows the case where a frequency of noise is 100 Hz. FIG.

Figure 48C:
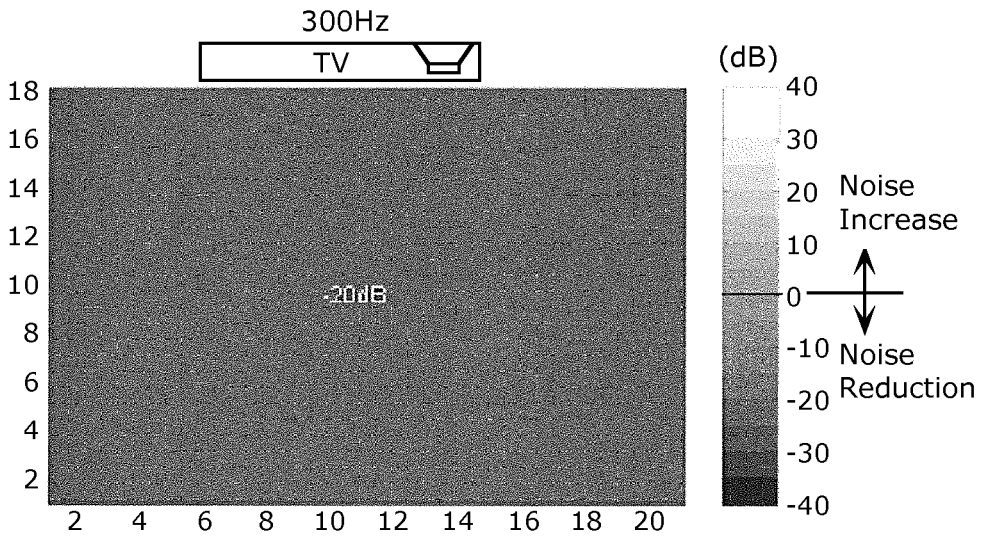
FIG. 48C is the third graph showing analysis results of acoustic simulation (in the case of 300 Hz).
Figure 48D:
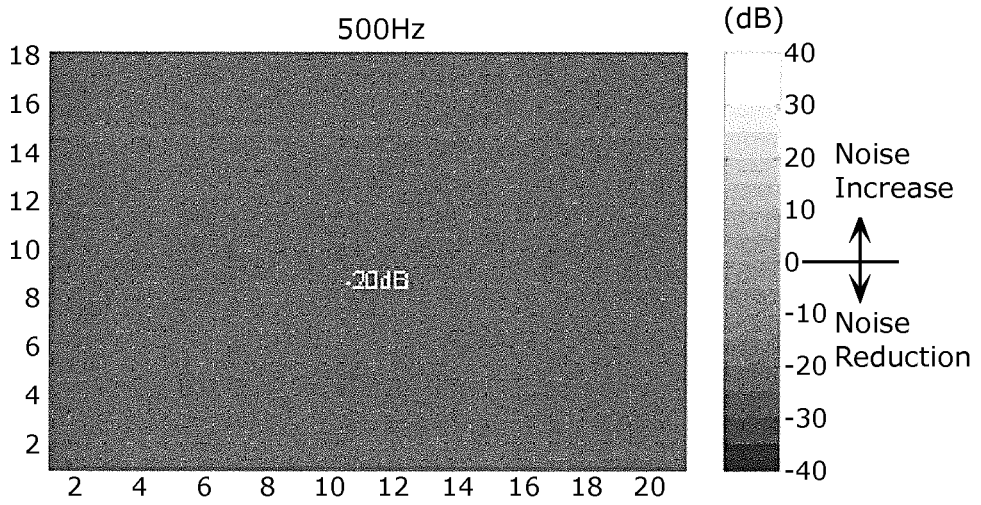
FIG. 48D is the third graph showing analysis results of acoustic simulation (in the case of 500 Hz).

28B shows the case where a frequency of noise is 200 Hz. FIG. 48C shows the case where a frequency of noise is 300 Hz. FIG. 48D shows the case where a frequency of noise is 500 Hz. At any frequency, noise reduction effects of 20 dB is offered to the entire target space.

From the above, in order to produce noise reduction effects in a region as large as possible in the target space, it is necessary to perform homogeneous noise control on a wide surface (ideally, the whole wall) as large as possible of the wall from which noise enters. In other words, in the methods of the first and second related arts, with the increase of the noise reduction amount and the noise-reduced area, more sensors for detecting vibration and more actuators for producing vibration (suppressing noise vibration by the vibration) are necessary. As a result, a huge amount of control arithmetic operations is required.

Moreover, in the use of the technique of the third related art, although each ultrasonic reproduction speakers in a parametric speaker is small and capable of having a sharp directionality, there are problems that conversion efficiency is low, that the technique is not suitable for reproduction in a low-frequency band, and that a listener should be protected from ultrasound, for example.

On the other hand, an array speaker can control a directionality by digital method in a wide frequency band from a low frequency band to a high frequency band. However, since a plurality of speakers are arranged in a straight line (for example, horizontally) or in a planar shape, the array has a long length and cannot have a compact shape.

Therefore, in order to address the above-described problems, an object of the present invention is to provide a diffracted sound reduction device that has a compact shape and a structure with a small arithmetic operation amount and a low cost, and that is capable of reducing a sound pressure reproduced by a speaker in an undesired direction and correctly transferring the sound in a desired direction. Hereinafter, in the description, "diffracted sound" refers to generic sound except sound directly arrived at a listener from a speaker.

In particular, an object of the present invention is to reproduce the same acoustic properties at a listening position in a direction of transferring sound regardless of operating the diffracted sound reduction device, so as to control diffracted sound without causing discomfort on the listener. Still another object of the present invention is to offer the same effects even if the present invention is attached to commercially available TVs and the like.

The following describes embodiments of the present invention with reference to the drawings. It should be noted that all the embodiments described below are specific examples of the present invention. Numerical values, shapes, materials, constituent elements, arrangement positions and the connection configuration of the constituent elements, steps, the order of the steps, and the like described in the following embodiments are merely examples, and are not intended to limit the present invention. The present invention is characterized by the appended claims. Therefore, among the constituent elements in the following embodiments, constituent elements that are not described in independent claims that show the most generic concept of the present invention are described as elements constituting more desirable configurations, although such constituent elements are not necessarily required to achieve the object of the present invention.

Embodiment 1

A structure of a diffracted sound reduction device according to Embodiment 1 is described. FIG. 1 is a diagram showing a configuration of speakers in a diffracted sound reduction device according to Embodiment 1.

In FIG. 1, (a) is a front view of a control speaker 1 (the control speaker 1 serves also as a TV speaker, for example), (b) is a right side view of the speaker shown in (a), and (c) is a top view of the speaker shown in (a). As seen in the figure, in the diffracted sound reduction device, control speakers 2 to 6 are arranged around the control speaker 1 so that at least one control speaker is provided above, below, on the left of, on the right of, and behind the control speaker 1. Then, microphones 11 to 16 are provided to face the control speakers 1 to 5, respectively, to serve as control points. Here, the control speaker 1 serves also as a reproduction speaker that reproduces necessary sound (for example, TV sound). The microphone 11 is provided at a position of a listener (hereinafter, referred to also as a "listener's position"), or in a direction towards the listener. Regarding the position of the microphone 11, the position of the control point may be the same as the position of the listener.

That is, the diffracted sound reduction device according to the present embodiment controls a sound pressure at each of the control points provided at the listener's position and other points except the listener's position. More specifically, the diffracted sound reduction device includes: a reproduction speaker 1 that outputs a reproduced sound having properties indicated by an input signal; and at least two control speakers (1 to 6) each of which reproduces a control signal indicating properties of control sound to reduce a sound pressure of diffracted sound, which is a part of the reproduced sound, that arrives at each of the control points except the listener's position. As described later, the diffracted sound reduction device includes control filters that generate the respective control signals by filtering the input signal. Here, the reproduction speaker is arranged to face the listener. Each of the control speakers is arranged around the reproduction speaker not to face the listener. Furthermore, the control points are arranged to face the reproduction speaker and the respective control speakers.

Here, the following two kinds of control effects of the diffracted sound reduction device according to the present embodiment are desired. First, sound reproduced by the control speaker 1 (serving also as the reproduction speaker) keeps the same properties at the microphone 11, regardless whether or not the diffracted sound reduction device according to the present embodiment performs the diffracted sound reduction control. Second, in comparison to diffracted sound which is a part of the reproduced sound reproduced by the control speaker 1 in the case where the diffracted sound reduction device according to the present embodiment does not perform the control, each of the microphones 12 to 16 can reduce a sound pressure by a predetermined amount in the case where the diffracted sound reduction device according to the present embodiment performs the diffracted sound reduction control.

More specifically, when the diffracted sound reduction device according to the present embodiment does not perform control, it is assumed that a transfer characteristic from the control speaker 1 to the microphone 11 is D1, a transfer characteristic from the control speaker 1 to the microphone 12 is D2, a transfer characteristic from the control speaker 1 to the microphone 13 is D3, a transfer characteristic from the control speaker 1 to the microphone 14 is D4, a transfer characteristic from the control speaker 1 to the microphone 15 is D5, and a transfer characteristic from the control speaker 1 to the microphone 16 is D6. Here, if the diffracted sound by the diffracted sound reduction device according to the present embodiment is reduced to 1/10 (=reduced to −20 dB), the control have to be performed so that the microphone 11 keeps D1, the microphone 12 has D2/10, the microphone 13 has D3/10, the microphone 14 has D4/10, the microphone 15 has D5/10, and the microphone 16 has D6/10. In order to achieve the above, in the diffracted sound reduction device according to the present embodiment, each of control filters 21 to 26 shown in FIG. 2 performs signal processing on an input signal received from the sound source 20 (for example, an output device of TV sound) to generate a control signal, and causes a corresponding one of the control speakers 1 to 6 to reproduce the control signal. Here, in order to offer the above-described control effects, how to determine the control properties of the control filters 21 to 26 is important. More specifically, each of the control filters 21 to 26 generates the control signal so that a sound pressure of diffracted sound which is a part of the reproduced sound is reduced to be lower than a sound pressure of direct sound that arrives at the listener's position.

It should be noted that the control properties of the control filters 21 to 26 may be determined by the diffracted sound reduction device according to the present embodiment, and values predetermined by an external calculator may be stored in the diffracted sound reduction device according to the present embodiment.

Therefore, the following describes the method of determining the control properties.

Figure 3:
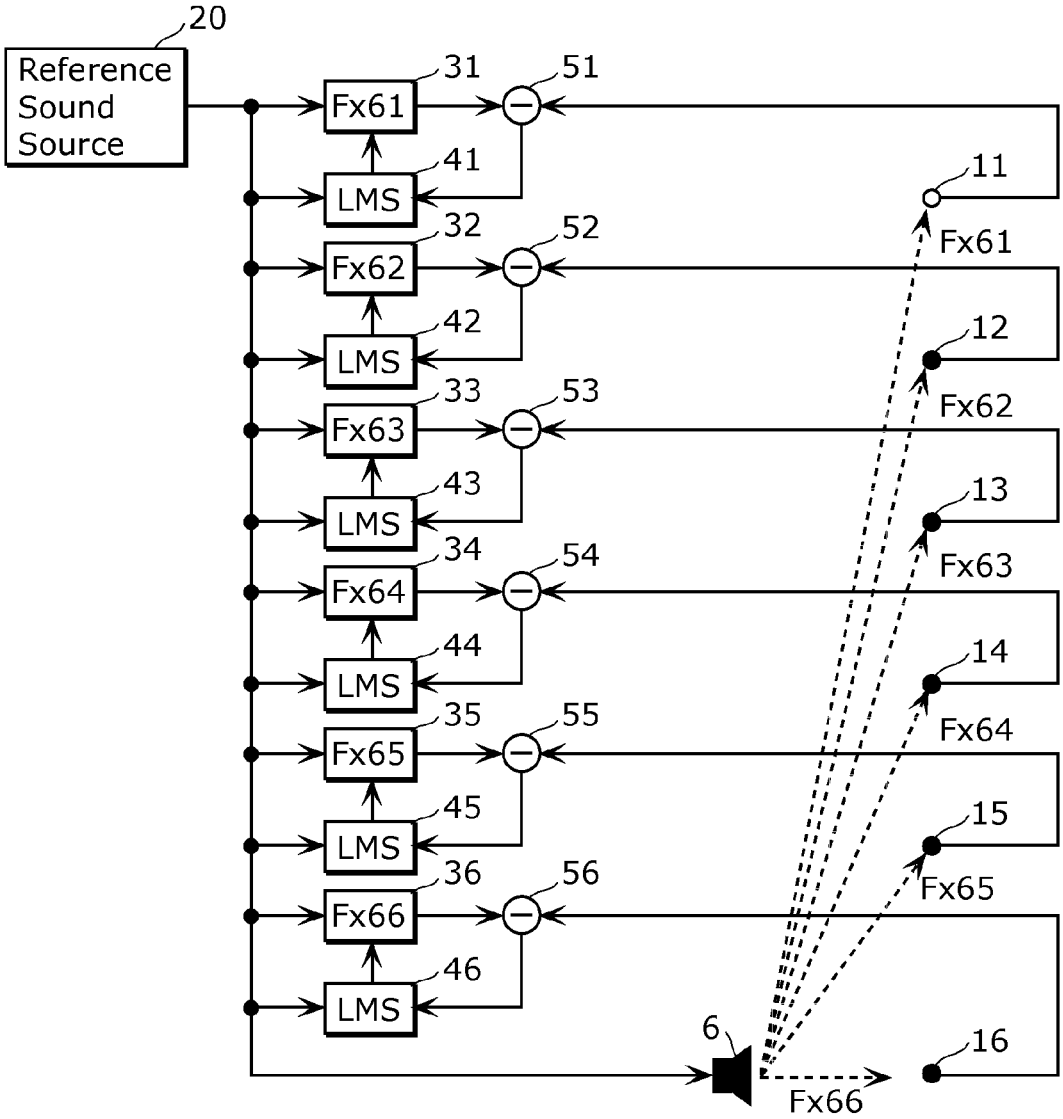
FIG. 3 is a block diagram of signal processing performed by determining transfer characteristics between control speakers and microphones.

First, it is necessary to determine a transfer characteristic from each of the control speakers 1 to 6 to each of the microphones 11 to 16. FIG. 3 is a block diagram of signal processing for determining a transfer characteristic from the control speaker 6 to each of the microphones 11 to 16. In FIG. 3, the measurement signal (hereinafter, referred to also as an "input signal") provided from the reference sound source 20 is reproduced by the control speaker 6 as reference sound. At the same time, the reference signal provided from the reference sound source 20 is provided to Fx filters 31 to 36 and LMS arithmetic units 41 to 46. Each of the Fx filters 31 to 36 performs a convolution operation on its control coefficient and the reference signal received from the reference sound source 20, and provides the convolution result to subtractors 51 to 56, respectively. Meanwhile, the reference sound reproduced by the control speaker 6 is detected by the microphones 11 to 16 which provide the respective reference sound to the subtractors 51 to 56, respectively. Then, each of the subtractors 51 to 56 subtracts the corresponding output signal of the Fx filters 31 to 36 from the corresponding detected signal of the microphones 11 to 16, respectively, and provide the results to the LMS arithmetic units 41 to 46, respectively. Considering the reference signal from the reference sound source 20 as a reference signal and the output signals of the subtractors 51 to 56 as error signals, the LMS arithmetic units 41 to 46 perform Least Mean Square (LMS) operation to minimize the value of the respective error signals. More specifically, each of the LMS arithmetic units 41 to 46 calculates a coefficient updating amount of corresponding one of the Fx filters 31 to 36, respectively, and adds the updating amount to the current control coefficient to generate a new control coefficient. Thereby, the control coefficients (Fx61 to Fx66) of the Fx filters 31 to 36 are updated. By repeating the series of operations, the respective error signals of the LMS arithmetic units 41 to 46, namely, the output signals of the subtractors 51 to 56 approach minimum values (ideally, approach almost 0). As a result, each of the properties of the Fx filters 31 to 36 (=control coefficients) is approximated to the transfer characteristic from the control speaker 6 to a corresponding one of the microphones 11 to 16. It should be noted that the reference signal desirably includes sound of various frequencies as much as possible. For example, it is considered that white noise is used as the reference signal.

Practically, each of the LMS arithmetic units repeats the above-described LMS operation until, for example, all of the error signals become smaller than a predetermined threshold values, so that the transfer characteristic Fx61 from the control speaker 6 to the microphone 11 is determined in the Fx filter 31, the transfer characteristic Fx62 from the control speaker 6 to the microphone 12 is determined in the Fx filter 32, . . . , and the transfer characteristic Fx66 from the control speaker 6 to the microphone 16 is determined in the Fx filter 36. It should be noted that, regarding the conditions under which the LMS arithmetic unit determines to terminate the repetition of the LMS operations, the LMS arithmetic unit may determine the termination if at least one error signal is smaller than a predetermined threshold value. It is also possible that the LMS arithmetic unit determines the termination if a sum of all error signals is smaller than a predetermined threshold value.

Although it has been described that the control speaker 6 is used as an example, the same can be determined in the case of the control speakers 1 to 5. More specifically, in the case of the control speaker 1, the transfer characteristics Fx11 to Fx16 are determined. In the case of the control speaker 2, the transfer characteristics Fx21 to Fx26 are determined. In the case of the control speaker 3, the transfer characteristics Fx31 to Fx36 are determined. In the case of the control speaker 4, the transfer characteristics Fx41 to Fx46 are determined. In the case of the control speaker 5, the transfer characteristics Fx51 to Fx56 are determined.

Figure 4:
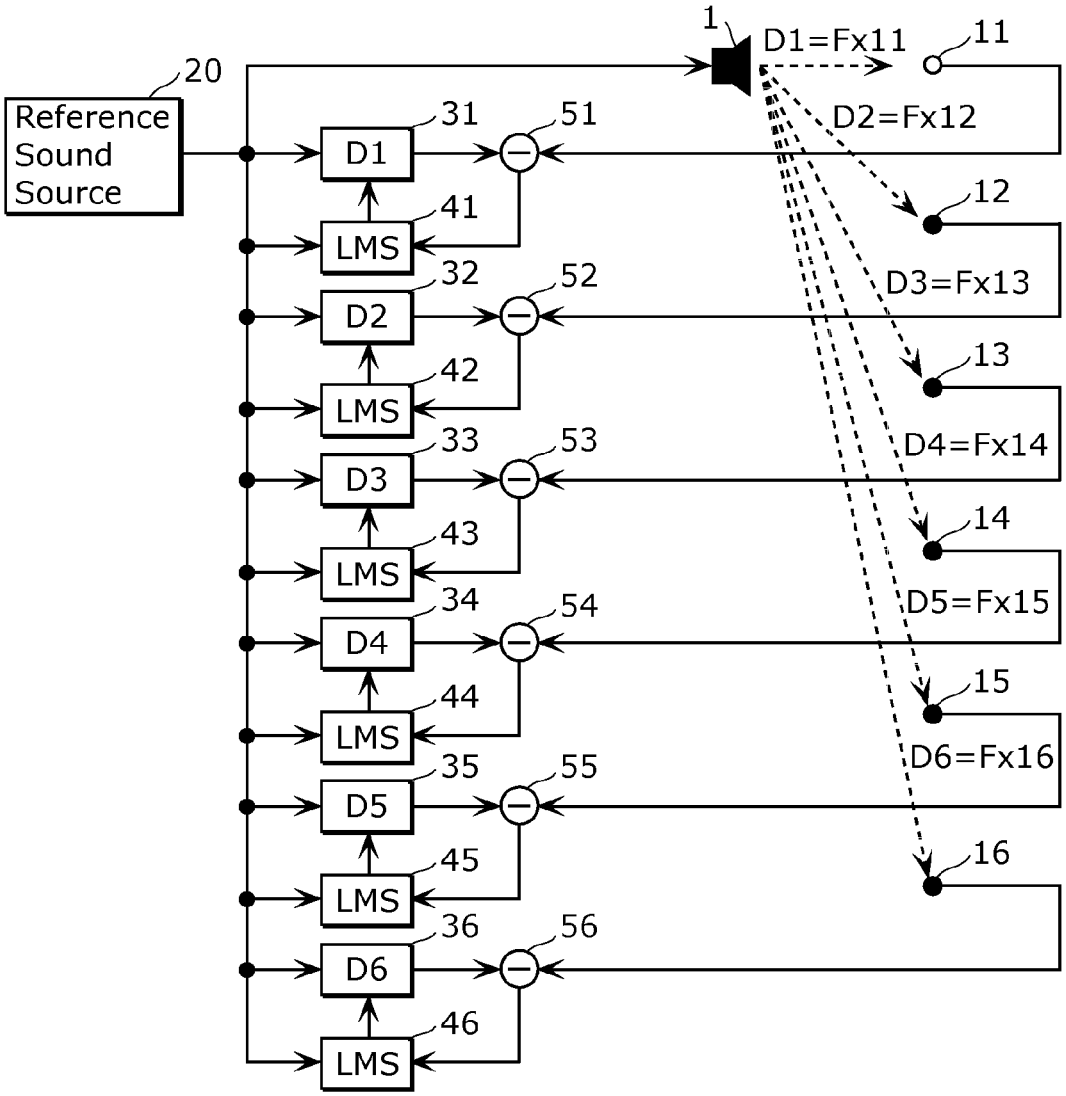
FIG. 4 is a block diagram of signal processing to determine transfer characteristics of diffracted sound to be controlled.

Next, it is necessary to measure the diffracted sound to be controlled. The measurement is performed in the same manner as calculating a transfer characteristic from the control speaker 1 to each of the microphones 11 to 16. FIG. 4 shows a configuration for the measurement. As apparent from comparison between FIG. 4 and FIG. 3, the calculation in FIG. 4 is the same as the calculation of the transfer characteristics Fx11 to Fx16. More specifically, the transfer characteristic Fx11=D1, the transfer characteristic Fx12=D2, the transfer characteristic Fx13=D3, the transfer characteristic Fx14=D4, the transfer characteristic Fx15=D5, and the transfer characteristic Fx16=D6.

Figure 2:
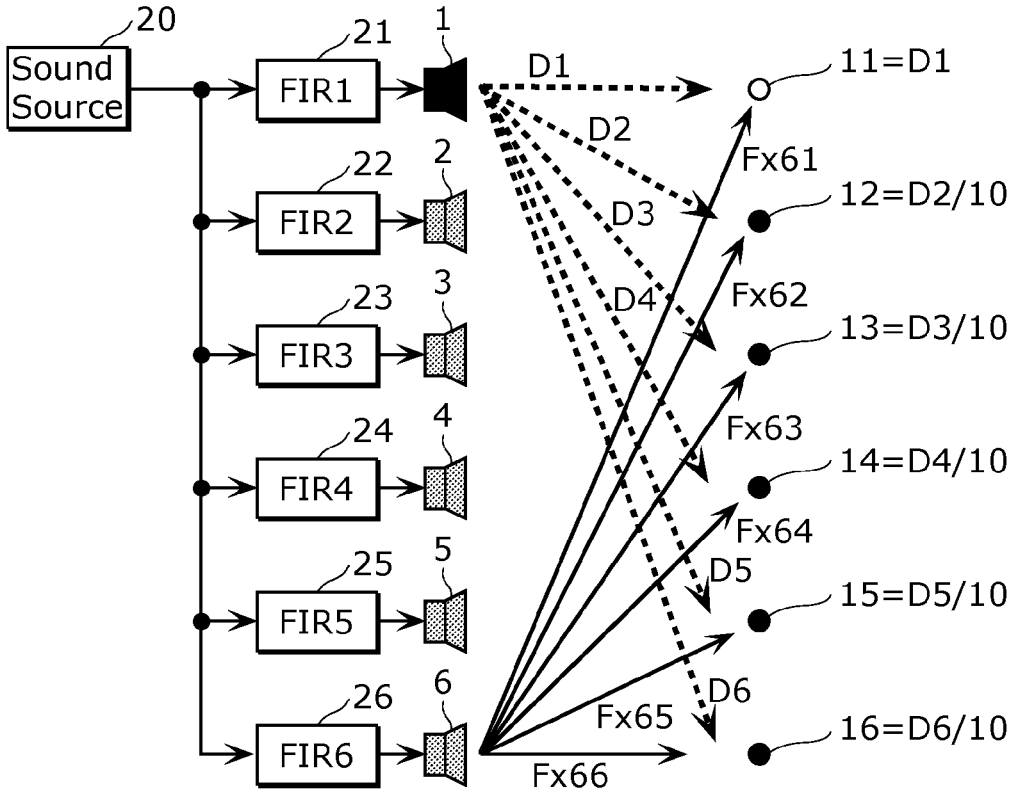
FIG. 2 is a block diagram of signal processing performed by the diffracted sound reduction device according to Embodiment 1.
Figure 5:
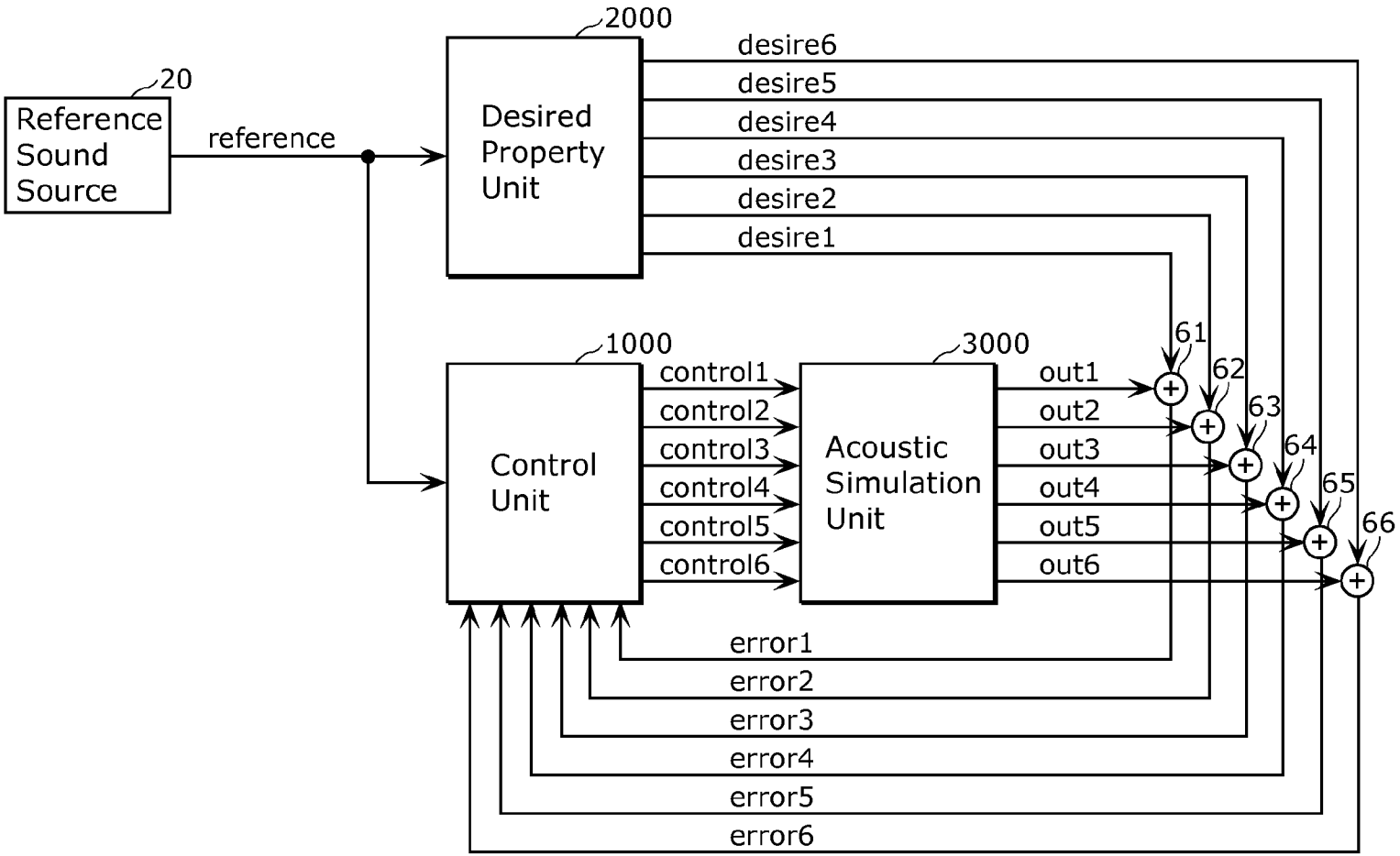
FIG. 5 is an overall block diagram of signal processing to determine control properties of diffracted sound.

Finally, the coefficients of the control filters 21 to 26 in FIG. 2, which are eventual control properties, are determined using the signal processing configuration shown in FIG. 5.

In FIG. 5, the desired property unit 2000 performs predetermined processing on the reference signal from the reference sound source 20 in order to output desired signals. Next, the desired signals are provided to adders 61 to 66, respectively. On the other hand, the reference signal is provided also to the control unit 1000 that performs predetermined processing on the reference signal to output control signals. After that, the acoustic simulation unit 3000 performs processing on the control signals and provides them an output signals to the adders 61 to 66, respectively. Each of the adders 61 to 66 adds the corresponding desired signal and the corresponding output signal together, and provides the resulting signal to the control unit 1000 as an error signal.

Figure 6:
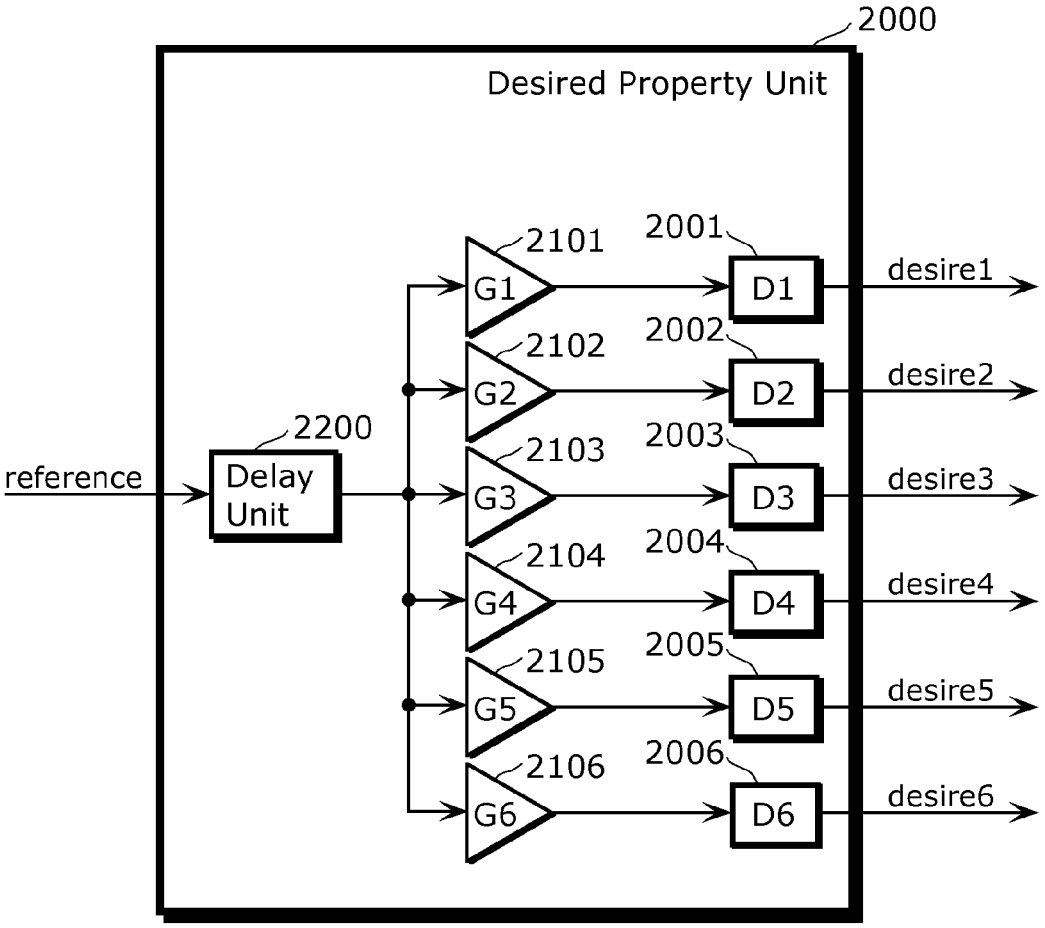
FIG. 6 is a block diagram of internal signal processing performed by the desired property unit shown in FIG. 5.

Here, the desired property unit 2000 in FIG. 5 has a structure as shown in FIG. 6. For desired property filters 2001 to 2006, the transfer characteristics D1 to D6 determined in FIG. 4 are set as coefficients, respectively. For each of level adjusters 2101 to 2106, an arbitrary level can be set. In order to control an arrival level of the diffracted sound transferred from the control speaker 1 to each of the microphones 11 to 16 as described above, a gain of the level adjuster 2101 is set to 1, and a gain of the level adjuster 2102 to 2106 is set to 0.1. A delay unit 2200 is used to set a delay time duration necessary to satisfy causality of the entire system of FIG. 5. Therefore, the input reference signal is delayed by various predetermined delay time durations, and are outputted as a desired signal desire1 having the transfer characteristic D1, a desired signal desire2 having 1/10 of the transfer characteristic D2, a desired signal desire3 having 1/10 of the transfer characteristic D3, a desired signal desire4 having 1/10 of the transfer characteristic D4, a desired signal desire5 having 1/10 of the transfer characteristic D5, and a desired signal desire6 having 1/10 of the transfer characteristic D6, respectively. It should be noted that the desired property unit 2000 does not need to always have the delay unit 2200. As described above, an object of the delay unit 2200 is to satisfy causality of the entire system. Therefore, even if the delay unit outsides the desired property unit 2000 delays the reference signal or the desired signals, the present embodiment can offer the same effects.

Figure 7:
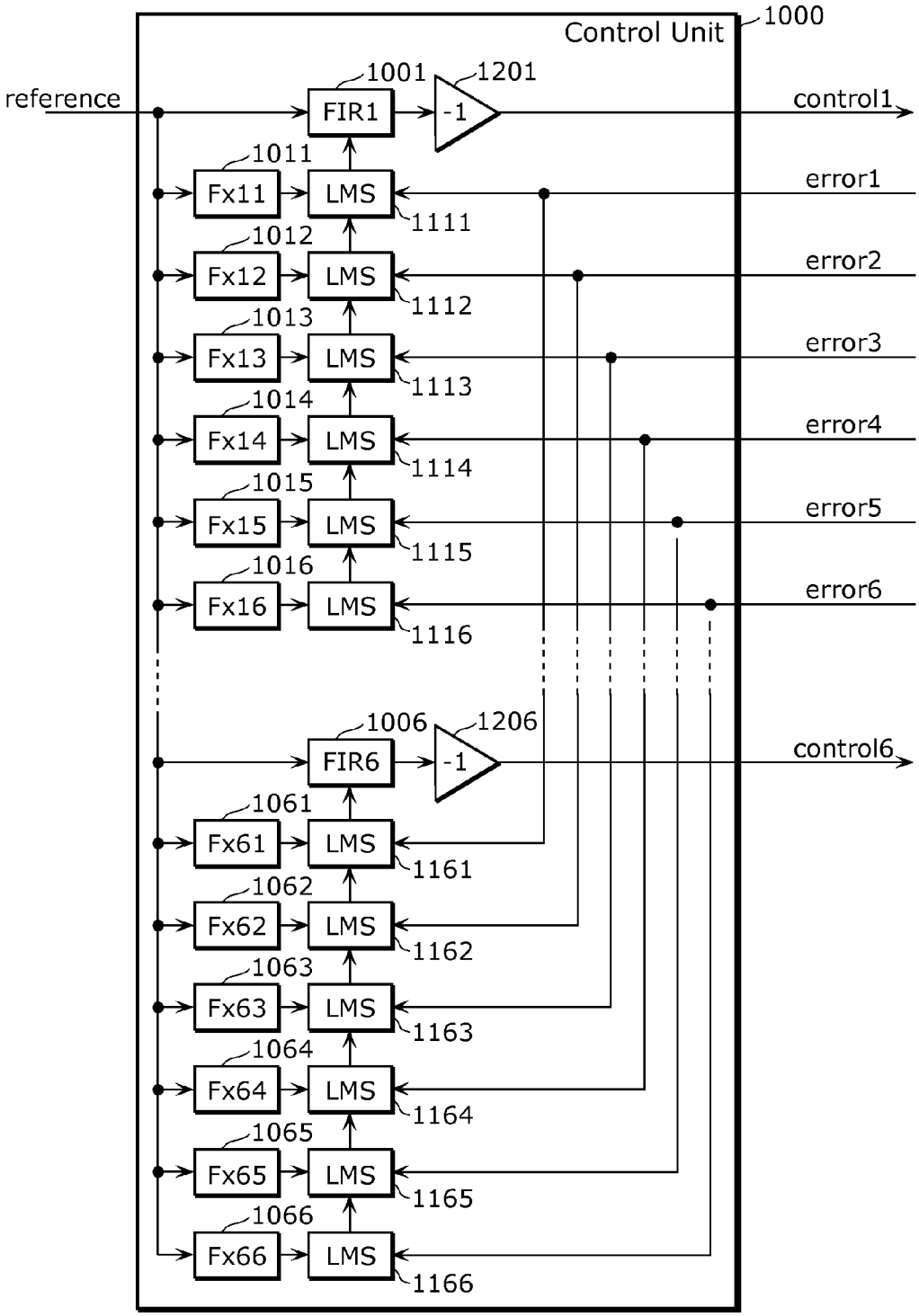
FIG. 7 is a block diagram of internal signal processing performed by the control unit shown in FIG. 5.

FIG. 7 is a block diagram showing the control unit in FIG. 5. In FIG. 7, the transfer characteristics Fx11 to Fx16 determined in FIG. 3 are set as filter coefficients of the Fx filters 1011 to 1106, respectively. Transfer characteristics Fx21 to Fx26 are set as filter coefficients of the Fx filters 1021 to 1026 (not shown), respectively. Transfer characteristics Fx31 to Fx36 are set as filter coefficients of the Fx filters 1031 to 1036 (not shown), respectively. Transfer characteristics Fx41 to Fx46 are set as filter coefficients of the Fx filters 1041 to 1046 (not shown), respectively. Transfer characteristics Fx51 to Fx56 are set as filter coefficients of the Fx filters 1051 to 1056 (not shown), respectively. Transfer characteristics Fx61 to Fx66 are set as filter coefficients of the Fx filters 1061 to 1066, respectively.

In FIG. 7, the control filters 1001 to 1006 perform signal processing on the input reference signal, and phase inverters 1201 to 1206 perform phase inversion on outputs of the control filters 1001 to 1006 to output control signals 1 to 6, respectively. On the other hand, the reference signal is provided also to Fx filters 1011 to 1016, . . . , Fx filters 1061 to 1066, and convolution is performed between the reference signal and each of the transfer characteristics Fx11 to Fx16, . . . , Fx61 to Fx66. Furthermore, the arithmetic operation results of the convolution are provided to the LMS arithmetic units 1111 to 1116, . . . , 1161 to 1166, respectively. The LMS arithmetic units 1111 to 1116, . . . , 1161 to 1166 also receive the error signals 1 to 6. After that, in the same manner as shown in FIG. 3, coefficient updating amounts of the control filters 1001 to 1006 are determined and added to current coefficients of the control filters 1001 to 1006, respectively, to update as next new coefficients. The adaptive signal processing technique of updating a plurality of coefficients of control filters using also a plurality of error signals is called a multiple error LMS algorithm, which is disclosed, for example, in ACTIVE CONTROL OF SOUND (Non-Patent Literature) (P. A. Nelson & S. J. Elliott, ACADEMIC PRESS, pp. 397 to 410).

The control signals 1 to 6 which are signals provided from the control unit 1000 in FIG. 7 are provided to the acoustic simulation unit 3000 in FIG. 5.

Figure 8:
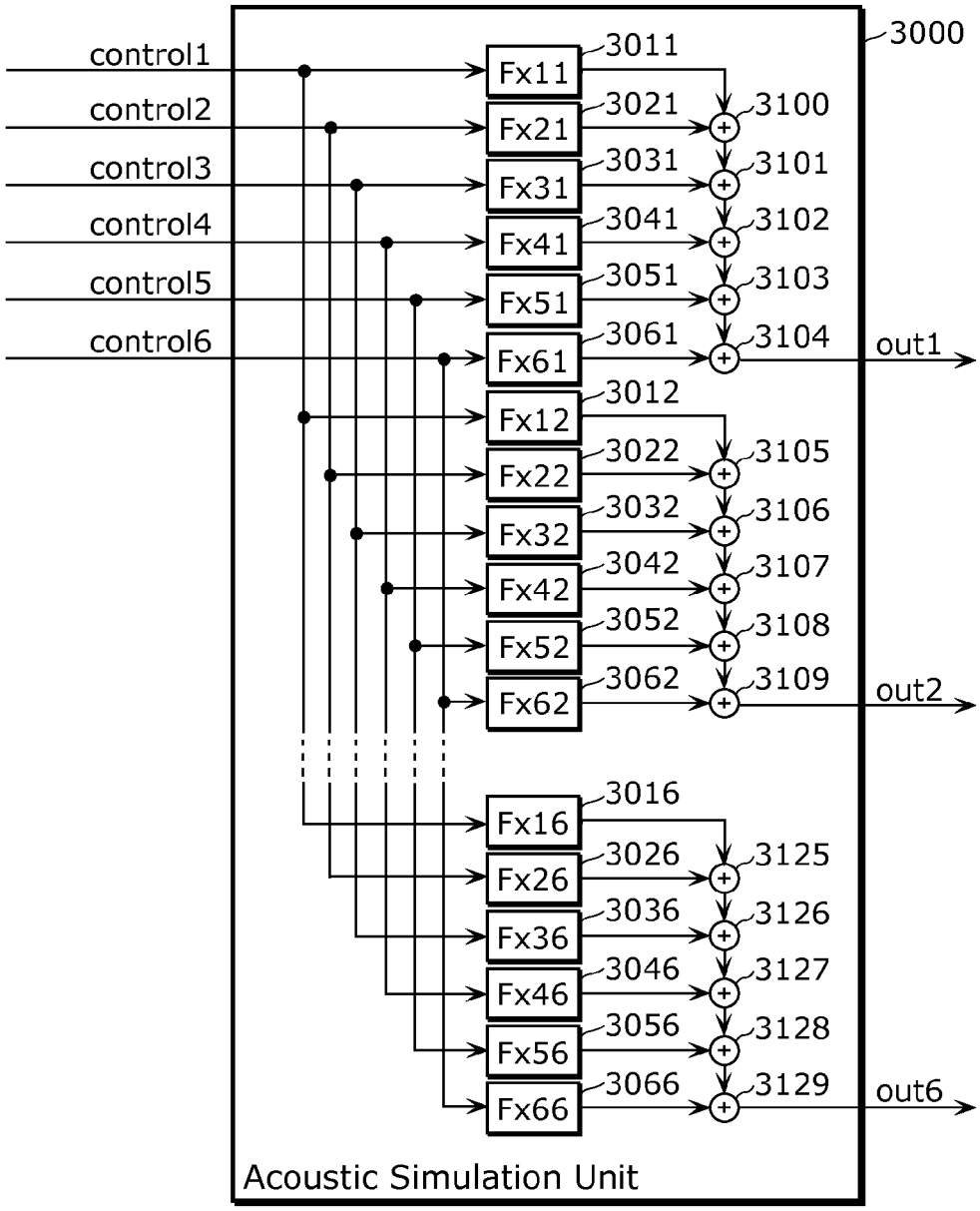
FIG. 8 is a block diagram of internal signal processing performed by the acoustic simulation unit shown in FIG. 5.

FIG. 8 is a block diagram showing the acoustic simulation unit 3000. The transfer characteristics Fx11 to Fx16 determined in FIG. 3 are set as filter coefficients for the Fx filters 3011 to 3016 (partly not shown). The transfer characteristics Fx21 to Fx26 are set as filter coefficients for the Fx filters 3021 to 3026 (partly not shown). The transfer characteristics Fx31 to Fx36 are set as filter coefficients for the Fx filters 3031 to 3036 (partly not shown). The transfer characteristics Fx41 to Fx46 are set as filter coefficients for the Fx filters 3041 to 3046 (partly not shown). The transfer characteristics Fx51 to Fx56 are set as filter coefficients for the Fx filters 3051 to 3056 (partly not shown). The transfer characteristics Fx61 to Fx66 are set as filter coefficients for the Fx filters 3061 to 3066 (partly not shown).

Thus, each of the Fx filters 3011 to 3016 performs convolution between the control signal control1 and corresponding one of the transfer characteristics Fx11 to Fx16. Likewise, each of the Fx filters 3021 to 3026 performs convolution between the control signal control2 and corresponding one of the transfer characteristics Fx21 to Fx26. Each of the Fx filters 3031 to 3036 performs convolution between the control signal control3 and corresponding one of the transfer characteristics Fx31 to Fx36. Each of the Fx filters 3041 to 3046 performs convolution between the control signal control4 and corresponding one of the transfer characteristics Fx41 to Fx46. Each of the Fx filters 3051 to 3056 performs convolution between the control signal control5 and corresponding one of the transfer characteristics Fx51 to Fx56. Each of the Fx filters 3061 to 3066 performs convolution between the control signal control6 and corresponding one of the transfer characteristics Fx61 to Fx66.

After that, outputs of the respective Fx filters are added together by the adders 3100 to 3129 (not shown entirely) to be outputted as output signals out1 to out6. Here, the output signal out1 corresponds to a signal indicating properties of synthesized sound generated when the control sound provided from the control speakers 1 to 6 in FIG. 2 arrives at the control point indicated by the microphone 11. Likewise, the output signal out2 corresponds to a signal indicating properties of synthesized sound generated when the control sound provided from the control speakers 1 to 6 arrives at the control point indicated by the microphone 12. Likewise, the output signal out3 corresponds to a signal indicating properties of synthesized sound generated when the control sound provided from the control speakers 1 to 6 in FIG. 3 arrives at the control point indicated by the microphone 13. The, the output signal out4 corresponds to a signal indicating properties of synthesized sound generated when the control sound provided from the control speakers 1 to 6 arrives at the control point indicated by the microphone 14. The, the output signal out5 corresponds to a signal indicating properties of synthesized sound generated when the control sound provided from the control speakers 1 to 6 in FIG. 5 arrives at the control point indicated by the microphone 15. The output signal 6 corresponds to a signal indicating properties of synthesized sound generated when the control sound provided from the control speakers 1 to 6 in FIG. 6 arrives at the control point indicated by the microphone 16.

In the present embodiment, the control speaker serves also as a reproduction speaker, and the control sound reproduced by the control speaker 1 is also reproduced sound of input signal. Therefore, each of the signals indicated by out1 to out6 is also a signal indicating properties of synthesized sound of reproduced sound and control sound at the corresponding control point.

As obvious from the description with reference to FIGS. 6 to 8, the adder 61 in FIG. 5 corresponds to the microphone 11 in FIG. 2, the adder 62 corresponds to the microphone 12, the adder 63 corresponds to the microphone 13, the adder 64 corresponds to the microphone 14, the adder 65 in FIG. 5 corresponds to the microphone 15, and the adder 66 corresponds to the microphone 11. The error signals error1 to error6 in FIG. 5 correspond to the output signals of the microphones 11 to 16, respectively. Each of the control filters 1001 to 1006 in the control unit 1000 in FIG. 7 updates its coefficient to minimize the error signals error1 to error6. As a result, the synthesis properties of the control unit 1000 and the acoustic simulation unit 3000 are controlled to be the same as those of the desired property unit 2000. This means that the control filters 1001 to 1006 in FIG. 7 are inverse filters of the desired property unit 2000 and the acoustic simulation unit 3000. For example, when −H (− indicates the phase inverters 1201 to 1206 in FIG. 7) is a sound transfer function of the control unit 1000 in FIG. 5, D is a sound transfer function of the desired property unit 2000, and C' is a sound transfer function of the acoustic simulation unit 3000, the adder calculates properties of the control unit H so that $$D-H\cdot C'\approx 0.$$

Therefore, $$H=D/C'.$$

When this is applied to FIG. 2, H indicates properties of the control filters 21 to 26 (corresponding to the control filters 1001 to 1006 in FIG. 7, respectively). When C is a transfer characteristic from the control speakers 1 to 6 to the microphones 11 to 16, C≈C'. Therefore, the properties achieved by the microphones 11 to 16 are $$H\cdot C\approx D.$$

As a result, desired control effects can be offered. In other words, for the microphone 11, the reproduced sound reproduced by the control speaker 1 (serving also as the reproduction speaker) has the same properties as those of D1 regardless whether or not the diffracted sound reduction device performs the control. Furthermore, a sound pressure of the reproduced sound is D2/10 in the microphone 12, D3/10 in the microphone 13, D4/10 in the microphone 14, D5/10 in the microphone 15, and D6/10 in the microphone 16 (in the case of reducing the diffracted sound to 1/10).

Figure 9:
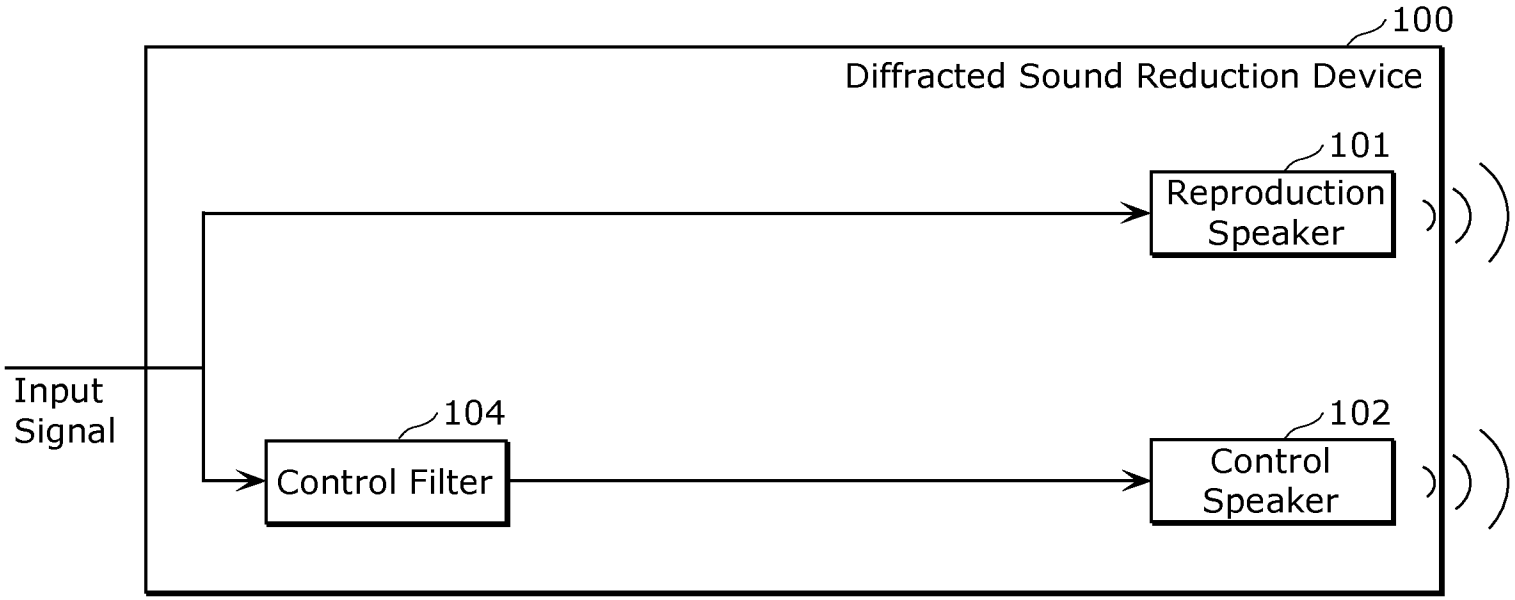
FIG. 9 is a functional block diagram of a diffracted sound reduction device according to Embodiment 1.

FIG. 9 is a functional block of the diffracted sound reduction device 100 including a control filter 104 having filter coefficients determined by the above-described method. FIG. 9 shows a logical configuration of the reproduction speaker 101 and the control speaker 102. More specifically, the reproduction speaker 101 includes at least one speaker. The control speaker 102 includes at least two speakers. Therefore, the diffracted sound reduction device 100 includes: the reproduction speaker 101 that reproduces an input signal as reproduced sound: at least two control speakers 102 that reproduce respective control signals each indicating properties of control sound for reducing a sound pressure of diffracted sound which is a part of the reproduced sound and arrives at corresponding one of control points; and the control filter 104 that filters the input signal to generate the control signals.

By the above structure, in the present embodiment where one of the control speakers serves also as a reproduction speaker, the diffracted sound reduction device can be implemented by using two speakers at minimum and the control filter (for example, implemented by arithmetic operation units such as digital signal processors). Therefore, it is possible to offer a compact structure in comparison to the conventional arts. Furthermore, even if the target space to be controlled is expanded, an arithmetic operation amount is not increased. Therefore, it is possible to provide the diffracted sound reduction device that has a compact shape and a small arithmetic operation amount, and that reduces a sound pressure of sound reproduced by a speaker in an undesired direction and correctly transfers the sound in a desired direction. Furthermore, the compact structure with a small arithmetic operation amount can reduce a manufacturing cost of the device.

More specifically, in the present embodiment, one of at least two control speakers in the diffracted sound reduction device 100 serves also as the reproduction speaker. The control filter 104 in the diffracted sound reduction device 100 filters an input signal, so that properties of direct sound are the same as the properties of the reproduced sound at the listener's position when the input signal is directly reproduced by the reproduction speaker without reproducing the control signal, and that the properties of the diffracted sound are the same as the properties of the direct sound from which a sound pressure level is reduced by a predetermined amount. More specifically, the control filter 104 filters the input signal so that the sound pressure of the direct sound is the same as the sound pressure of the reproduced sound at the control point of the listener's point when the input signal is directly reproduced by the reproduction speaker without reproducing the control signal, and that the sound pressure of the diffracted sound is reduced by a predetermined amount at control points except the listener's position, in comparison to the case where the input signal is directly reproduced by the reproduction speaker without reproducing the control signal.

For example, in the case of watching TV, for instance, regardless whether or not the diffracted sound reduction device performs the control, at the listener's position or in a direction towards the listener, it is possible to reduce sound diffracted to directions except the listener's direction without changing the properties of the TV sound. Therefore, the listener can watch TV without any constraint.

It should be noted that it has been described in the present embodiment that the diffracted sound reduction level is 1/10, but it may be appropriately set to a desired arbitral level, for example, 1/3, 1/2, or the like depending on the situation such as room environments. It should also be noted that the microphones 12 to 16 have the same reduction level, but they may have different setting depending on the situation. For example, if a right side of a TV should be mainly quiet because a person is there, the reduction level of the microphone 12 in FIG. 1 may be 1/10 and the reduction level of each of the microphones 13 to 16 may be 1/3.

Furthermore, the adders 61 to 66 in FIG. 5 add the desired signals desire1 to desire6 with the output signals out1 to out6, respectively. This is because, in FIG. 7, the phase inverters 1201 to 1206 perform phase inversion on phase of the output signals of the control filters 1001 to 1006, respectively. Therefore, in FIG. 7, if the control unit 1000 does not have the phase inverters 1201 to 1206, subtractors that subtracts out1 to out6 from desire1 to desire6, respectively, may be used instead of the adders 61 to 66. In other words, the adders 61 to 66 may be other arithmetic operation units rather than the adders.

In other words, each of the control filters in the diffracted sound reduction device according to the present embodiment has a filter coefficient determined by a filter coefficient determination method including the following steps (A) to (E).

(A) A desired property determination step of performing signal processing on the input signal (reference in FIG. 5) and determining a desired signal (corresponding one of desire1 to desire6 in FIG. 5) indicating properties of desired reproduced sound at corresponding one of the control points.

(B) A control signal calculation step of applying the control filter (corresponding one of the control filters 1001 to 1006 in FIG. 7), which corresponds to corresponding one of the control speakers, on the input signal to calculate a control signal (corresponding one of control1 to control6 in FIG. 7) to be reproduced by corresponding one of the control speakers.

(C) An acoustic simulation step of calculating a reproduction signal (corresponding one of out1 to out6 in FIG. 8) indicating properties of desired reproduced sound of corresponding one of the control points, based on the control signal calculated in the control signal calculation step.

(D) An addition step of calculating an error signal (corresponding one of error1 to error6 in FIG. 5) generated by synthesizing the desired signal and the reproduction signal, for corresponding one of the control points.

(E) A determination step of updating a coefficient of the control filter 104 so that the error signal calculated in the addition step is decreased when the error signal is greater than or equal to a predetermined threshold value, and determining, as a filter coefficient to be set in the control filter 104, a current coefficient of the control filter 104 when the error signal is smaller than the predetermined threshold value.

More specifically, in the desired property determination step, with reference to FIG. 6, the level adjusters 2101 to 2106 and the desired property filters 2001 to 2006 which are in association with the respective control points are applied to the input signal, so as to determine desired signals (desire1 to desire6). Here, for the first desired property filter (the desired property filter 2001 in the present embodiment) among the desired property filters, a transfer characteristic of sound transfer from the reproduction speaker to a control point at the listener's position is set. For each of the other desired property filters rather than the first desired property filter, a transfer characteristic of sound transfer from the reproduction speaker to corresponding one of the control points except the listener's position is set.

Each of the level adjusters adjusts a gain of the input signal according to a setting value. More specifically, a setting value of a gain set for each of level adjusters corresponding to the other desired property filters is smaller than a setting value of a gain set for a level adjuster (the level adjuster 2101 in the present embodiment) corresponding to the first desired property filter among the level adjusters.

Furthermore, in the acoustic simulation step, with reference to FIG. 8, acoustic simulation filters (Fx filters 3011 to 3066) each indicating a transfer characteristic of a path to corresponding one of the control points is applied to corresponding one of the control signals. After that, for each of the control points, each of the adders 3100 to 3129 sums the control signals on which the acoustic simulation filter is applied, so as to calculate a reproduction signal at each of the control points.

Moreover, with reference to FIG. 7, in the determination step performed by the control unit 1000, acoustic simulation filters (the Fx filters 1011 to 1066), each of which indicates a transfer characteristic of sound from corresponding one of the control speakers to corresponding one of the control points, is applied to the input signal.

After that, if each of the error signals (error1 to error6) is greater than or equal to a predetermined threshold value, based on the output signals of the acoustic simulation filters (the Fx filters 1011 to 1066) and the error signals corresponding to the output signals, the coefficients (FIR1 to FIR6) of the control filters are updated to decrease values of the error signals in a next addition step.

Figure 10:
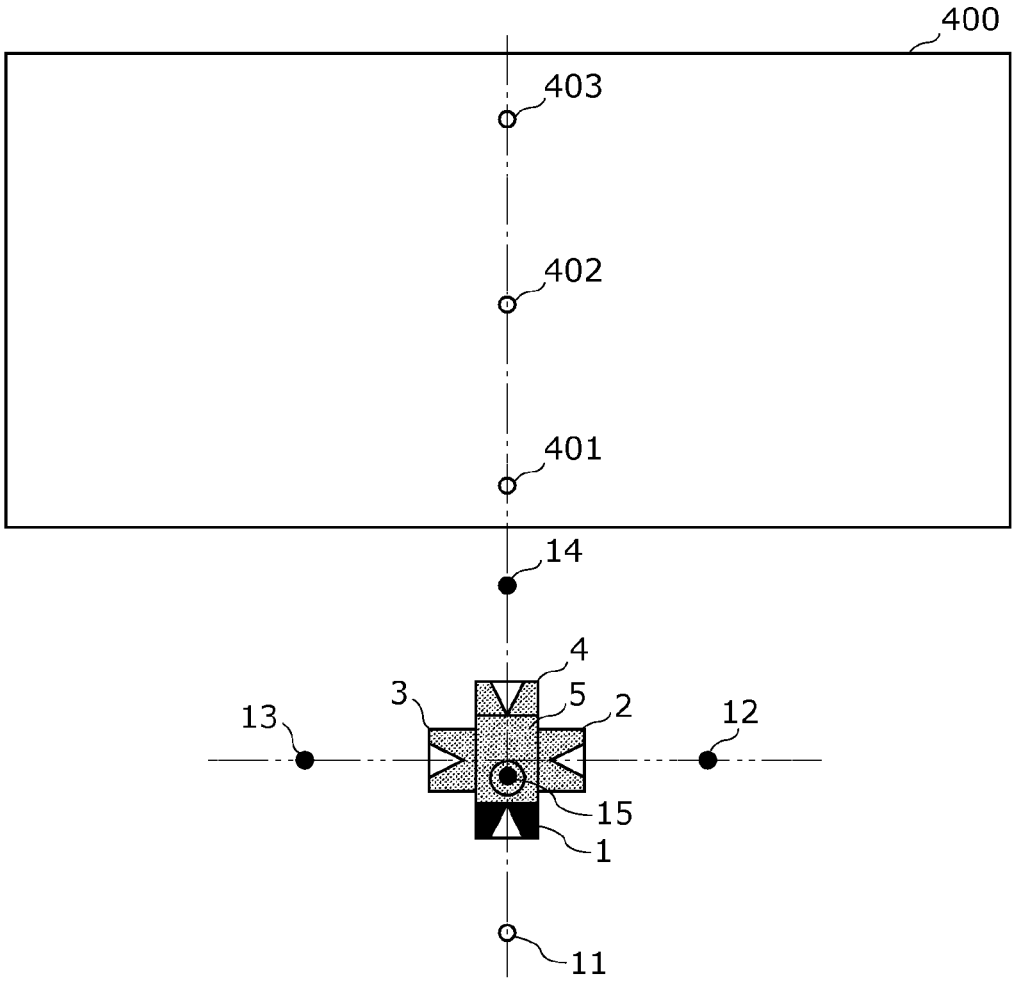
FIG. 10 is a top view of an arrangement of microphones and speakers of a diffracted sound reduction device in a laboratory according to Embodiment 1.

The diffracted sound reduction device according to the present embodiment may further include: a desired property unit 2000 that performs signal processing on the input signal (reference in FIG. 5) to generate a plurality of desired signals Dn (desire1 to desire6 in FIG. 5); a control unit 1000 that performs signal processing on the input signal to generate a plurality of control signals Cn (control1 to control6 in FIG. 5); an acoustic simulation unit 300 performs signal processing on the respective control signals Cn provided from the control unit 1000 to generate a plurality of reproduction signals On each corresponding to corresponding one of the control signals Cn; and adders (arithmetic operation units) 61 to 66 each of which synthesizes corresponding one of the desired signals Dn and the reproduction signals On corresponding to the desired signal Dn, so that error signals En (error1 to error6 in FIG. 5) are generated. Here, the diffracted sound reduction device determines the control properties of the control filter 104 as $$Cn=Dn/On,$$

so that each of the error signals is smaller than the predetermined threshold value, The following describes an experimental example which is actually performed to examine effects of the diffracted sound reduction device according to the present embodiment. FIG. 10 is a top view of an configuration of microphones and speakers in a laboratory. In FIG. 10, 400 denotes a next-door room of a room having a reproduction speaker. In the reproduction speaker, there are microphones 401 to 403 for evaluation. In this experiment, since a stand is provided to arrange the control speaker at a predetermined height from the floor, the control speaker 6 in FIG. 1 is not used and total five control speakers 1 to 5 are used. Accordingly, used microphones are five microphones 11 to 15. In other words, a space below the control speakers is not controlled.

An aim of this experiment is to perform control so that reproduced sound provided from the control speaker 1 (serving also as a reproduction speaker) has the same properties at the position of the microphone 11 regardless whether or not the control is performed, and that a sound pressure level at each of the positions of the microphones 12 to 15 is reduced to ⅓. The results are shown in FIGS. 11 to 15. In FIGS. 11 to 15, a vertical axis indicates a sound pressure level (dB) at the measurement position, and the horizontal axis indicates frequency (Hz) of the measured sound.

Figure 11:
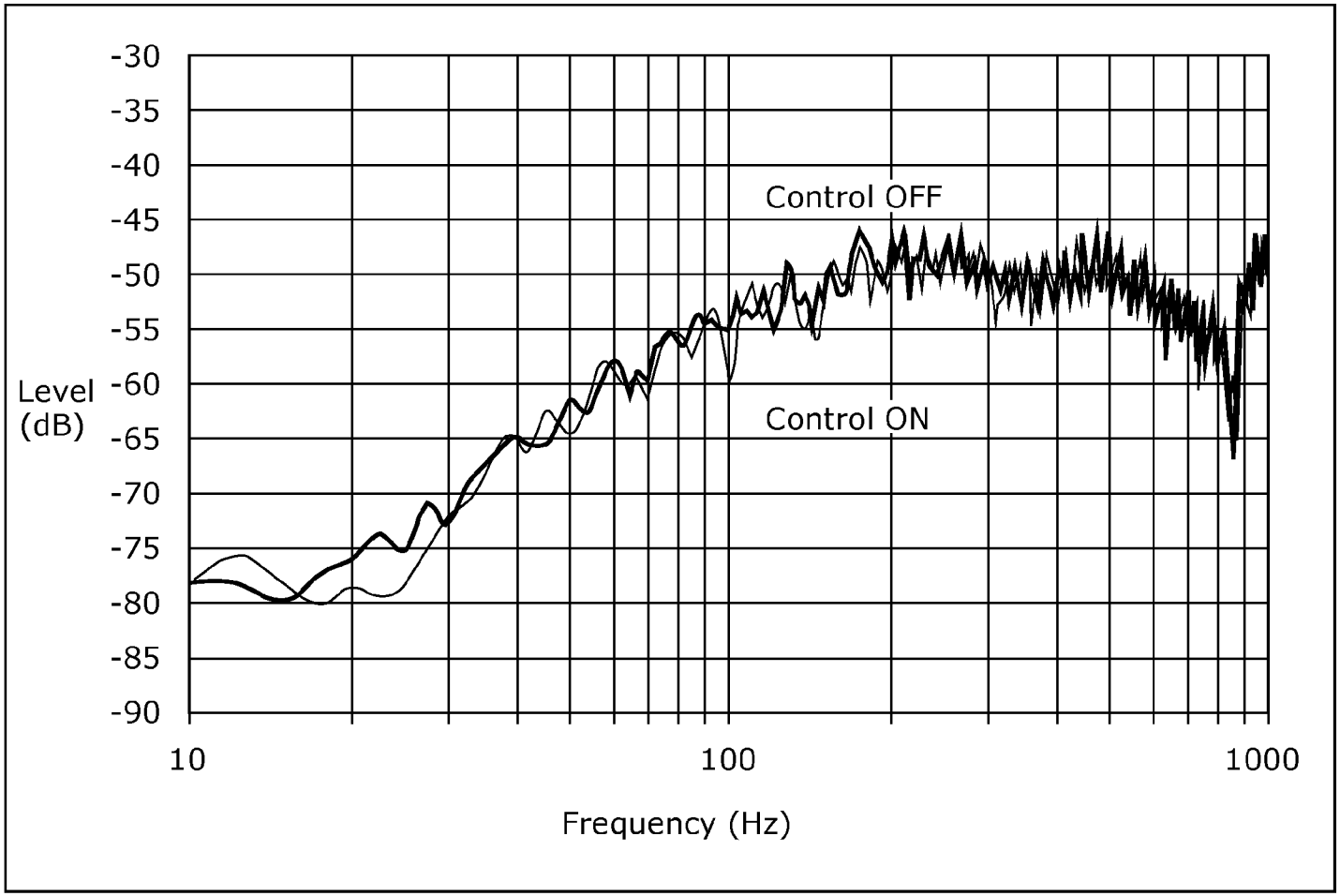
FIG. 11 is a graph plotting control effects of a microphone 11 of the diffracted sound reduction device in the experimental arrangement shown in FIG. 10.
Figure 12:
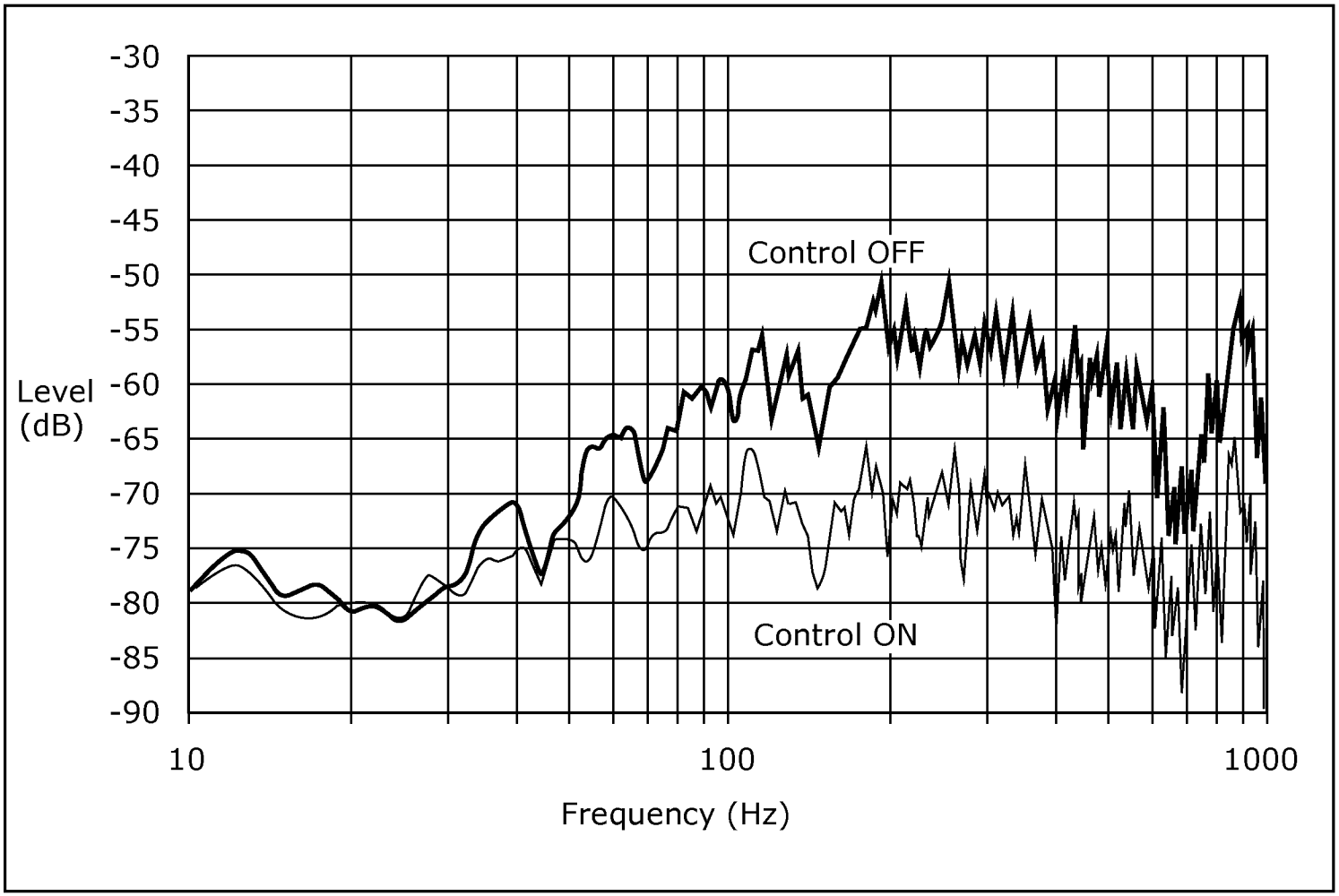
FIG. 12 is a graph plotting control effects of a microphone 12 of the diffracted sound reduction device in the experimental arrangement shown in FIG. 10.
Figure 13:
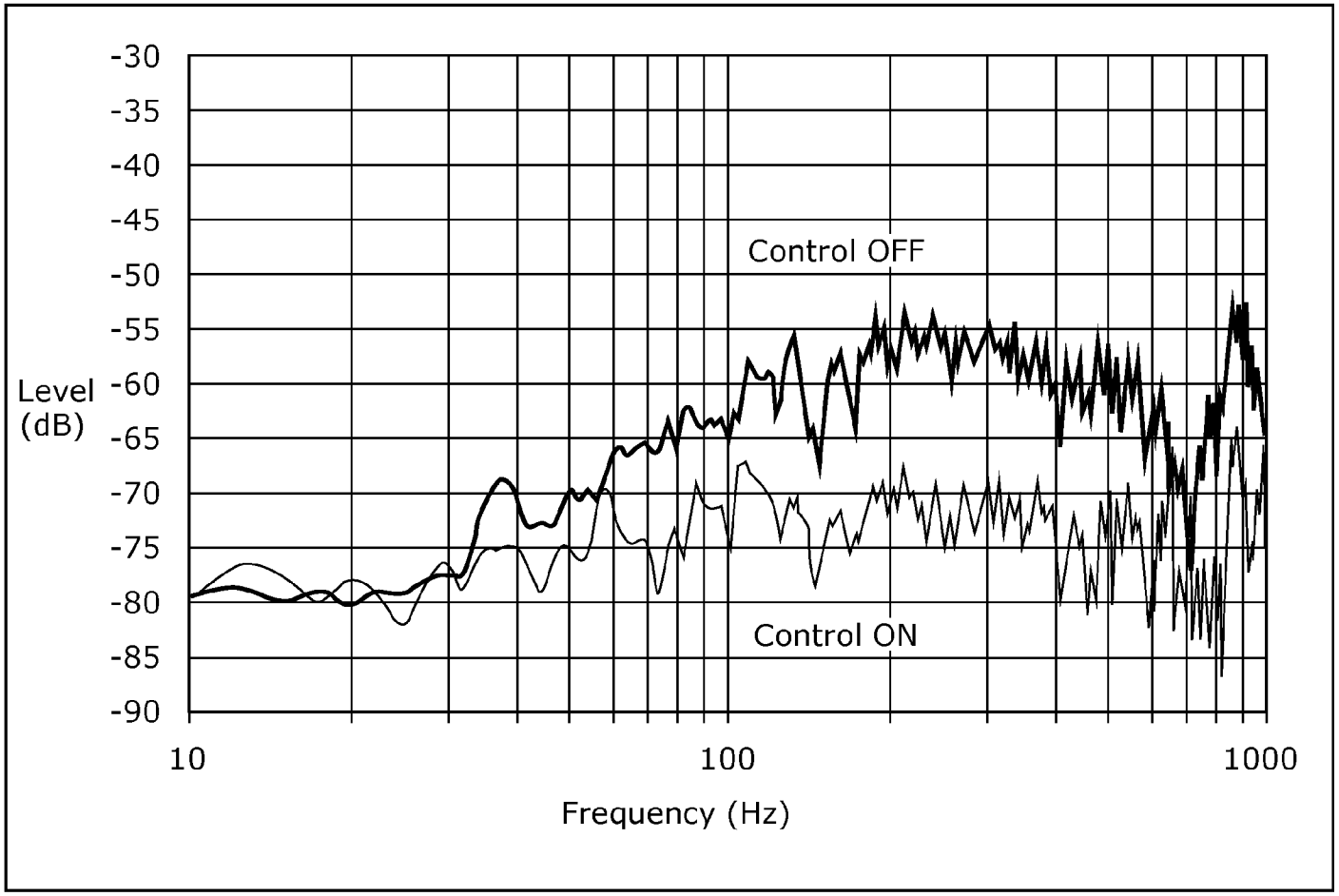
FIG. 13 is a graph plotting control effects of a microphone 13 of the diffracted sound reduction device in the experimental arrangement shown in FIG. 10.
Figure 14:
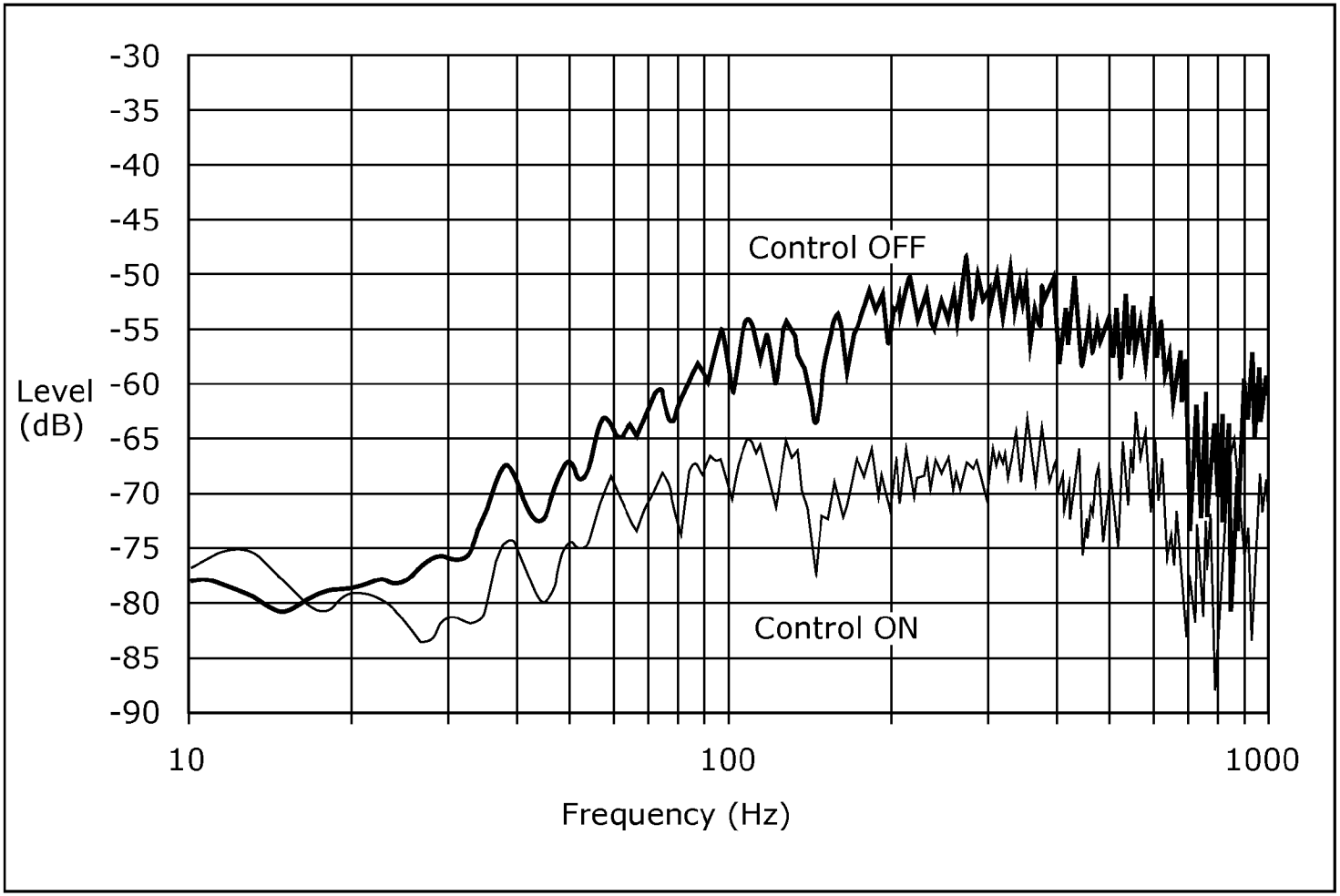
FIG. 14 is a graph plotting control effects of a microphone 14 of the diffracted sound reduction device in the experimental arrangement shown in FIG. 10.
Figure 15:
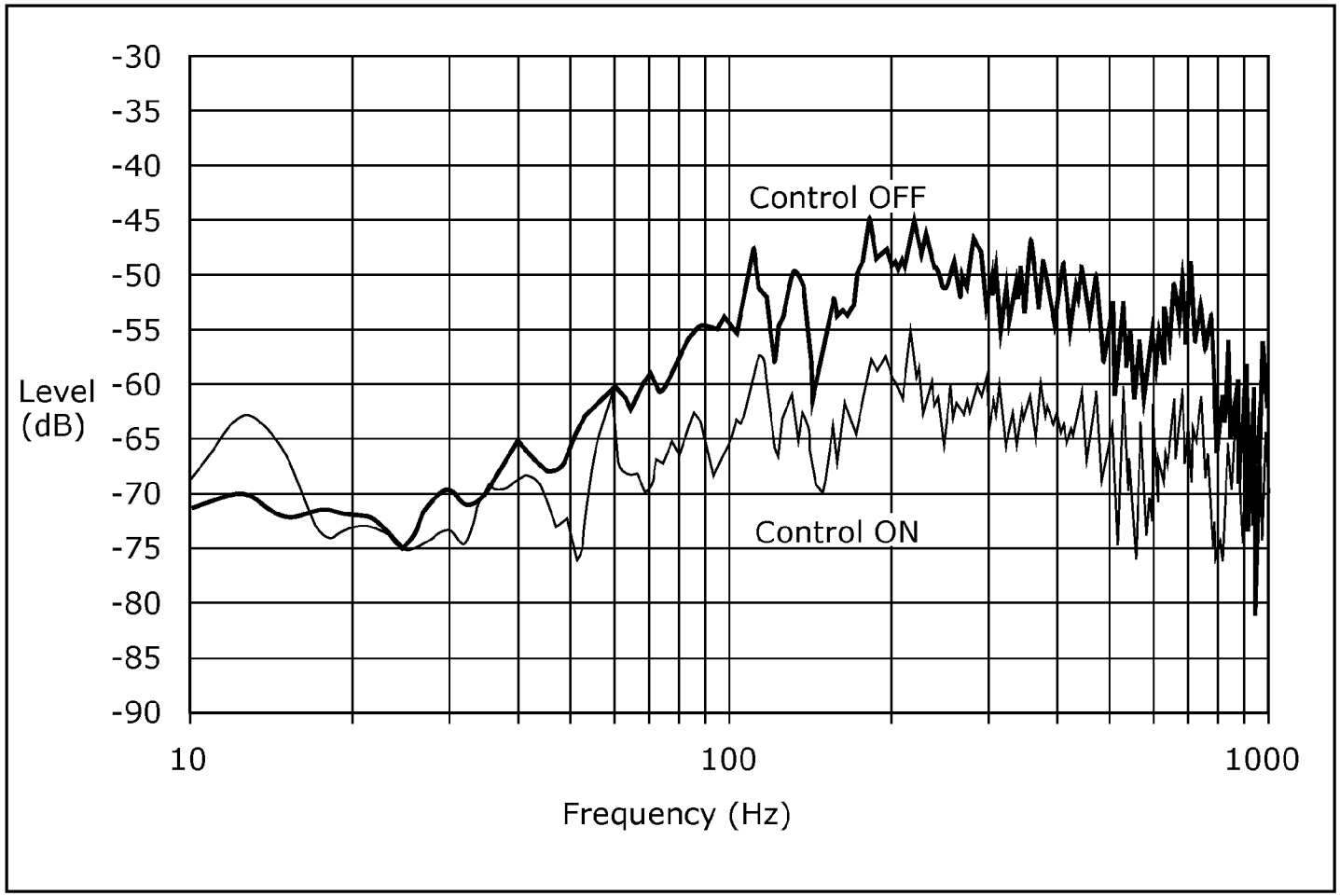
FIG. 15 is a graph plotting control effects of a microphone 15 of the diffracted sound reduction device in the experimental arrangement shown in FIG. 10.

FIG. 11 shows control effects at the position of the microphone 11. Whichever the control is ON (thin line) or OFF (thick line), the properties are hardly changed. FIG. 12 shows control effects at the position of the microphone 12. In the control ON, the reduction effects of approximately 10 dB (=reduction to ⅓) are obtained. Likewise, FIG. 13 shows control effects at the position of the microphone 13. In the control ON, the reduction effects of approximately 10 dB (=reduction to ⅓) are obtained. FIG. 14 shows control effects at the position of the microphone 14. In the control ON, the reduction effects of approximately 10 dB are obtained. FIG. 15 shows control effects at the position of the microphone 15. In the control ON, the reduction effects of approximately 10 dB are obtained.

Figure 16:
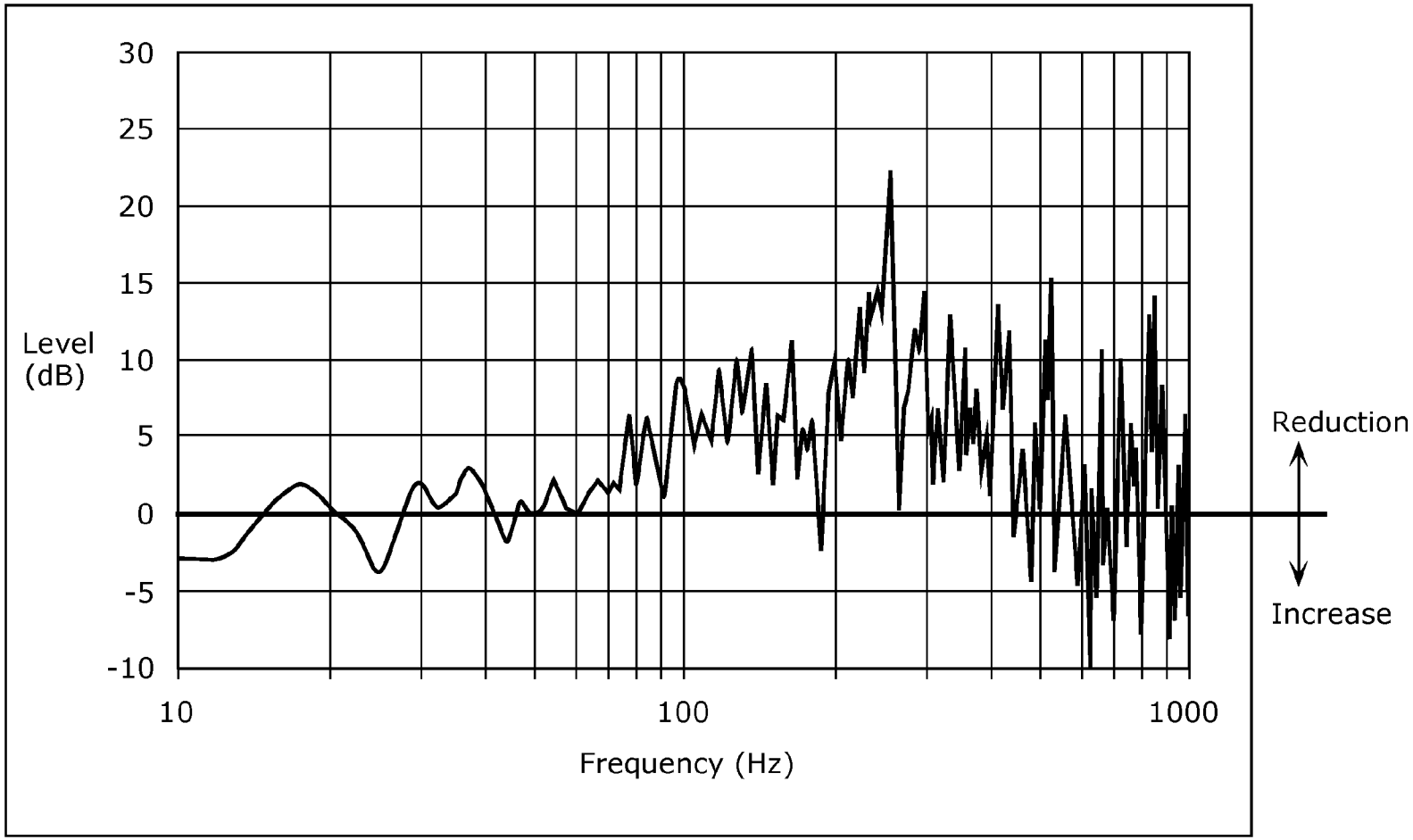
FIG. 16 is a graph plotting control effects of a microphone 401 of the diffracted sound reduction device in the experimental arrangement shown in FIG. 10.
Figure 17:
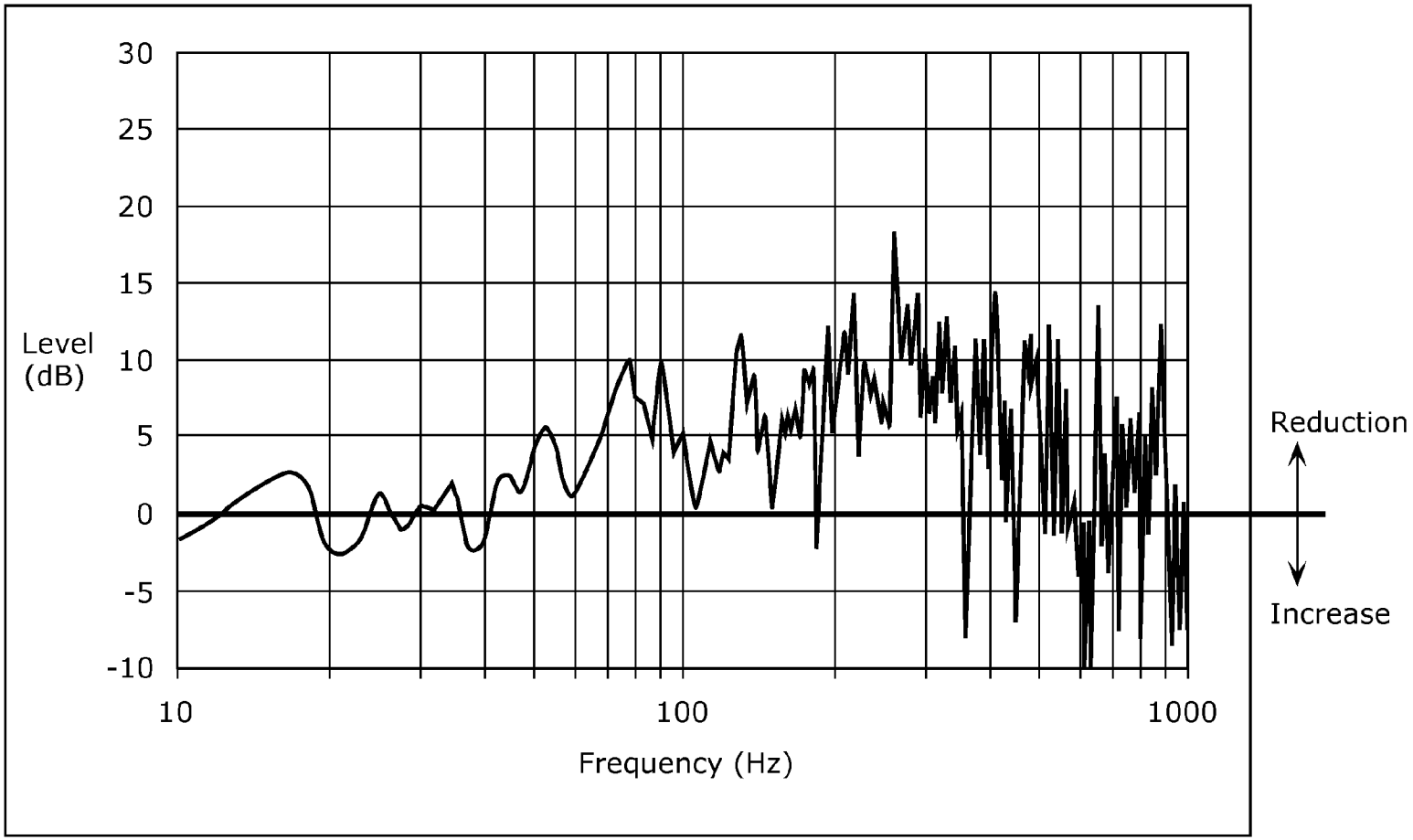
FIG. 17 is a graph plotting control effects of a microphone 402 of the diffracted sound reduction device in the experimental arrangement shown in FIG. 10.
Figure 18:
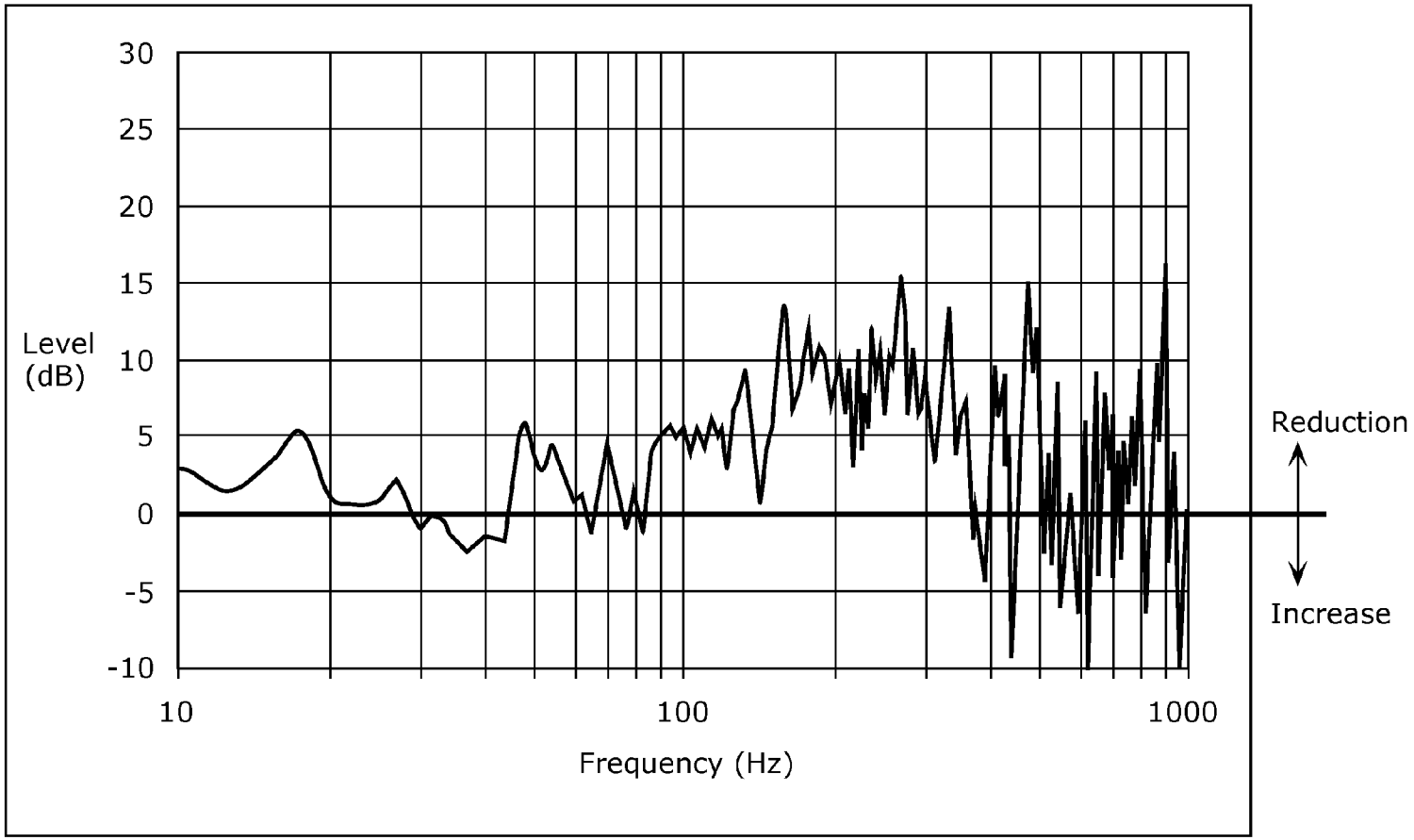
FIG. 18 is a graph plotting control effects of a microphone 403 of the diffracted sound reduction device in the experimental arrangement shown in FIG. 10.

As described above, the microphones 11 to 15 serving as the control points can offer desired effects. Then, measurement is performed to examine how the next-door room 400 is effected. The results are shown in FIGS. 16 to 17. In FIGS. 16 to 18, a vertical axis indicates a difference (dB) between a sound pressure level in the case where the diffracted sound reduction device is OFF and a sound pressure level in the case where the diffracted sound reduction device is ON. A horizontal axis indicates frequency (Hz) of the measured sound.

FIG. 16 shows control effects (difference between control OFF and control ON) at the position of the microphone 401. The diffracted sound reduction effects of 5 dB to 15 dB are obtained. Likewise, FIG. 17 shows control effects at the position of the microphone 402, and FIG. 18 shows control effects at the position of the microphone 403. In both cases, the diffracted sound reduction effects of 5 dB to 10 dB are obtained.

As described above, when diffracted sound at the microphones 11 to 15 are controlled by the control speakers 1 to 5, respectively, it is possible to reduce leaked sound of TV sound (reproduced sound provided from the control speaker 1) to the next-door room 400. In the experiment, for the microphones 12 to 15, diffracted sound is reduced in a wide frequency band from approximately 50 Hz (according to the properties such as the control speaker fo) to 1 kHz. The microphones 401 to 403 also offer the effects in the frequency band from approximately 80 Hz to 5000 Hz. Therefore, it is possible to offer the control effects in a low frequency band where the directional speaker according to the third related art has a difficulty in offering the control effects. Moreover, in comparison to the first and second related arts for controlling vibration of an entire wall surface partitioning a next-door room and the directional speaker as the third related art, it is possible to offer a compact shape and to significantly reduce an arithmetic operation amount.

It should be noted that it has been described that the downward control speaker 6 is eliminated in the experiment shown in FIG. 10, it is ideal not to eliminate the control speaker 6. However, as good effects are offered in this experiment, it is possible to reduce the number of control speakers according to conditions applied to the system, within a range not to affect the effects. At least one control speaker may be arranged for each position facing a control point.

Embodiment 2

Figure 19:
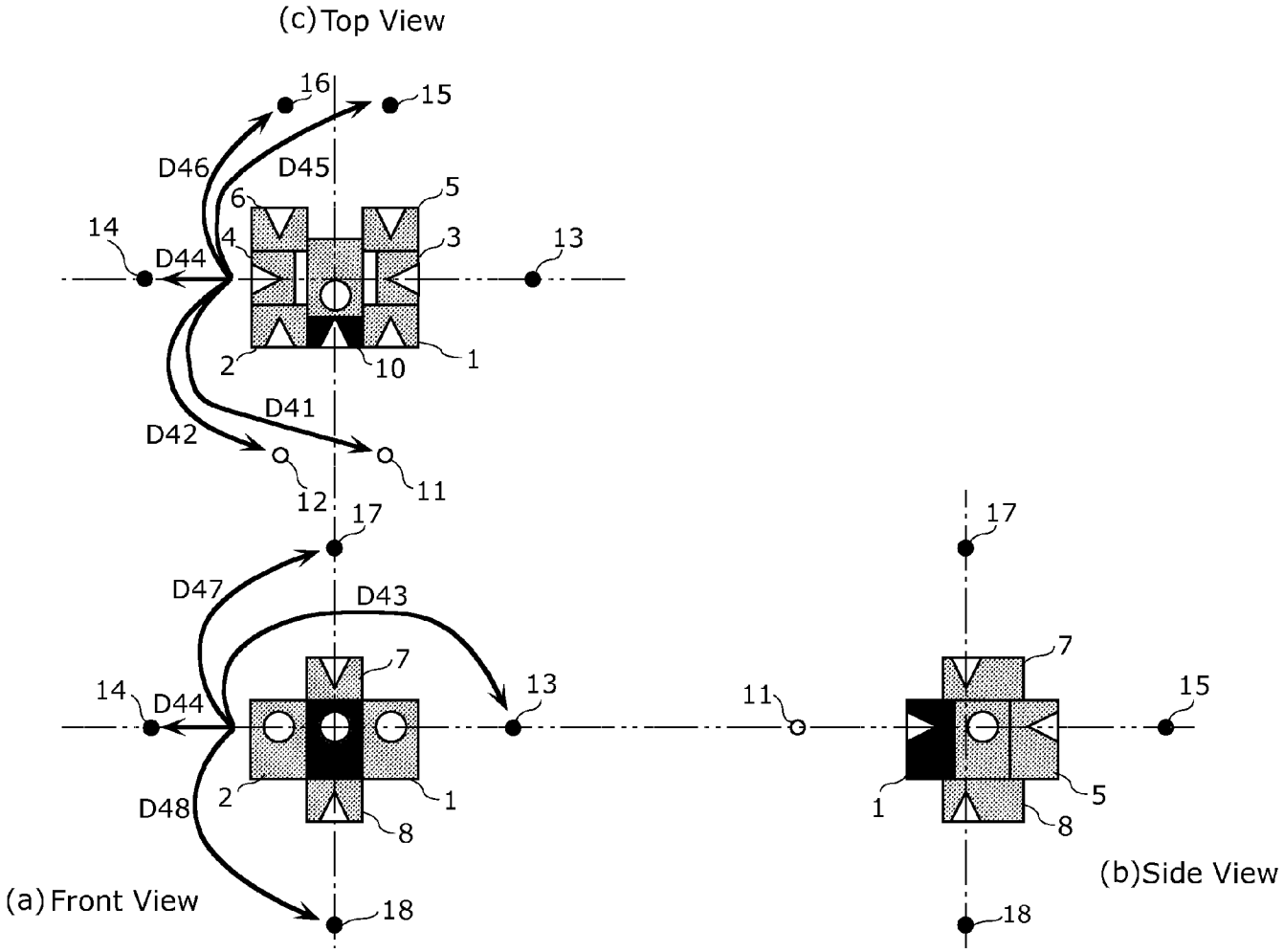
FIG. 19 is a diagram showing a configuration of speakers and microphones of a diffracted sound reduction device according to Embodiment 2.

The following describes a structure of a diffracted sound reduction device according to Embodiment 2. FIG. 19 is a diagram showing a configuration of speakers in the diffracted sound reduction device according to Embodiment 2.

In FIG. 19, (a) shows a front view of a reproduction speaker 10 (for example, a TV speaker). (b) shows a right side view of (a). (c) is a top view of (a). As seen in the figure, the diffracted sound reduction device according to Embodiment 2 has a speaker configuration where at least one speaker is arrange above, below, on the left of, on the right of, and behind the reproduction speaker 10 so that at least the control speakers 1 to 8 are arranged around the reproduction speaker 10. Then, microphones 11 to 18 are arranged to face the control speakers 1 to 8, respectively, to serve as control points. Here, the reproduction speaker 10 is a speaker that reproduces necessary sound (for example, TV sound), and the microphones 11 and 12 are arranged at the listener's position or in a direction towards the listener.

Therefore, the following two control effects are desired. First, sound reproduced by the reproduction speaker 10 keeps the same properties at the microphones 11 to 12, regardless whether or not the diffracted sound reduction device according to the present embodiment performs the control. Second, in comparison to diffracted sound which is a part of the reproduced sound reproduced by the reproduction speaker 10 in the case where the diffracted sound reduction device according to the present embodiment does not perform the control, each of the microphones 13 to 18 can reduce a sound pressure by a predetermined amount in the case where the diffracted sound reduction device according to the present embodiment performs the control.

In Embodiment 1, the reproduction speaker serves also as the control speaker. In Embodiment 2, however, the reproduction speaker merely reproduces TV sound as a speaker embedded in a TV, for example. The control speakers 1 to 8 arranged around the reproduction speaker perform the control to reduce diffracted sound.

In order to reduce diffracted sound, the microphones 13 to 18 reduce reproduced sound provided from the reproduction speaker 10. Therefore, the control speakers 1 to 8 perform reduction of reproduced sound provided from the reproduction speaker 10 at the microphones 13 to 18, namely, active nose control (ANC). However, if the ANC sound is transferred to the microphones 11 to 12, the properties of the TV sound provided from the reproduction speaker 10 are changed. In order to address the problem, it is necessary to prevent the ANC sound reproduced by the control speakers 1 to 8 from transferred to the microphones 11 to 12. In other words, at the microphones 11 to 12, it is necessary to reduce the ANC sound to a level where the ANC sound does not interfere with the TV sound to change the properties of the TV sound. In the other words, it is necessary to prevent that the control sound reproduced by the control speakers 1 to 8 are diffracted at the microphones 11 to 12. This control method has been described in Embodiment 1. In other words, it is necessary that the control sound provided from the control speakers 1 to 8 are reduced at the microphones 11 to 12 to a predetermined level so as to perform diffracted sound control, and then the microphones 13 to 18 performs AVC control on the TV sound provided from the reproduction speaker 10.

For example, the case of the control speaker 4 in FIG. 19 is described. The control sound reproduced by the control speaker 4 is transferred towards the microphones 11 to 18. Normally, the sound is transferred to the microphones 11 and 12 with transfer characteristics D41 and D42, respectively. However, when the control speakers 1 to 8 perform diffracted sound control, the sound transferring from the control speaker 4 to the microphones 11 and 12 is reduced to D41/10 and D42/10, respectively. Here, since the sound from the control speaker 4 to the microphone 11 and the sound from the control speaker 4 to the microphone 12 have an enough low level, they do not interfere with the reproduced sound reproduced by the reproduction speaker 10. If the same control is applied to the other control speakers to control diffracted sound, at the microphones 11 and 12, every sound provided from the control speakers 1 to 8 does not interfere with the reproduced sound reproduced by the reproduction speaker 10. The filters performing the diffracted sound control are correction filters 10000 to 15000 shown in FIG. 21. Filter coefficients of the correction filters 10000 to 15000 can be determined by a structure shown in FIG. 21. The details are described later.

Figure 20:
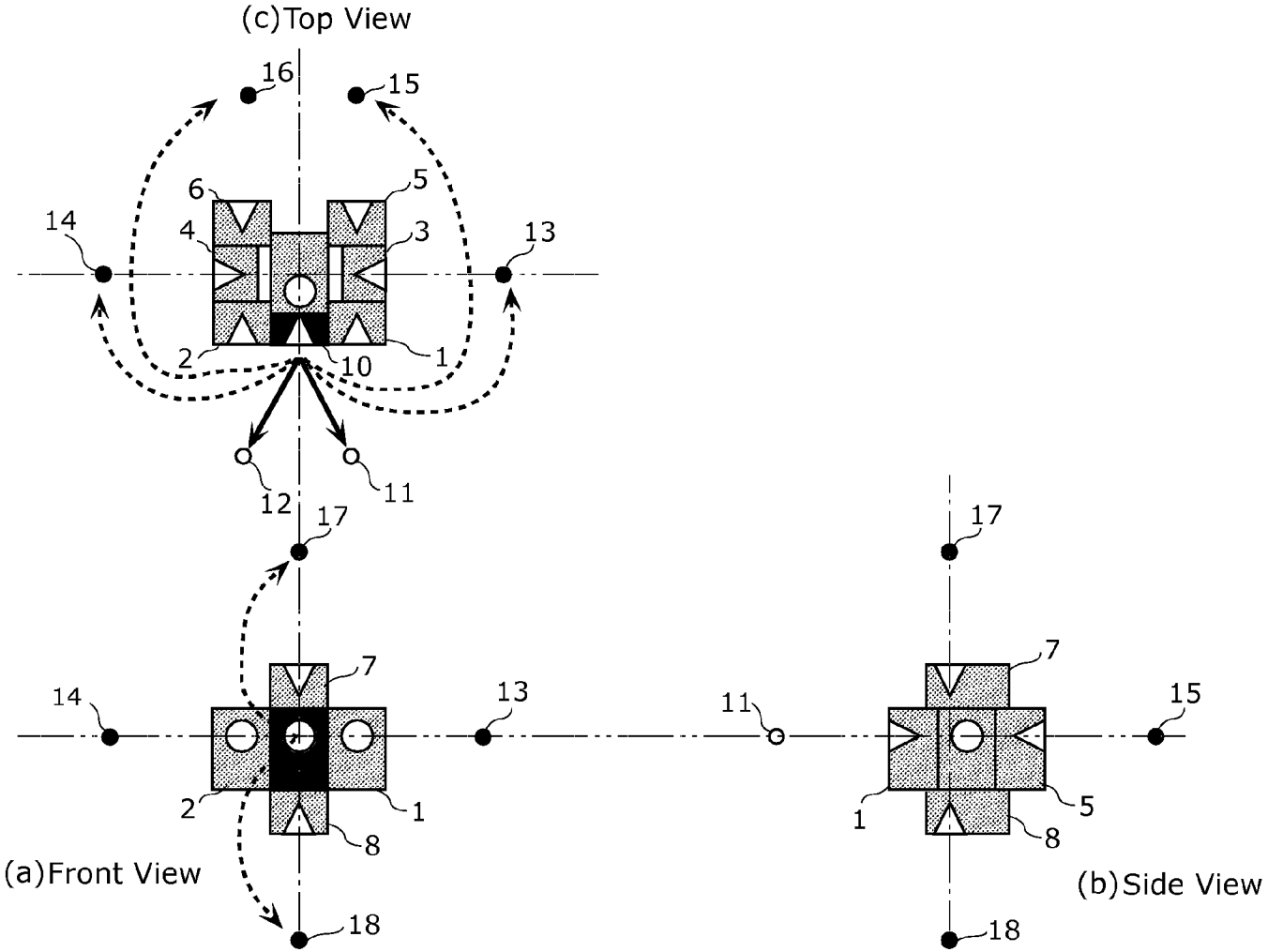
FIG. 20 is a diagram showing a configuration of speakers and microphones of a diffracted sound reduction device according to Embodiment 2.

Next, the reproduced sound provided from the reproduction speaker 10 in FIG. 20 is transferred to the microphones 11 to 18 without any control. Here, in order to prevent that the reproduced sound provided from the reproduction speaker 10 is transferred to the microphones 11 to 18, the control speakers 1 to 8 on which diffracted sound control is performed are used to cancel the sound transferring from the reproduction speaker 10 to the microphones 11 to 18 by ANC. This is the ANC 5000 shown in FIG. 21. A method of designing the ANC 5000 will be described later.

Figure 21:
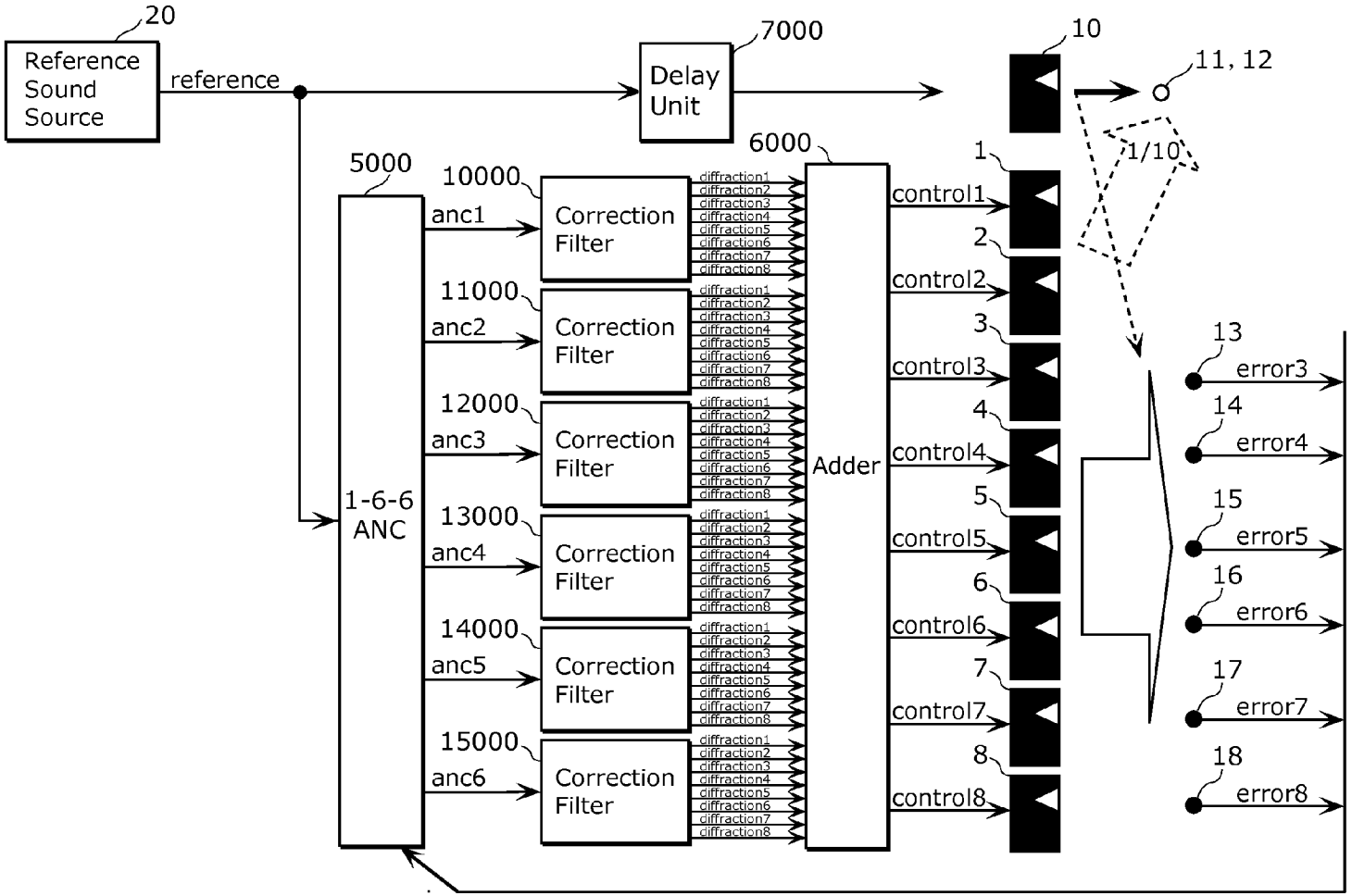
FIG. 21 is a block diagram of signal processing performed by the diffracted sound reduction device according to Embodiment 2.

The following describes operations and designing methods for the correction filters 10000 to 15000 and the ANC 5000 in FIG. 21 are described in detail with reference to FIG. 22 to 27.

Figure 22:
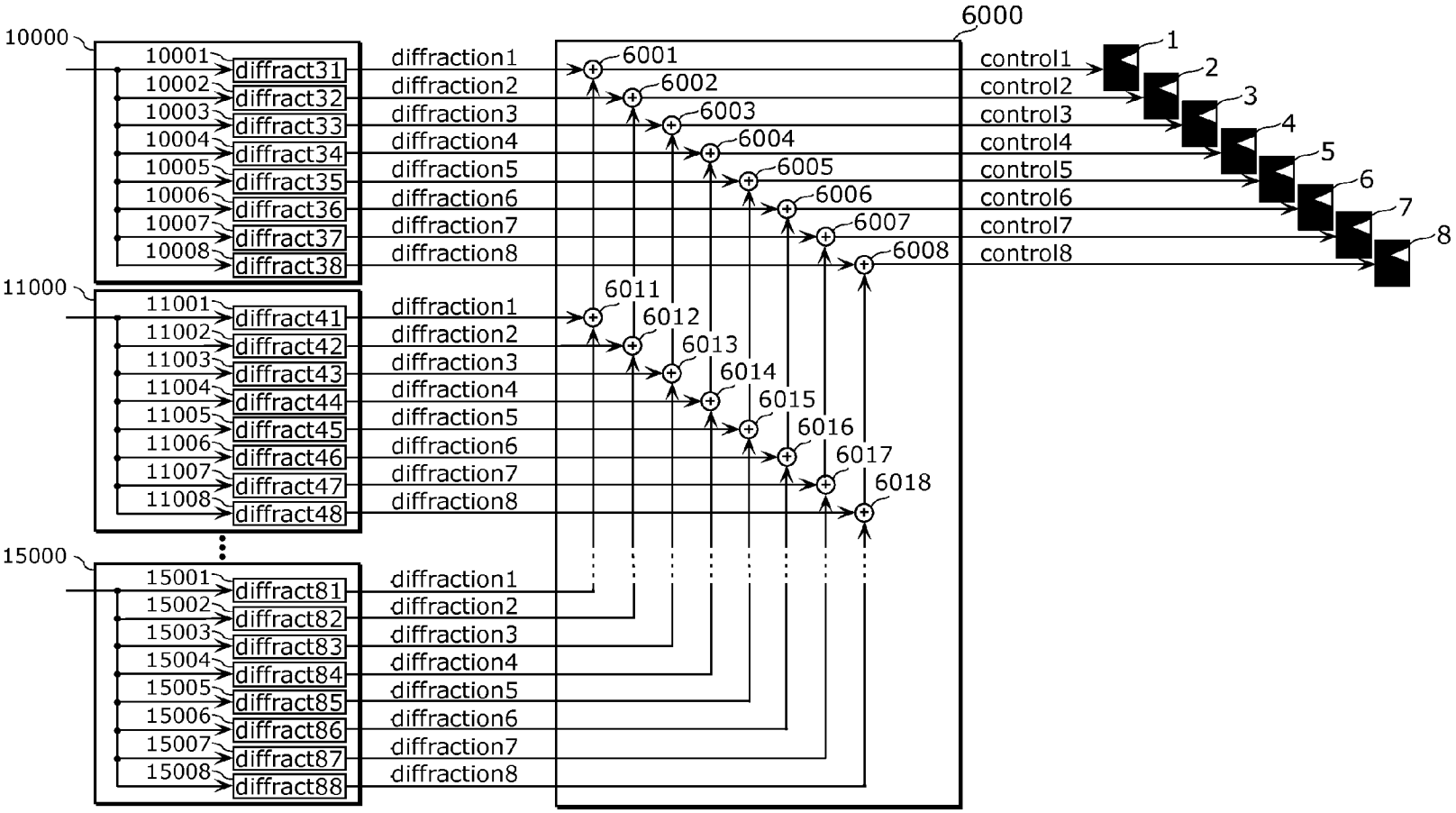
FIG. 22 is a block diagram showing an internal configuration of correction filters and an adder and a connection configuration of control speakers which are shown in FIG. 21.

FIG. 22 shows a configuration of the correction filters 10000 to 15000, the adder 6000, and the control speakers 1 to 8 which are shown in FIG. 21. In the correction filter 10000, each of diffracted sound control filters 10001 to 10008 performs signal processing on a signal provided from the ANC 5000 and provides the result to the adder 6000. Likewise, in the other correction filters 10000 to 15000, each of diffracted sound control filters 11001 to 15008 performs signal processing on the signal provided from the ANC 5000 and provides the result to the adder 6000. The adder 6000 adds output signals of the correction filters 11000 to 15000 corresponding to the control speaker 1 by adders 6001, 6011, . . . , so as to generate one signal (control1) to be provided to the control speaker 1. Likewise, for the control speakers 2 to 8, the adder 6000 adds output signals of the correction filters 11000 to 15000 corresponding to the corresponding speaker so as to generate one signal to be provided to the control speaker.

Here, the method of determining the control properties of the correction filters 10000 to 15000 may be the method described in Embodiment 1. For example, in the case of the correction filter 11000, the control unit 1000 in FIG. 5 in Embodiment 1 corresponds to the correction filter 11000 in FIG. 23.

Figure 23:
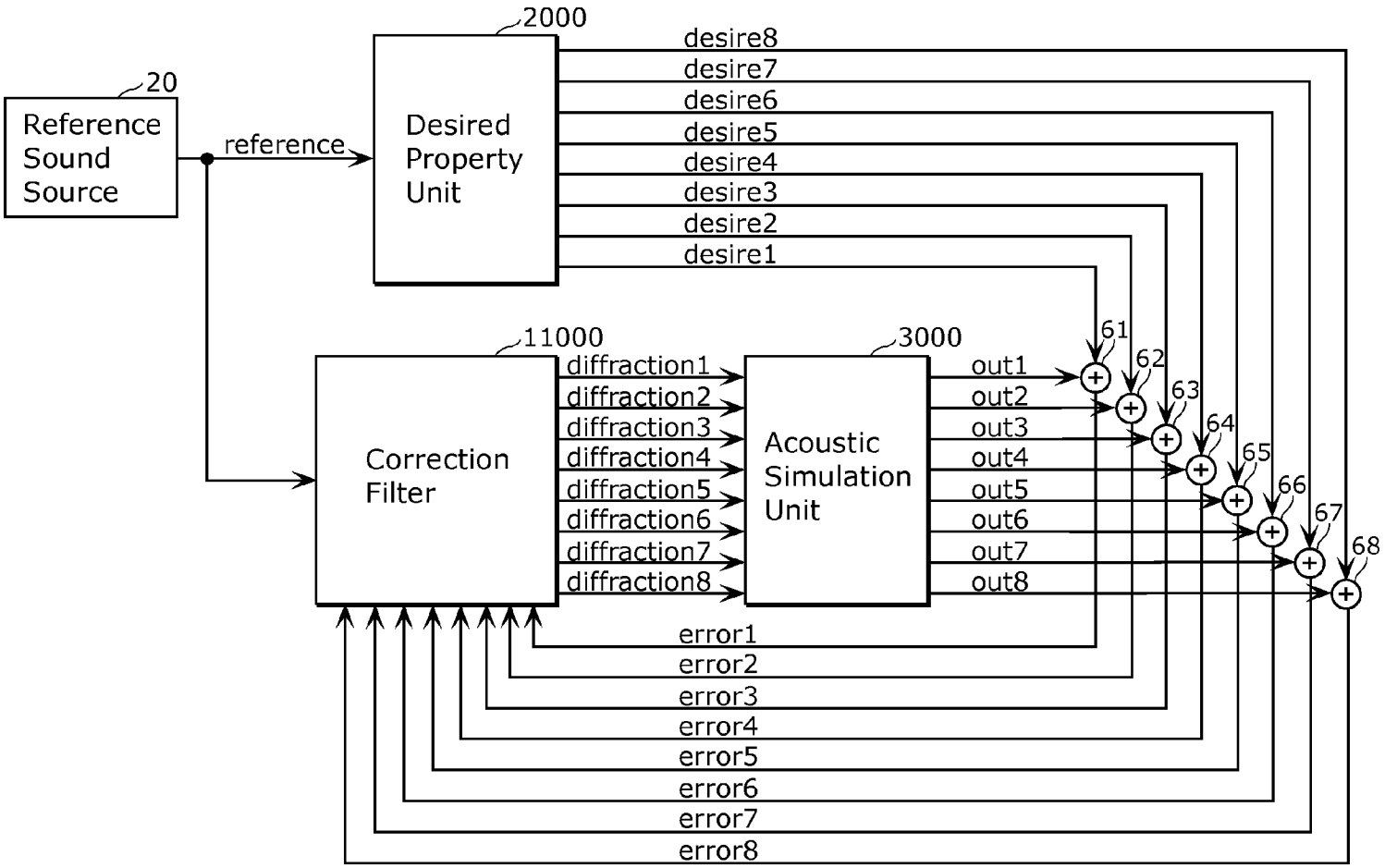
FIG. 23 is an overall block diagram of signal processing to determine control properties of the correction filter shown in FIG. 22.

In FIG. 23, the desired property unit 2000 performs predetermined processing on the reference signal provided from the reference sound source 20, and thereby outputs desire signals. The output desire signals are provided to the adders 61 to 68, respectively. On the other hand, the reference signal is provided also to the correction filter 11000. Here, the correction filter 11000 performs predetermined processing on the reference signal to output control signals. Then, the control signals are processed by the acoustic simulation unit 3000 and then provided to the adders 61 to 68, respectively, as output signals. Each of the adders 61 to 68 adds a corresponding desire signal with a corresponding output signal and provides the result to the correction filter 11000 as an error signal.

The following describes the method of determining control properties of the correction filters 10000 to 15000 (namely, a method of determining filter coefficients) in detail.

Figure 24:
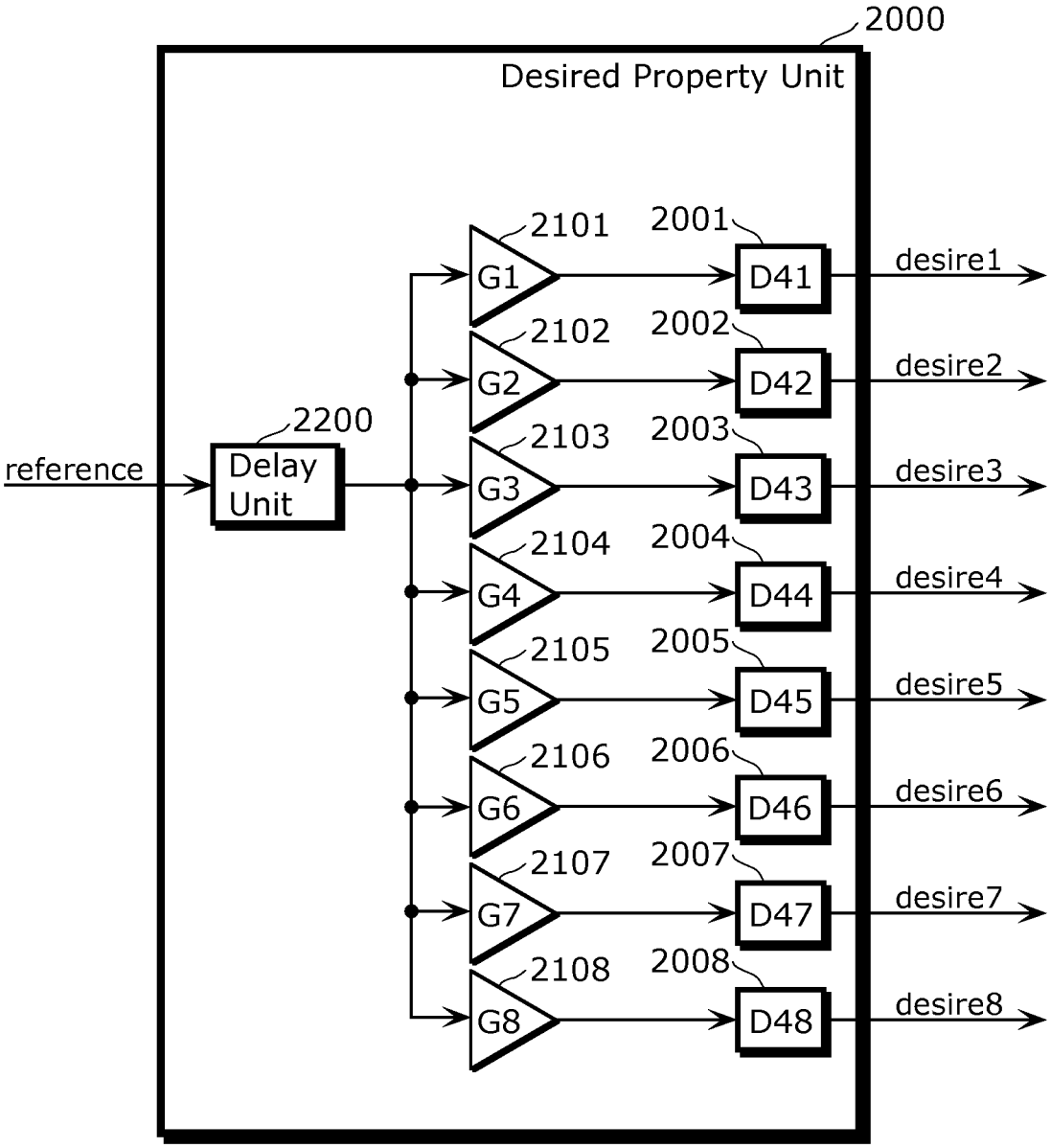
FIG. 24 is a block diagram of internal signal processing performed by the desired property unit shown in FIG. 23.

The desired property unit 2000 in FIG. 23 has a structure shown in FIG. 24. For each of the desired property filters 2001 to 2008, the transfer characteristics D41 to D48 shown in FIG. 19 are set as coefficients, respectively. The transfer characteristics D41 to D48 may be determined as described with reference to FIG. 4. To the level adjusters 2101 to 2108, an arbitrary level can be set. For example, in order to prevent that the reproduced sound provided from the control speaker 4 is transferred to the microphones 11 and 12 in FIG. 9, gains of the level adjusters 2101 to 2102 are set to 0.1. Here, gains of the other level adjusters 2103 to 2108 are basically set to 1. Even if the gains of the level adjusters 2103 to 2108 are not set to 1, the ANC 5000 in FIG. 21 performs adjustment so that it does not cause a big problem as far as the gains are not extremely small values such as 0.1. Here, a delay unit 2200 is used to set a delay time duration necessary to satisfy causality of the entire system of FIG. 23. Therefore, the input reference signal has a predetermined delay time duration and is outputted as a desired signal desire1 having 1/10 of the transfer characteristic D41. The reference signal is also outputted as a desired signal desire2 having 1/10 of the transfer characteristic D42. The reference signal is also outputted as a desired signal desire3 having 1/10 of the transfer characteristic D43. The reference signal is also outputted as a desired signal desire4 having 1/10 of the transfer characteristic D44. The reference signal is also outputted as a desired signal desire5 having 1/10 of the transfer characteristic D45. The reference signal is also outputted as a desired signal desire6 having 1/10 of the transfer characteristic D46. The reference signal is also outputted as a desired signal desire7 having 1/10 of the transfer characteristic D47. The reference signal is also outputted as a desired signal desire8 having 1/10 of the transfer characteristic D48.

Figure 25:
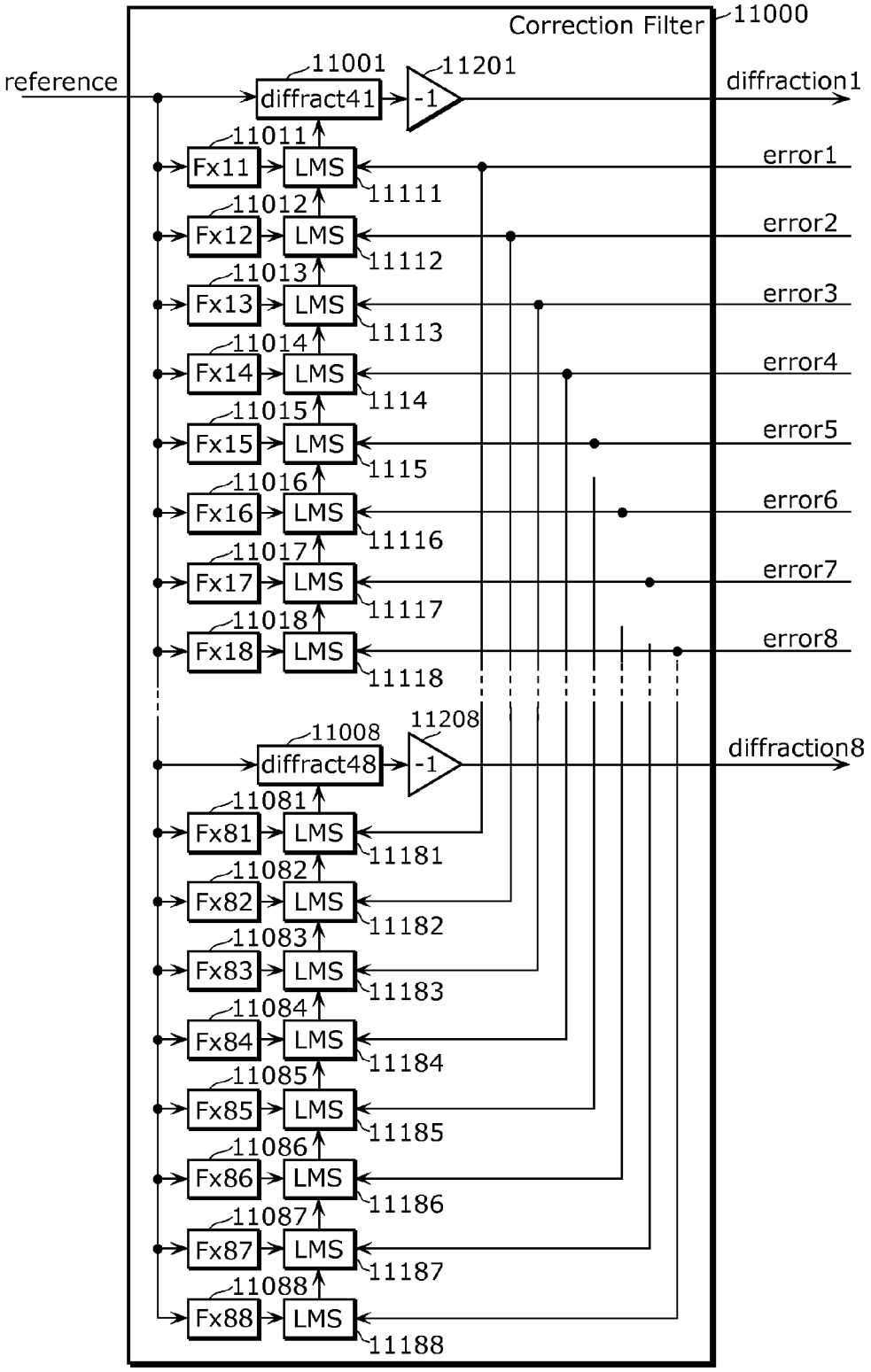
FIG. 25 is a block diagram of internal signal processing performed by the correction filter shown in FIG. 23.

FIG. 25 is a block diagram showing the correction filters 11000 shown in FIG. 23. The transfer characteristics Fx11 to Fx18 of sound transfer from the control speaker 1 to the microphones 11 to 18 are set in the Fx filters 11011 to 11018, respectively, as filter coefficients. The transfer characteristics Fx21 to Fx28 of sound transfer from the control speaker 2 to the microphones 11 to 18 are set in the Fx filters 11021 to 11028 (not described), respectively, as filter coefficients. The transfer characteristics Fx31 to Fx38 of sound transfer from the control speaker 3 to the microphones 11 to 18 are set in the Fx filters 11031 to 11038 (not described), respectively, as filter coefficients. The transfer characteristics Fx41 to Fx48 of sound transfer from the control speaker 4 to the microphones 11 to 18 are set in the Fx filters 11041 to 11048 (not described), respectively, as filter coefficients. The transfer characteristics Fx51 to Fx58 of sound transfer from the control speaker 5 to the microphones 11 to 18 are set in the Fx filters 11051 to 11058 (not described), respectively, as filter coefficients. The transfer characteristics Fx61 to Fx68 of sound transfer from the control speaker 6 to the microphones 11 to 18 are set in the Fx filters 11061 to 11068 (not described), respectively, as filter coefficients. The transfer characteristics Fx71 to Fx78 of sound transfer from the control speaker 7 to the microphones 11 to 18 are set in the Fx filters 11071 to 11078 (not described), respectively, as filter coefficients. The transfer characteristics Fx81 to Fx88 of sound transfer from the control speaker 8 to the microphones 11 to 18 are set in the Fx filters 11081 to 11088, respectively, as filter coefficients.

In FIG. 25, the control filters 11001 to 11008 perform signal processing on the input reference signal, then the phase inverters 11201 to 11208 performs phase inversion on the results, and the resulting signals are outputted as diffraction signals diffraction1 to diffraction 8. On the other hand, the reference signal is provided also to Fx filters 1011 to 1018, . . . , Fx filters 1081 to 1088, and convolution is performed between the reference signal and each of the transfer characteristics Fx11 to Fx18, . . . , Fx81 to Fx88. After that, outputs of the Fx filters 1011 to 1018, . . . , Fx filters 1081 to 1088 are provided to the LMS arithmetic units 11111 to 11118, . . . , 11181 to 11188, respectively. The LMS arithmetic units 11111 to 11118, . . . , 11181 to 11188 also receive the corresponding error signals 1 to 8. After that, the LMS arithmetic units 11111 to 11118, . . . , 11181 to 11188 determines coefficient updating amounts of the control filters 11001 to 11008, respectively, and add the results to current coefficients of the control filters 11001 to 11008, respectively, to update as next new coefficients.

Figure 26:
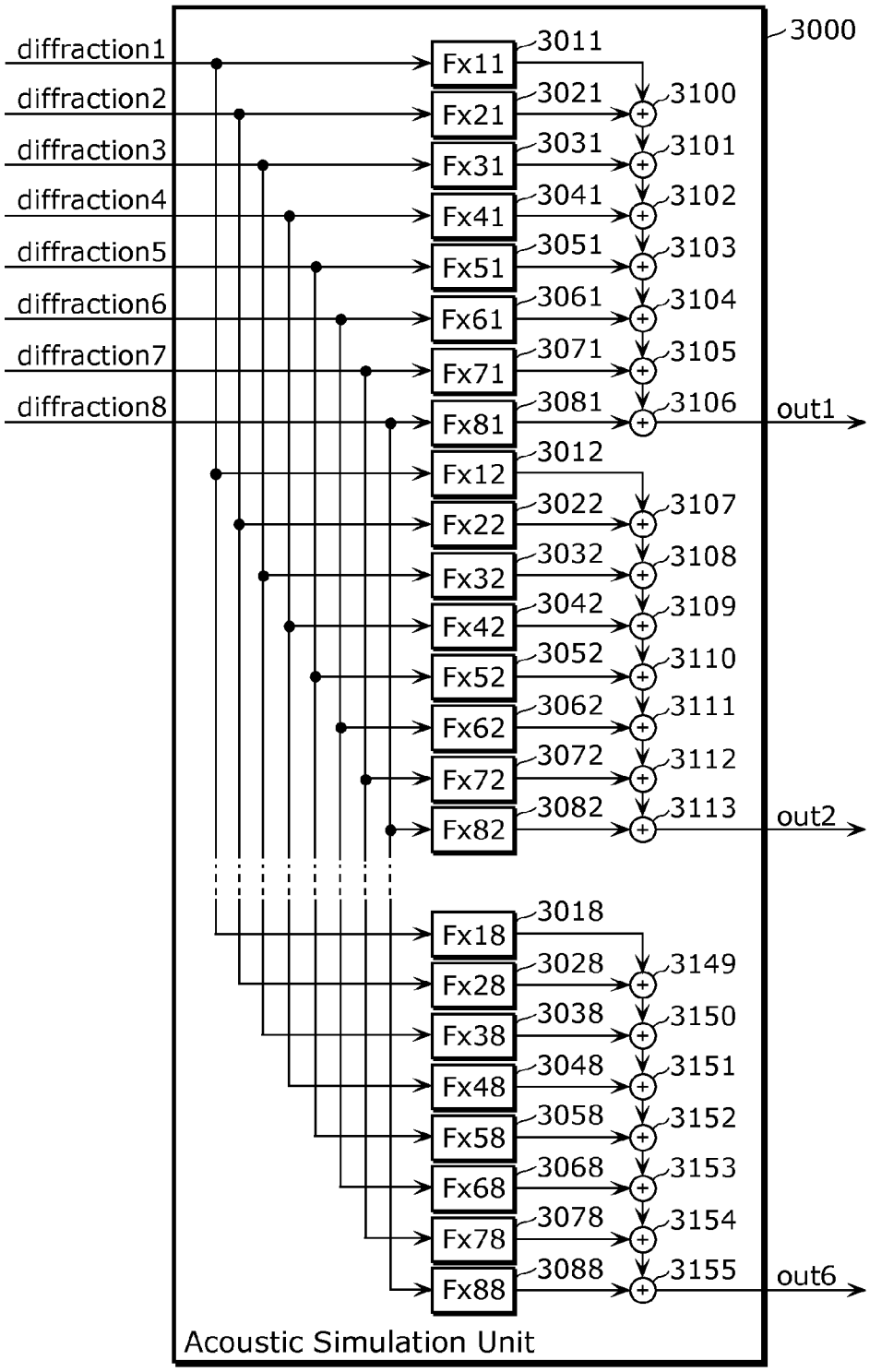
FIG. 26 is a block diagram of internal signal processing performed by the acoustic simulation unit shown in FIG. 23.

The diffraction signal diffranction1 to diffraction8 which are provided from the correction filter 11000 in FIG. 25 are provided to the acoustic simulation unit 3000 in FIG. 23. FIG. 26 is a block diagram showing an acoustic simulation unit 3000. The transfer characteristics Fx11 to Fx18 are set as filter coefficients for the Fx filters 3011 to 3018 (partly not shown). Furthermore, the transfer characteristics Fx21 to Fx28 are set as filter coefficients for the Fx filters 3021 to 3028 (partly not shown). The transfer characteristics Fx31 to Fx38 are set as filter coefficients for the Fx filters 3031 to 3038 (partly not shown). The transfer characteristics Fx41 to Fx48 are set as filter coefficients for the Fx filters 3041 to 3048 (partly not shown). The transfer characteristics Fx51 to Fx58 are set as filter coefficients for the Fx filters 3051 to 3058 (partly not shown). The transfer characteristics Fx61 to Fx68 are set as filter coefficients for the Fx filters 3061 to 3068 (partly not shown). The transfer characteristics Fx71 to Fx78 are set as filter coefficients for the Fx filters 3071 to 3078 (partly not shown). The transfer characteristics Fx81 to Fx88 are set as filter coefficients for the Fx filters 3081 to 3088 (partly not shown).

Therefore, each of the Fx filters 3011 to 3018 performs convolution between the diffracton1 and corresponding one of the transfer characteristics Fx11 to Fx18. Likewise, each of the Fx filters 3021 to 3028 performs convolution between the diffracton2 and corresponding one of the transfer characteristics Fx21 to Fx28. Furthermore, each of the Fx filters 3031 to 3038 performs convolution between the diffracton3 and corresponding one of the transfer characteristics Fx31 to Fx38. Each of the Fx filters 3041 to 3048 performs convolution between the diffracton4 and corresponding one of the transfer characteristics Fx41 to Fx48. Each of the Fx filters 3051 to 3058 performs convolution between the diffracton5 and corresponding one of the transfer characteristics Fx51 to Fx58. Each of the Fx filters 3061 to 3068 performs convolution between the diffracton6 and corresponding one of the transfer characteristics Fx61 to Fx68. Each of the Fx filters 3071 to 3078 performs convolution between the diffracton7 and corresponding one of the transfer characteristics Fx71 to Fx78. Each of the Fx filters 3081 to 3088 performs convolution between the diffracton8 and corresponding one of the transfer characteristics Fx81 to Fx88. Then, outputs of the respective Fx filters are added together by the adders 3100 to 3155 (not shown entirely) as shown in FIG. 26 to be outputted as output signals out1 to out8.

Here, the output1 is a signal by which the control sound provided from the control speakers 1 to 8 in FIG. 21 arrive at the microphone 11. Likewise, the output2 is a signal by which the control sound provided from the control speakers 1 to 8 arrive at the microphone 12. Furthermore, the output3 is a signal by which the control sound provided from the control speakers 1 to 8 arrive at the microphone 13. The output4 is a signal by which the control sound provided from the control speakers 1 to 8 arrive at the microphone 14. The output5 is a signal by which the control sound provided from the control speakers 1 to 8 arrive at the microphone 15. The output6 is a signal by which the control sound provided from the control speakers 1 to 8 arrive at the microphone 16. The output7 is a signal by which the control sound provided from the control speakers 1 to 8 arrive at the microphone 17. The output8 is a signal by which the control sound provided from the control speakers 1 to 8 arrive at the microphone 18.

As obvious from the description with reference to FIGS. 24 to 26, the adders 61 in FIG. 23 corresponds to the microphone 11 in FIG. 21. The adder 62 corresponds to the microphone 12. The adder 63 corresponds to the microphone 13. The adder 64 corresponds to the microphone 14. The adder 65 corresponds to the microphone 15. The adder 66 corresponds to the microphone 16. The adder 67 corresponds to the microphone 17. The adder 68 corresponds to the microphone 18.

The error signals error1 to error8 in FIG. 23 correspond to the output signals of the microphones 11 to 18, respectively. Then, the control filters 11001 to 11008 in the correction filter 11000 in FIG. 25 update their coefficients (diffract41 to diffract48) to minimize the error signals error1 to error8, respectively. As a result, the synthesized properties of the correction filter 11000 and the acoustic simulation unit 3000 are controlled to be the same as those of the desired property unit 2000. This means that the reference signal provided to the correction filter 11000 is converted by the adders 61 and 62 via the acoustic simulation unit 3000 into D41/10 and D42/10, respectively. The reference signal is converted by the adders 63 to 68 into D43, D44, D45, D46, D47, and D48.

In the above description, the control speaker 4 has been described as an example. The same control is performed also on the control speaker 3 for the correction filter 10000. Likewise, the same control is performed for the control speakers 5 to 8 to determine the correction filters 12000 to 15000, respectively.

As a result, regarding the sound indicated by each of the output signals acn1 to anc6 provided from the ANC 5000 in FIG. 21, the diffracted sound is controlled by corresponding one of the correction filters 10000 to 15000 and the adder 6000. While the control sound reproduced by the control speakers 1 to 8 are transferred to the microphones 13 to 18, respectively, with respective designated sound pressures, the levels of the control sound are reduced to 1/10 at the microphones 11 and 12. Therefore, the ANC 5000 can control the microphones 13 to 18 without affecting the microphones 11 and 12.

Figure 27:
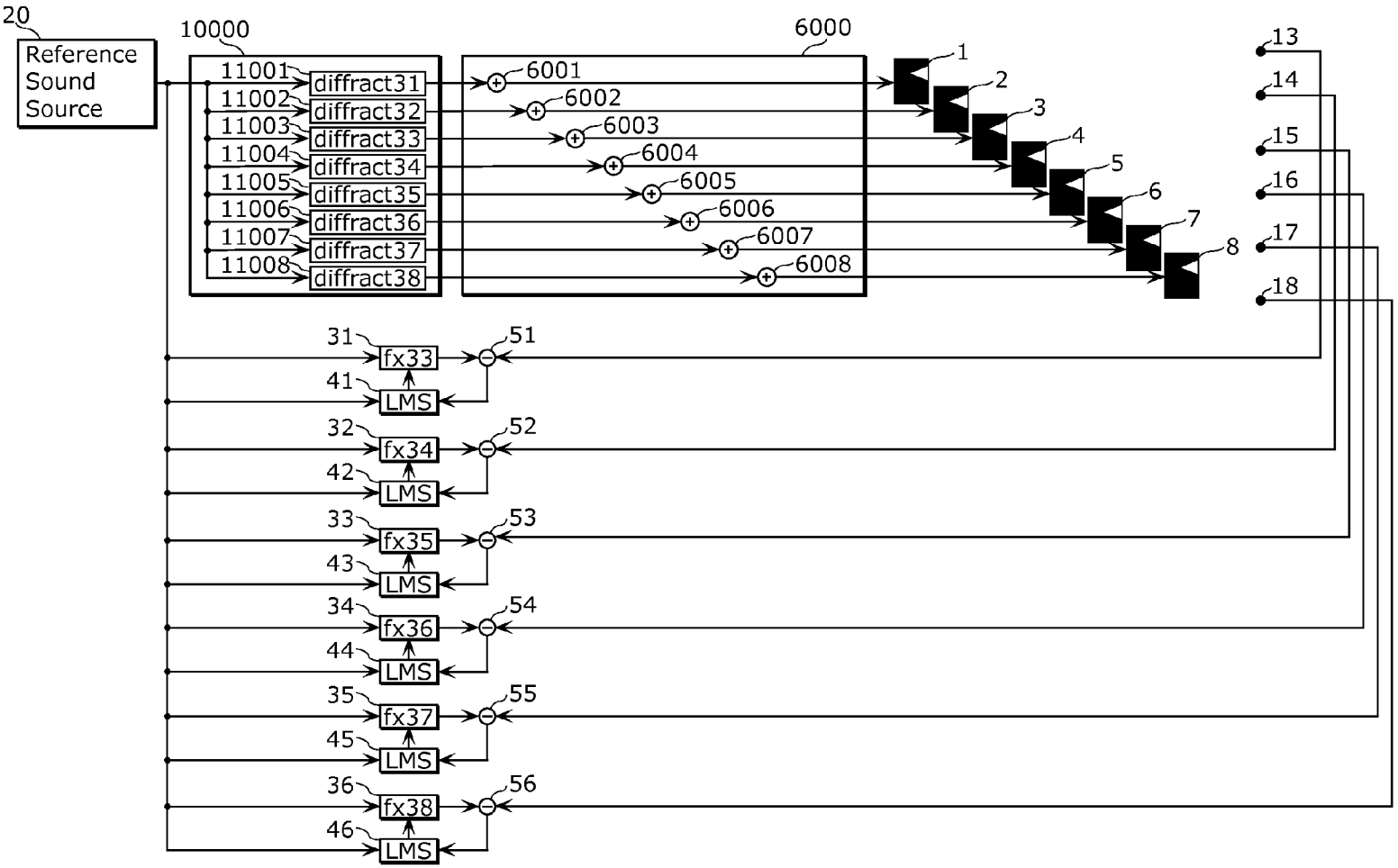
FIG. 27 is a block diagram of signal processing performed to determine properties of a Filtered-x filter of an Active Noise Control (ANC) shown in FIG. 21.

Next, the processing performed by the ANC 5000 is described. In view of the ANC 5000, transfer paths from the correction filters 10000 to 15000 to the microphones 13 to 18 via the adder 6000 and the control speakers 1 to 8, respectively, are so-called secondary paths. Therefore, it is necessary to identify these paths as filtered-x filters. FIG. 27 shows the situation where the correction filter 10000 is used as an example.

In FIG. 27, the reference signal produced by the reference sound source 20 is reproduced, as reference sound, by the control speakers 1 to 8 via the correction filter 10000 and the adder 6000. Here, for the correction filter 10000, as described with reference to FIGS. 21 to 26, the diffracted sound is controlled. Therefore, (it is considered that) the control sound reproduced by the control speakers 1 to 8 are transferred to the microphones 13 to 18 in FIG. 21, respectively, but are not transferred to the microphones 11 and 12.

At the same time, the reference signal produced by the reference sound source 20 is provided to the Fx filters 31 to 36 and the LMS arithmetic units 41 to 46. Each of the Fx filters 31 to 36 performs convolution between the corresponding control coefficient and the reference signal provided from the reference sound source 20, and provides the result to corresponding one of the subtractors 51 to 56. On the other hand, the reference sound reproduced by the control speakers 1 to 8 are detected by the microphones 13 to 18 and provided to the subtractors 51 to 56, respectively. Then, the subtractors 51 to 56 subtract output signals of the Fx filters 31 to 36 from the detected signals of the microphones 13 to 18, respectively, and provide the results to the LMS arithmetic units 41 to 46, respectively. The LMS arithmetic units 41 to 46 perform LMS arithmetic operations using the reference signal produced by the reference sound source 20 as the reference signal and the output signals of the subtractors 51 to 56 as error signals, so that the error signals are minimized. In other words, the LMS arithmetic units 41 to 46 calculate coefficient updating amounts of the Fx filters 31 to 36, respectively, and add the updating amounts to the respective current control coefficients to obtain respective next new control coefficients. By using the calculated control coefficients, the Fx filters 31 to 36 are updated. By repeating the series of operations, the respective error signals of the LMS arithmetic units 41 to 46, namely, the output signals of the subtractors 51 to 56 approach minimum values (ideally, approach almost 0). As a result, each of the properties of the Fx filters 31 to 36 (=coefficients) is approximated to the a transfer characteristic of sound transfer from the correction filter 10000 to corresponding one of the microphones 13 to 18 via corresponding one of the control speakers 1 to 8.

As described above, for the Fx filter 31, the transfer characteristic fx33 of sound transfer from the correction filter 10000 to the microphone 13 are determined. For the Fx filter 32, the transfer characteristic fx34 of sound transfer from the correction filter 10000 to the microphone 14 are determined, . . . , and for the Fx filter 36, the transfer characteristic fx38 of sound transfer from the correction filter 10000 to the microphone 18 are determined.

Although the correction filter 10000 has been described as an example, transfer characteristics can be determined also for the correction filters 11000 to 15000 in the same manner. More specifically, in the case of the correction filter 11000, transfer characteristics fx43 to fx48 are determined. In the case of the correction filter 12000, transfer characteristics fx53 to fx58 are determined. In the case of the correction filter 13000, transfer characteristics fx63 to fx68 are determined. In the case of the correction filter 14000, transfer characteristics fx73 to fx78 are determined. In the case of the correction filter 15000, transfer characteristics fx83 to fx88 are determined.

As described above, after determining filtered-x filters in view of the ANC 5000, control properties of the ANC 5000 are to be determined. The following describes the method of determining control properties of the ANC 5000.

Figure 28:
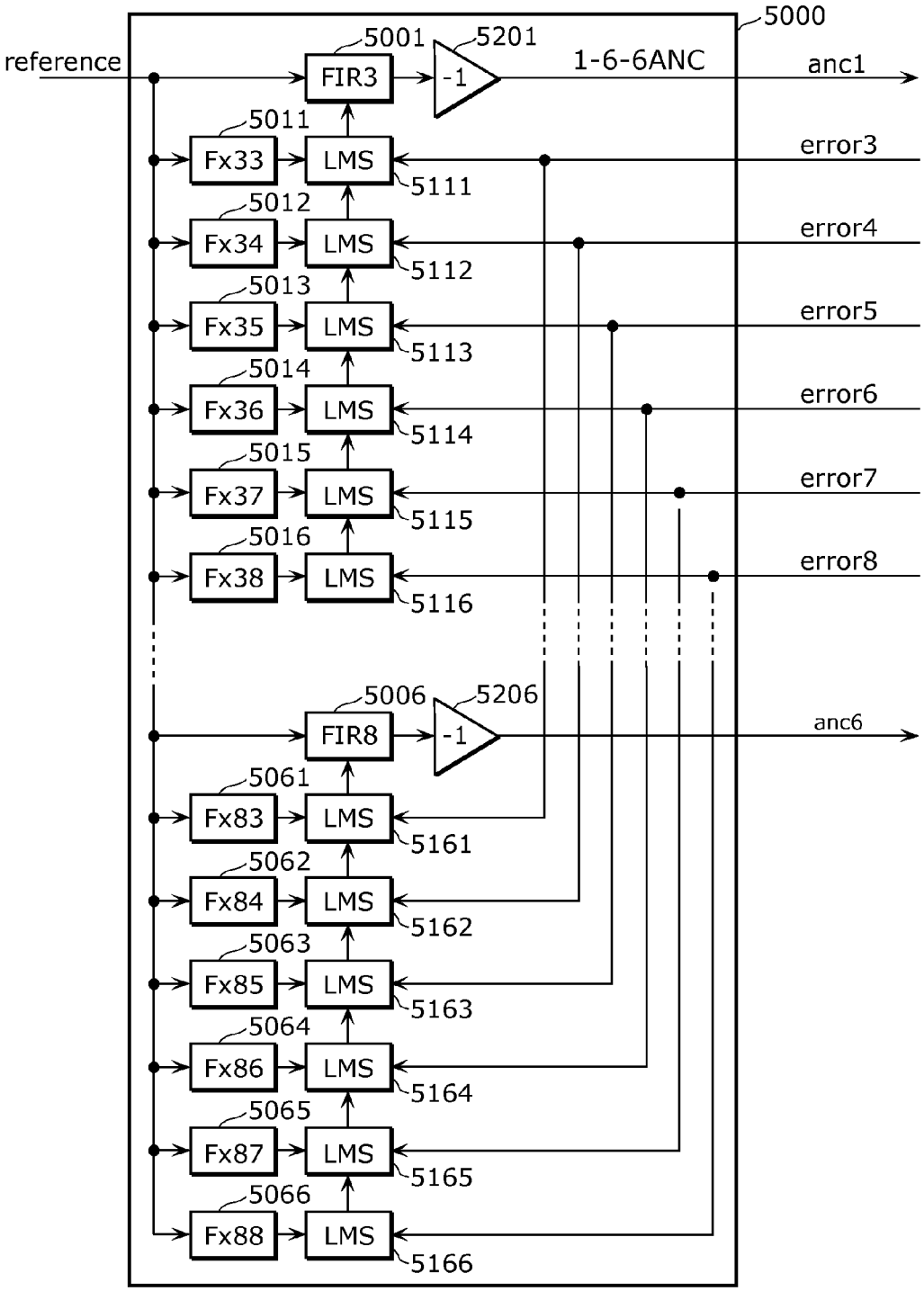
FIG. 28 is a block diagram of internal signal processing performed by the ANC shown in FIG. 21.

FIG. 28 shows an internal structure of the ANC 5000 in FIG. 21. For each of the Fx filters 5011 to 5066, as described with reference to FIG. 27, predetermined transfer characteristics are set as a coefficient.

Referring back to FIG. 21, the reference signal produced by the reference sound source 20 is applied with predetermined delay processing by the delay unit 7000, and then reproduced by the reproduction speaker 10. Here, the delay unit 7000 is used to satisfy causality of the entire system shown in FIG. 21.

On the other hand, the reference signal produced by the reference sound source 20 is provided also to the ANC 5000. The ANC 5000 performs predetermined signal processing on the reference signal to produce signals and to anc6. After that, each of the signals and to anc6 is applied with signal processing necessary for diffracted sound control by corresponding one of the correction filters 10000 to 15000, and then provided to the adder 6000 as corresponding one of diffraction1 to diffraction 6. The adder 6000 perform addition operation for each of the input signals diffraction1 to diffraction6 for each of the control speakers, so as to generate signals (control1 to control8). The signals control1 to control8 are reproduced by the control speakers 1 to 8, respectively.

Thereby, at each of the microphones 13 to 18, the reproduced sound reproduced by the reproduction speaker 10 interferes with corresponding one of the control sound produced by the control speakers 1 to 8. The results are detected as error signals error3 to error8.

In FIG. 28, the control filters 5001 to 5006 perform signal processing on the input reference signal, and the phase inverters 5201 to 5206 perform phase inversion on the results to generate signals and to anc6. The reference signal is provided also to the Fx filters 5011 to 5016, . . . , Fx filters 5061 to 5066. Then, convolution is performed between the reference signal and each of the transfer characteristics fx33 to fx38, . . . , fx83 to fx88, and then provided to the LMS arithmetic units 5111 to 5116, . . . , 5161 to 5166, respectively. The LMS arithmetic units 5111 to 5116, . . . , 5161 to 5166 receive signals error3 to error8 which are outputs of the microphones 13 to 18. The LMS arithmetic units calculate coefficient updating amounts of the control filters 5001 to 5006 to minimize the signals error3 to error8, respectively. Furthermore, the calculated coefficient updating amounts are added to the current coefficients of the control filters 5001 to 5006, respectively, so as to update the coefficients of the control filters. As a result, levels of the signals error3 to error8 are decreased.

More specifically, the ANC 5000 performs so-called control of 1 (the number of reference signal)-6 (the number of control speakers)-6 (the number of control points). As a result, in FIG. 21, when the reference signal produced by the reference sound source 20 is reproduced by the reproduction speaker 10, the level is decreased at the microphones 13 to 18. This means that the reproduced sound reproduced by the reproduction speaker 10 is cancelled at the microphones 13 to 18. On the other hand, the control sound reproduced by the control speakers 1 to 8 are transferred to the microphones 13 to 18, respectively, but their levels are decreased not to affect the microphones 11 and 12. Therefore, at the microphones 11 and 12, the reproduced sound reproduced by the reproduction speaker 10 is heard as not changed. In other words, if the reference sound source 20 is TV sound, the TV sound produced by the microphones 11 and 12 are heard with predetermined sound pressure levels regardless of the operation of the ANC 5000. At the same time, at the microphones 13 to 18, the TV sound is reduced not to be heard if the ANC 5000 operates.

Figure 29:
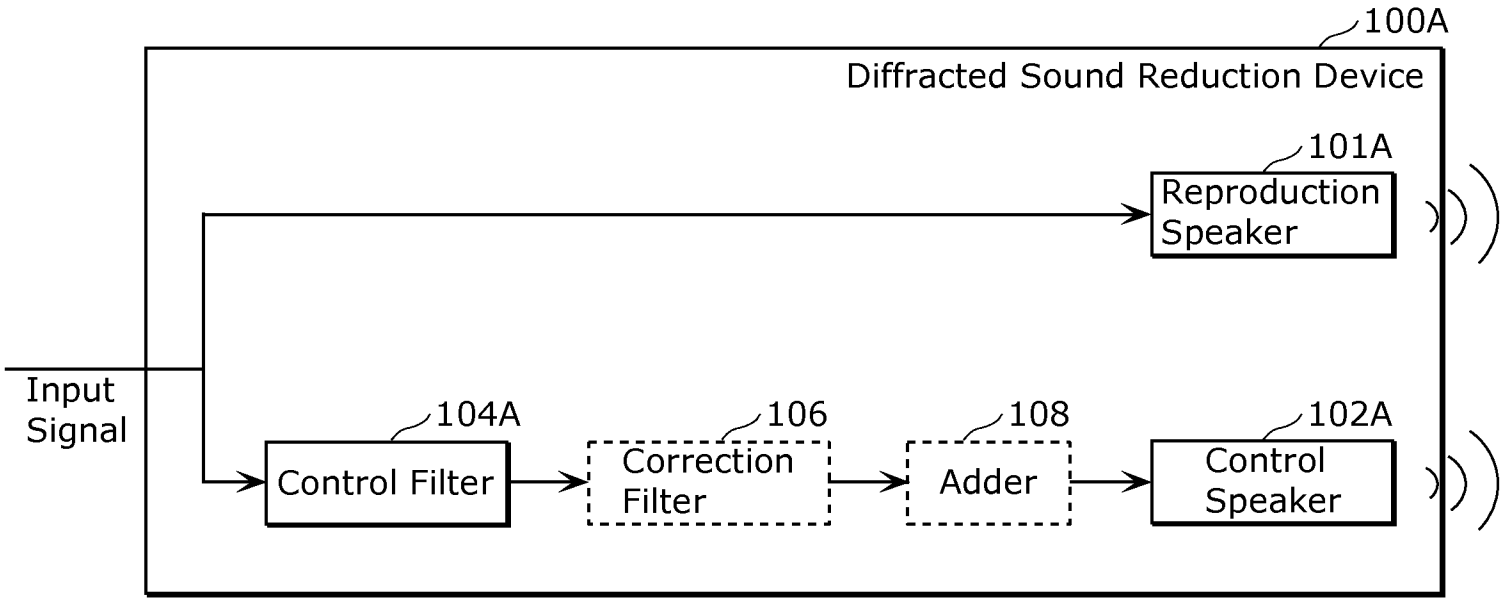
FIG. 29 is a functional block diagram of a diffracted sound reduction device according to Embodiment 2.

FIG. 29 is a functional block diagram of a diffracted sound reduction device 100A according to the present embodiment of the present invention.

As shown in FIG. 29, the diffracted sound reduction device 100A differs from the diffracted sound reduction device 100 in including a correction filter 106 (corresponding to the correction filters 10000 to 15000 in FIG. 21) that receives control signals from a control filter 104A (corresponding to 1-6-6ANC 5000 in FIG. 21), and an adder 108 (corresponding to the adder 6000 in FIG. 21).

The reproduction speaker 101A is different from at least two control speakers 102A. More specifically, from among at least two control speakers 102A, the first control speaker (corresponding to the control speakers 1 and 2 in FIG. 21 in the present embodiment) has a diaphragm facing the listener. The other control speakers rather than the first control speaker (corresponding to the control speakers 3 to 8 in FIG. 21 in the present embodiment) are arranged around the reproduction speaker not to face the listener.

The correction filter 106 has filter coefficients (diffract31 to diffract88 in FIG. 22) which are determined to further reduce influence of the control sound indicated by the control signals applied with the correction filter to the properties of the reproduced sound at the listener's position. In other words, the correction filter 106 has filter coefficients for decreasing the control sound reproducing control singles applied with the correction filter not to affect the properties of the reproduced sound at the listener's position (CL9).

The adder 108 consolidates control signals (diffraction) to diffraction8 in FIG. 22) applied with the correction filter 106 for each of the control speakers, and provides the consolidated control signals to the respective control speakers.

With the above-described structure, for example, if the listener watches TV, it is possible to reduce sound diffracted in directions except the direction towards the listener, without changing properties of the TV sound at the listener's position or in the direction towards the listener regardless whether or not control is performed. Therefore, the listener can watch TV without any constraint.

Furthermore, since the reproduction speaker 10 embedded in the TV is not used for the control, if the control speakers 1 to 8 are later arranged around an apparatus such as a general TV, the above-described effects can be offered.

It should be noted that it has been described in the present embodiment that the diffracted sound reduction level is 1/10, but it may be appropriately set to a desired arbitral level, for example, 1/3, 1/2, or the like depending on the situation such as room environments.

Here, in order to examine the effects of the diffracted sound reduction device according to the present embodiment, an actual experiment is described with reference to FIGS. 30 to 37.

Figure 30:
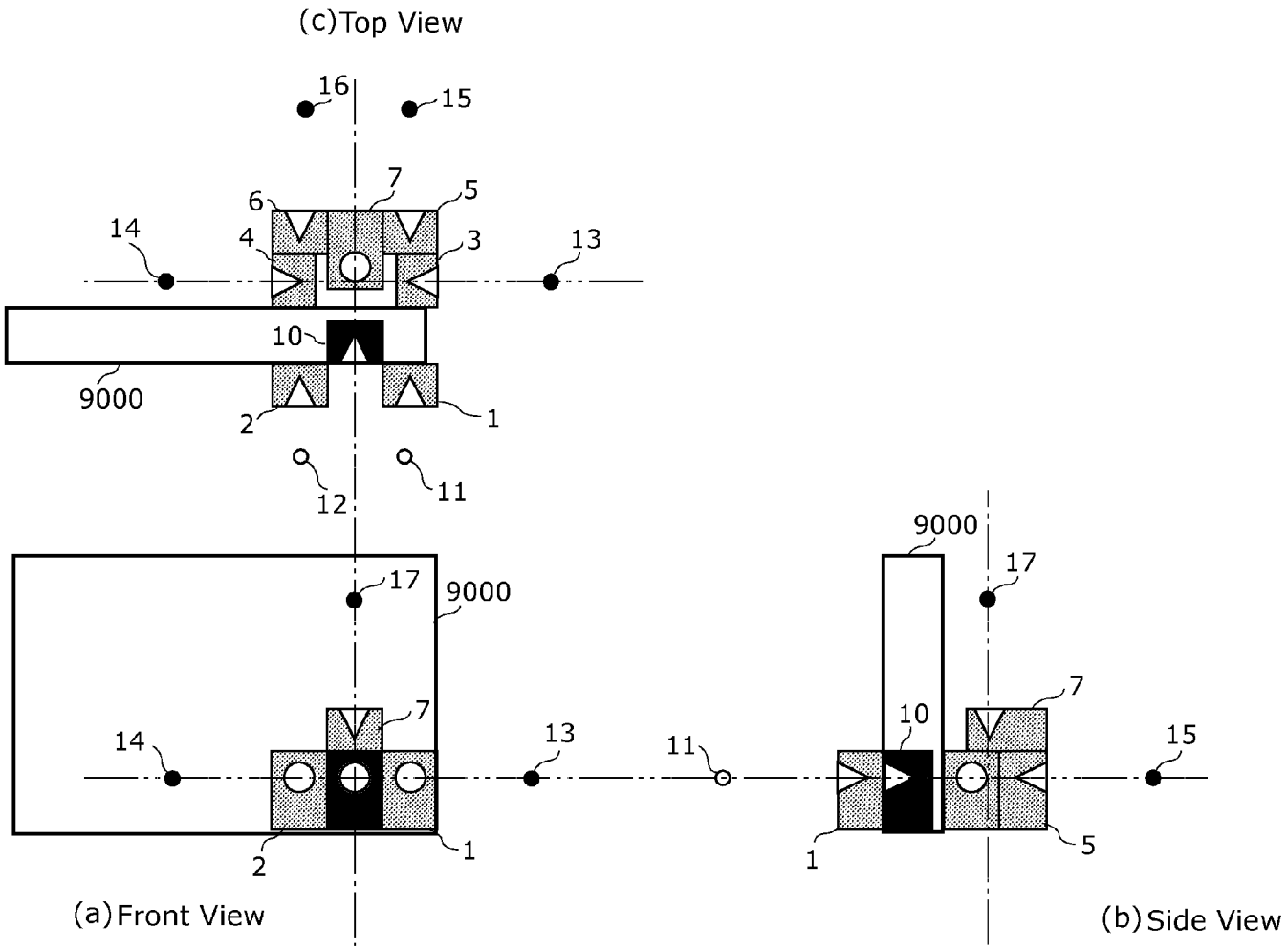
FIG. 30 is a diagram showing an arrangement of microphones and speakers of a diffracted sound reduction device in a laboratory according to Embodiment 2.

FIG. 30 shows the reproduction speaker 10 embedded in a TV 9000, and the control speakers 1 to 7 arranged around the reproduction speaker 10, and the microphones 11 to 17 serving as control points. In this experiment, the TV 9000 and the control speakers 1 to 7 are provided on a stand to arrange them at a certain height from the floor. Therefore, the control speaker 8 in FIGS. 19 and 20 is not used, and the total seven control speakers 1 to 7 are used. Accordingly, used microphones are seven microphones 11 to 17. In other words, a space below the control speakers is not controlled. The first aim of the experiment is that the reproduced sound reproduced by the reproduction speaker 10 embedded in the TV has the same properties at the control points of the microphones 11 and 12 regardless whether or not control is performed (the reproduced sound is not changed regardless whether control is ON or OFF). In addition, the second aim is to perform control so that sound pressure levels at the control points of the microphones 13 to 17 are reduced to ⅓. The results are as follows.

Figure 31:
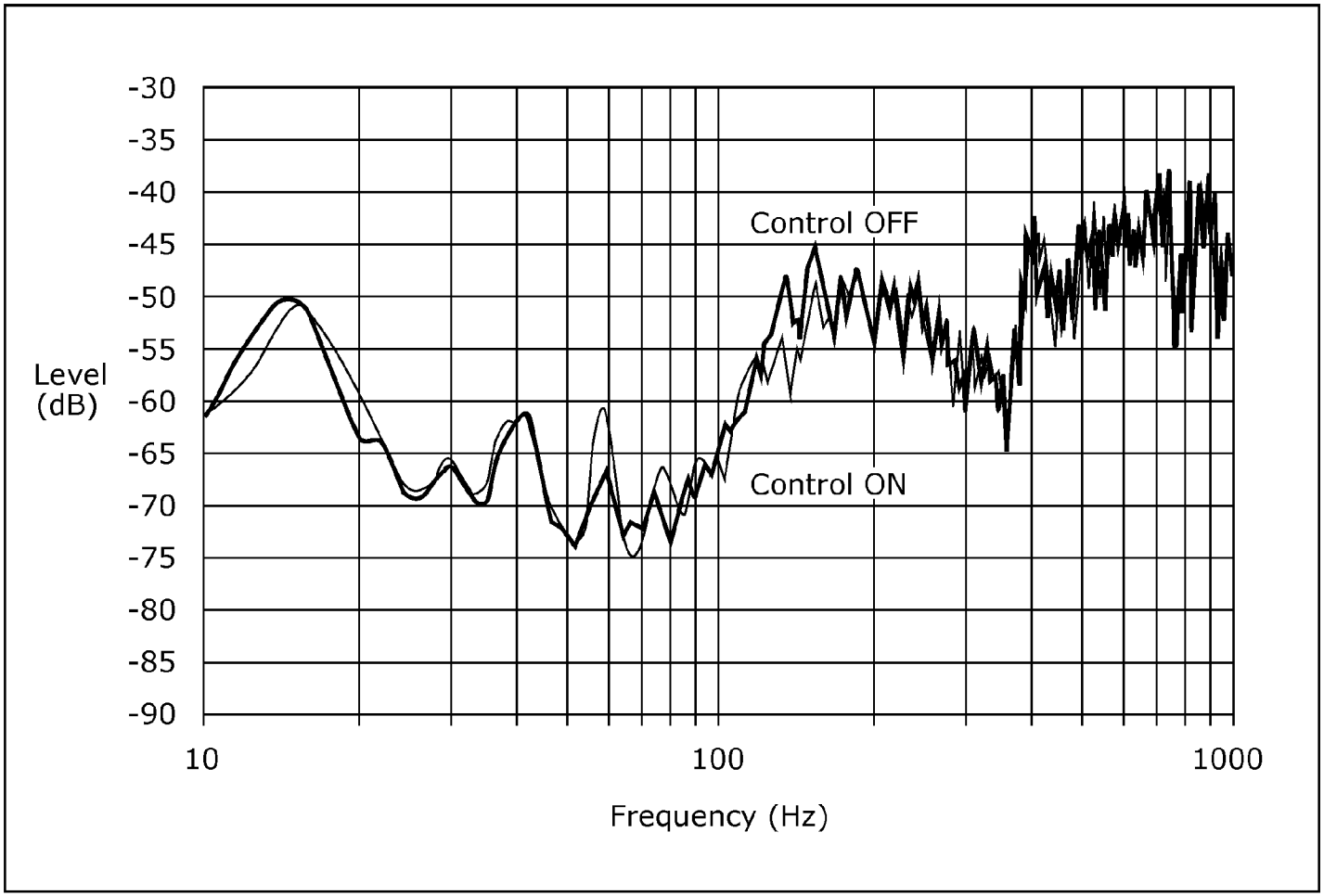
FIG. 31 is a graph plotting control effects of a microphone 11 of the diffracted sound reduction device in the experimental arrangement shown in FIG. 30.
Figure 32:
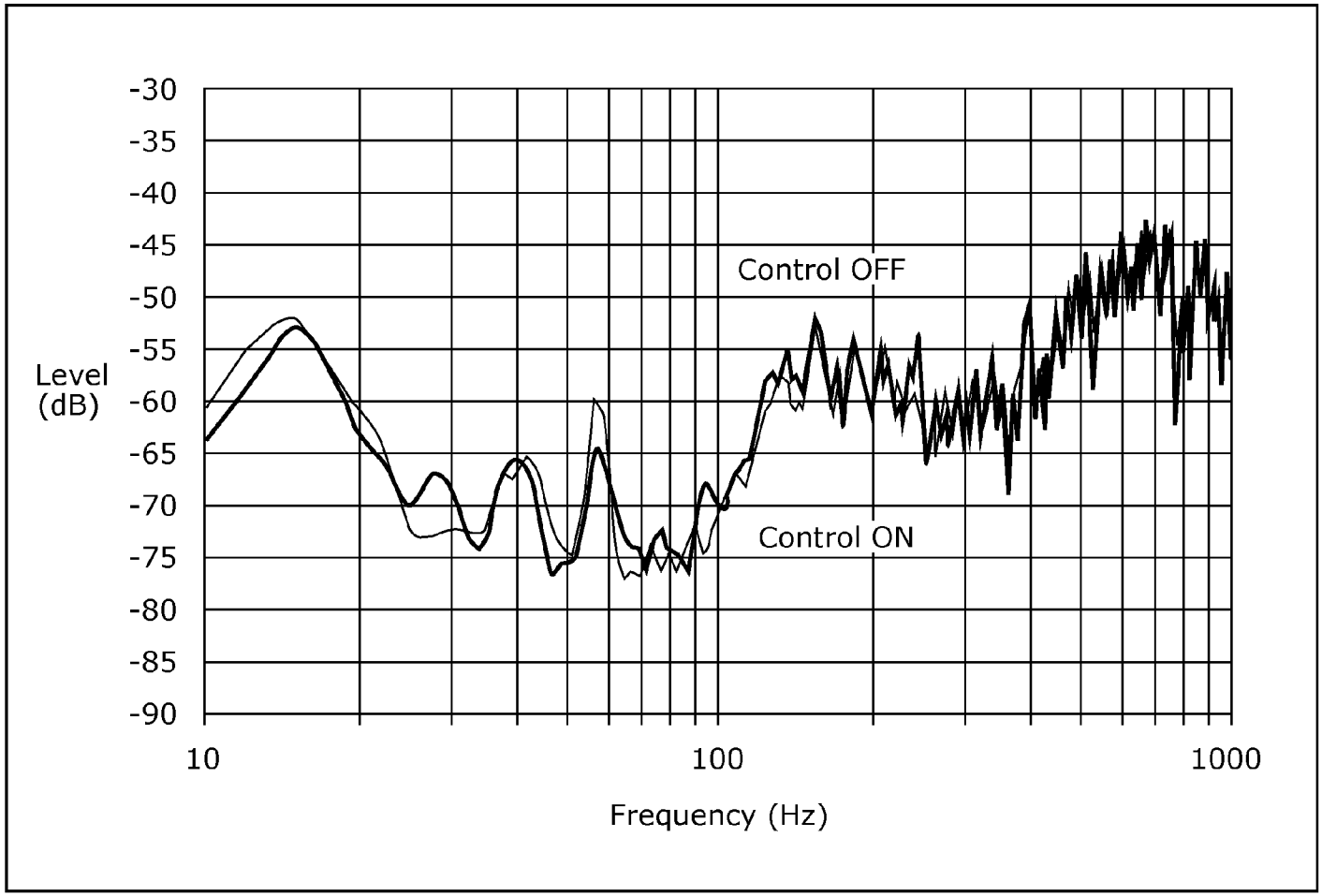
FIG. 32 is a graph plotting control effects of a microphone 12 of the diffracted sound reduction device in the experimental arrangement shown in FIG. 30.
Figure 33:
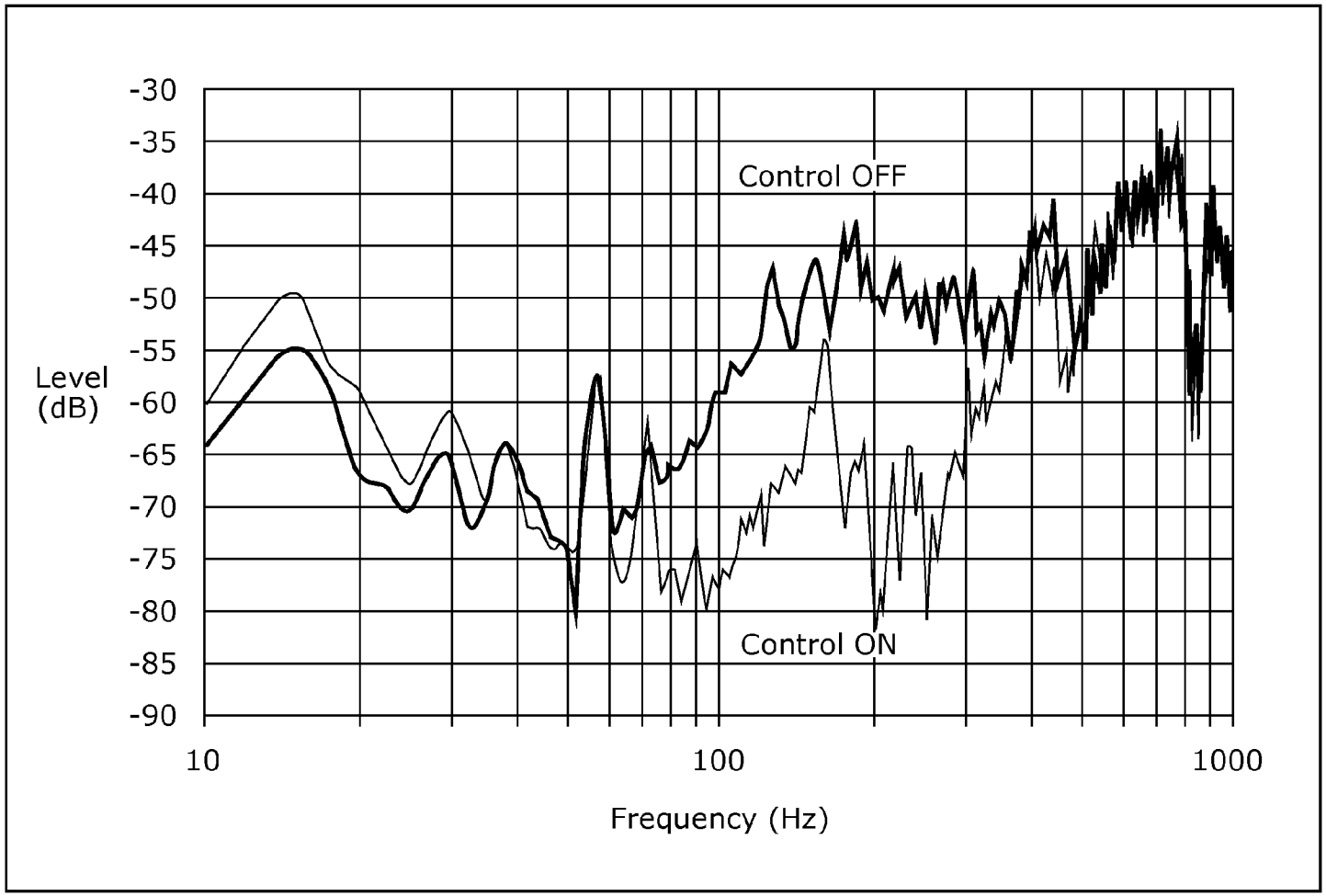
FIG. 33 is a graph plotting control effects of a microphone 13 of the diffracted sound reduction device in the experimental arrangement shown in FIG. 30.
Figure 34:
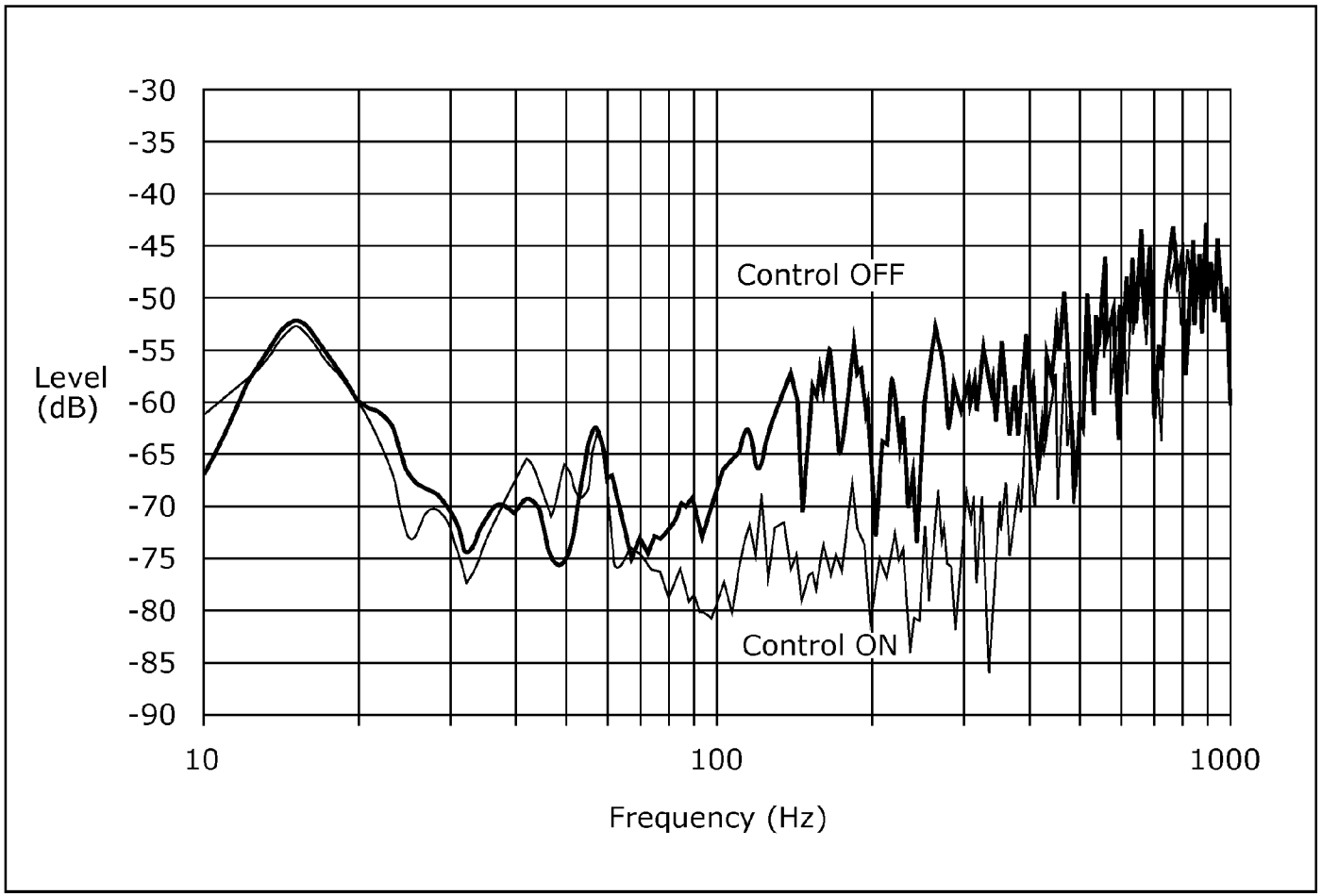
FIG. 34 is a graph plotting control effects of a microphone 14 of the diffracted sound reduction device in the experimental arrangement shown in FIG. 30.
Figure 35:
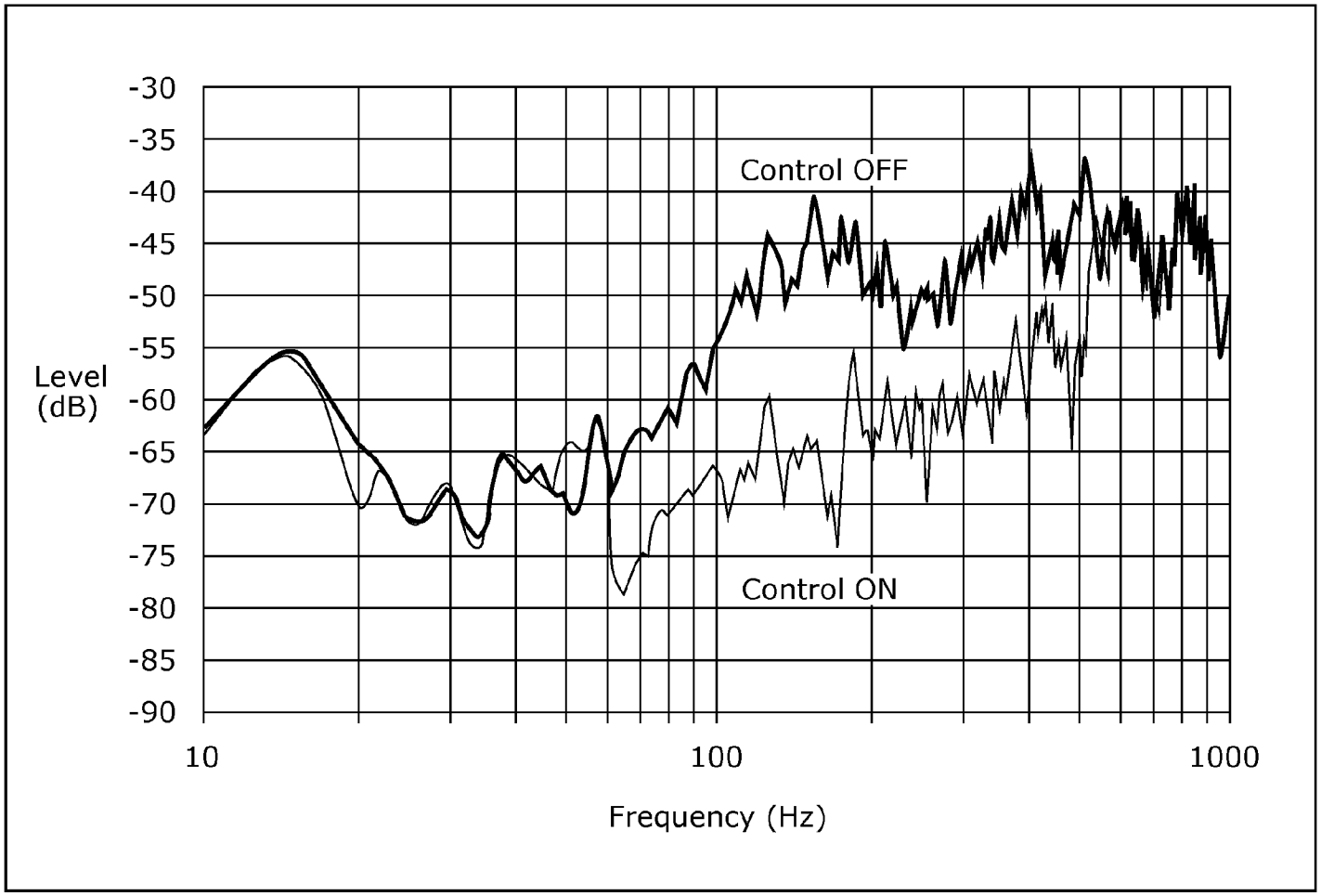
FIG. 35 is a graph plotting control effects of a microphone 15 of the diffracted sound reduction device in the experimental arrangement shown in FIG. 30.
Figure 36:
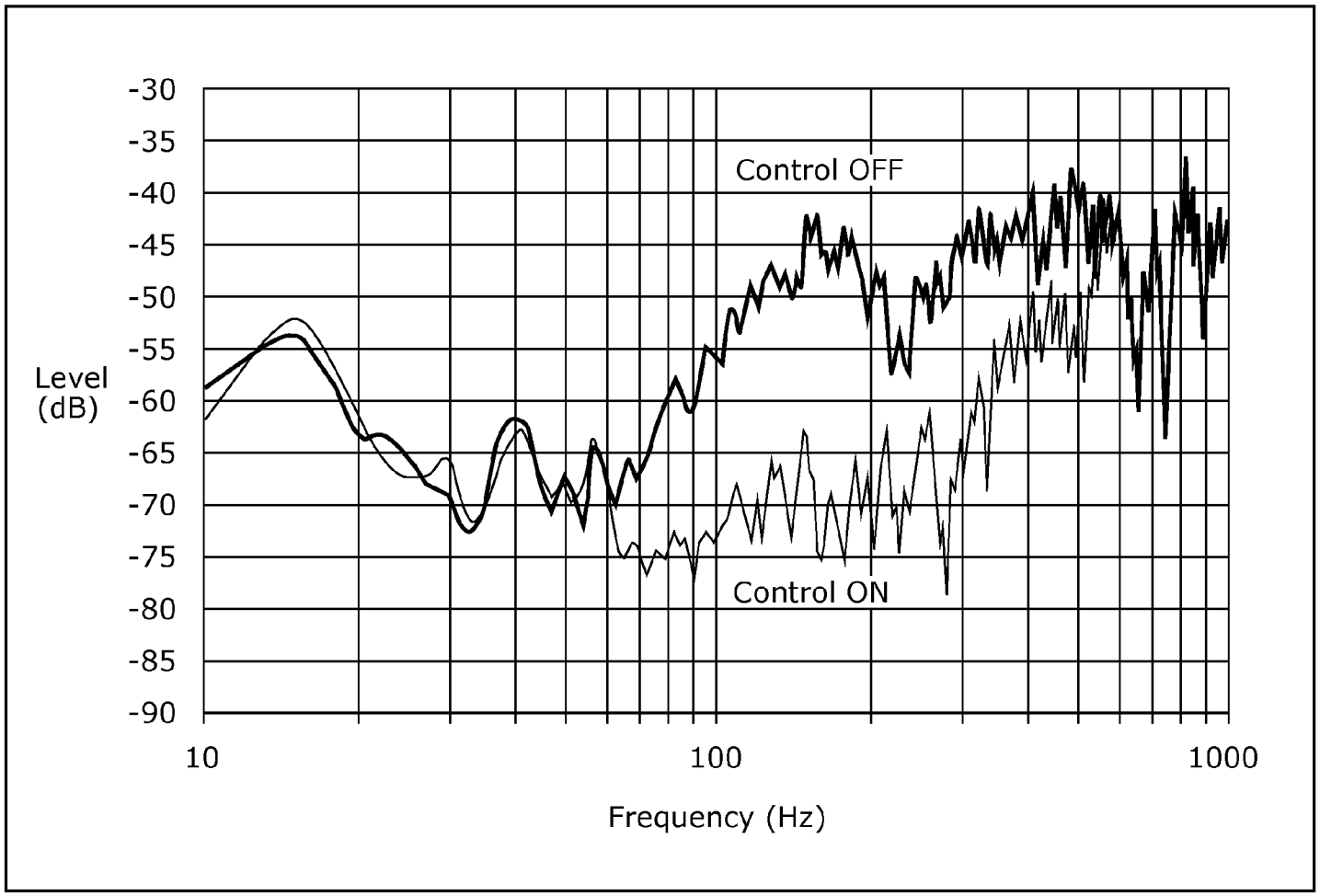
FIG. 36 is a graph plotting control effects of a microphone 16 of the diffracted sound reduction device in the experimental arrangement shown in FIG. 30.
Figure 37:
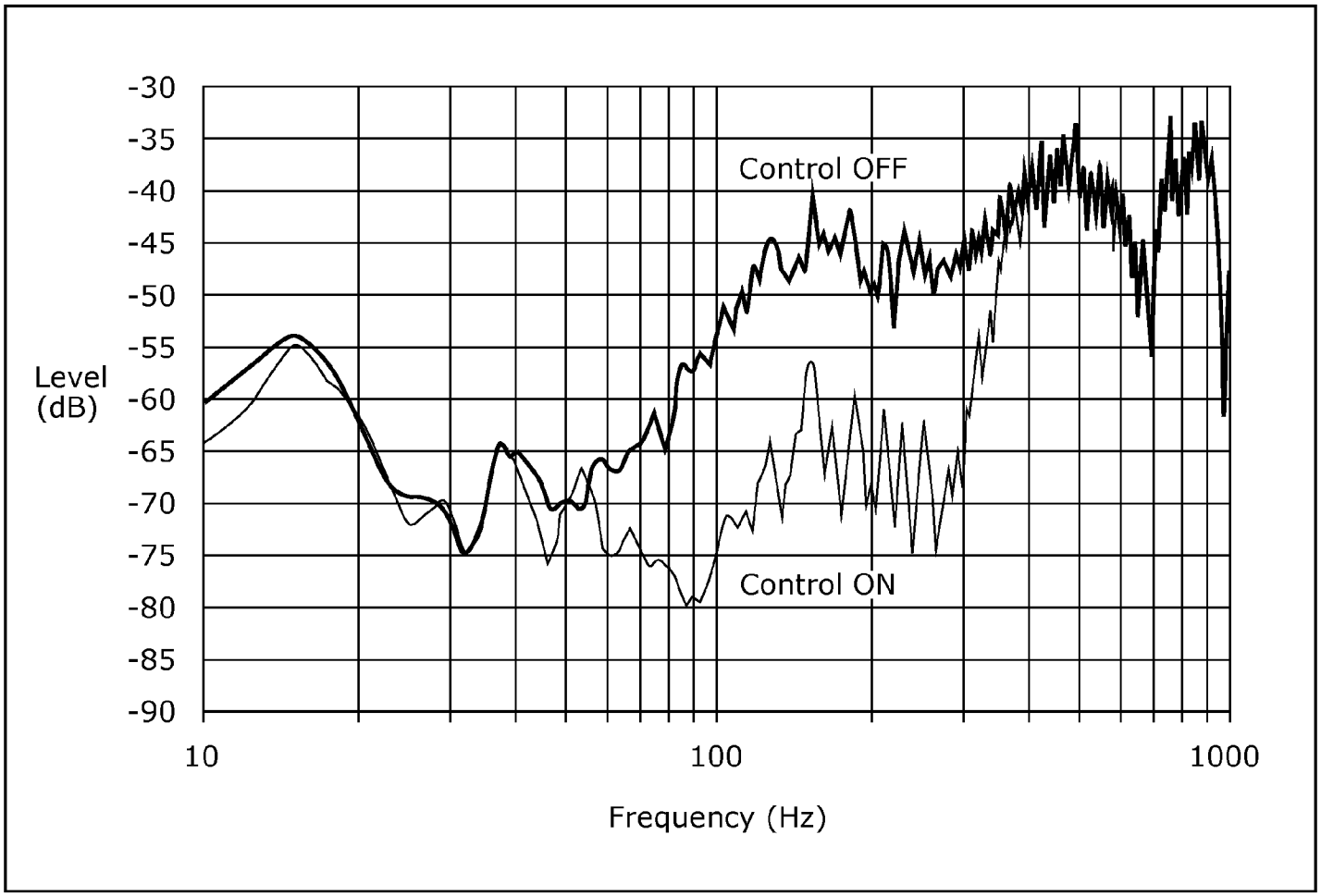
FIG. 37 is a graph plotting control effects of a microphone 17 in the diffracted sound reduction device in the experimental arrangement shown in FIG. 30.

FIG. 31 shows control effects at the position of the microphone 11. Whichever the control is ON (thin line) or OFF (thick line), the properties are hardly changed. FIG. 32 shows control effects at the position of the microphone 12. Whichever the control is ON or OFF, the properties are hardly changed. FIG. 33 shows control effects at the position of the microphone 13. In the control ON, the reduction effects of approximately 10 dB (=reduction to ⅓) are obtained. Likewise, FIG. 34 shows control effects at the position of the microphone 14. In the control ON, the reduction effects of approximately 10 dB are obtained. FIG. 35 shows control effects at the position of the microphone 15. In the control ON, the reduction effects of approximately 10 dB are obtained. FIG. 36 shows control effects at the position of the microphone 16. In the control ON, the reduction effects of approximately 10 dB are obtained. FIG. 37 shows control effects at the position of the microphone 17. In the control ON, the reduction effects of approximately 10 dB are obtained.

As described above, it is learned that at the positions of the microphones 11 to 17, by using the control speakers 1 to 7, the diffracted sound from the reproduction speaker 10 embedded in the TV can be reduced. In the experiment, at the positions of the microphones 13 to 17, the diffracted sound is reduced in a wide frequency band of approximately 60 Hz to 500 Hz. Therefore, the control effects can be offered in a low frequency band, which has been difficult for the directional speaker according to the third related art. Moreover, in comparison to the first and second related arts for controlling vibration of an entire wall surface partitioning a next-door room and the directional speaker as the third related art, it is possible to offer a compact shape and to significantly reduce an arithmetic operation amount. Furthermore, since the reproduction speaker 10 embedded in the TV 9000 reproduces reproduced sound and the control speakers 1 to 7 around the reproduction speaker 10 perform the control, it is not necessary to change the TV 9000 itself. If the control speakers and the microphones are later added to a TV which has already been bought, it is possible to reduce diffracted sound. In this case, it is also considered that a shelf or rack on which the control speakers and microphones are arranged is prepared for a TV. In other words, if a manufacturer, a model number, and the like of the TV is known, a size of the TV, a position of the embedded reproduction speaker, and the like are determined, which makes it possible to create a TV shelf or rack to satisfy the conditions. Therefore, if the user buys the dedicated rack at or after the purchase of the TV, it is possible to easily achieve the diffracted sound reduction device with good appearance.

It should be noted that it has been described that the downward control speaker 8 is eliminated in the experiment shown in FIG. 30, it is ideal not to eliminate the control speaker 8. However, as good effects are offered in this experiment, it is possible to reduce the number of control speakers according to conditions applied to the system, within a range not to affect the effects.

It should also be noted that, in Embodiments 1 and 2, speakers and microphones can be used instead of the acoustic simulation unit. The acoustic simulation unit is a structural unit for determining, at respective control points, properties of sound reproduced by the reproduction speaker and the control speakers which are arranged at predetermined positions. Therefore, if it is possible to actually arrange the speakers and the microphones, the acoustic simulation unit is not necessary.

It should be noted that the functional blocks in each of the block diagrams (FIGS. 2 to 9, FIGS. 21 to 29, and so on) are typically implemented into a Large Scale Integration (LSI) which is an integrated circuit. These may be integrated separately, or a part or all of them may be integrated into a single chip.

For example, functional blocks except a memory may be integrated into a single chip.

Here, the integrated circuit is referred to as a LSI, but the integrated circuit can be called an IC, a system LSI, a super LSI or an ultra LSI depending on their degrees of integration.

It should be noted that the technique of integrated circuit is not limited to the LSI, and it may be implemented as a dedicated circuit or a general-purpose processor. It is also possible to use a Field Programmable Gate Array (FPGA) that can be programmed after manufacturing the LSI, or a reconfigurable processor in which connection and setting of circuit cells inside the LSI can be reconfigured.

Furthermore, if due to the progress of semiconductor technologies or their derivations, new technologies for integrated circuits appear to be replaced with the LSIs, it is, of course, possible to use such technologies to implement the functional blocks as an integrated circuit. For example, biotechnology and the like can be applied to the above implementation.

It should also be noted that only a means for storing data to be coded or decoded, among these functional blocks, may be realized as another structure, without being integrated into the single chip.

Although the embodiments according to the present invention has been described with reference to the drawings, the present invention is not limited to the embodiment illustrated in the drawings. The embodiments illustrated in the drawings may be modified and varied within the same meanings and the scope of the present invention.

Although the embodiments according to the present invention has been described with reference to the drawings, the present invention is not limited to the embodiments illustrated in the drawings. The embodiments illustrated in the drawings may be modified and varied within the same meanings and the scope of the present invention.

INDUSTRIAL APPLICABILITY

The present invention can be applied to a diffracted sound reduction device and the like which cancels diffracted sound by a plurality of speakers in order to prevent that sound reproduced by a TV or an acoustic apparatus is transferred to directions where there is no listener.

REFERENCE SIGNS LIST

1, 2, 3, 4, 5, 6, 7, 8, 102, 102A control speaker
10, 101, 101A reproduction speaker
11, 12, 13, 14, 15, 16, 17, 18 microphone
20 sound source (reference sound source)

21, 22, 23, 24, 25, 26, 104, 104A, 1001, 1002, 1003, 1004, 1005, 1006, 5001, 5002, 5003, 5004, 5005, 5006 control filter

31, 32, 33, 34, 35, 36, 1011-1016, 1021-1026, . . . , 1061-1066, 3011-3018, 3021-3028, . . . , 3081-3088, 11011-11018, 11021-11028, . . . , 11081-11088 Fx filter

41, 42, 43, 44, 45, 46, 1111-1116, 1121-1126, . . . , 1161-1166, 5111, 5112, . . . , 5166, 11111-11118, 11121-11128, . . . , 11181-11188 LMS arithmetic unit

51, 52, 53, 54, 55, 56 subtractor

61, 62, 63, 64, 65, 66, 67, 68, 108, 3100, 3101, . . . , 3155, 6000, 6001, 6002, 6003, 6004, 6005, 6007, 6008, 6011, 6012, 6013, 6014, 6015, 6017, 6018 adder (arithmetic unit)

100, 100A diffracted sound reduction device

106, 10000, 11000, 12000, 13000, 14000, 15000 correction filter

400 next-door room

401, 402, 403 microphone (for evaluation)

1000 control unit

1201, 1202, 1203, 1204, 1205, 1206, 5201, 5202, 5203, 5204, 5205, 5206, 11201, 11202, 11203, 11204, 11205, 11206, 11207, 11208 phase inverter

2000 desired property unit

2001, 2002, 2003, 2004, 2005, 2006, 2007, 2008 desired property filter

2101, 2102, 2103, 2104, 2105, 2106, 2107, 2108 level adjuster

2200 delay unit

3000 acoustic simulation unit

5000 ANC

5011-5016, 5021-5026, . . . , 5061-5066 Fx filter

7000 delay unit

9000 TV

10001-10008, 11001-11008, . . . , 15001-15008 diffracted sound control filter

20000 speaker array

40001 sound blocking wall

40002 actuator

40003 vibration sensor

40004 noise sensor

40005 conversion circuit

40006 control circuit

50001 high transmission loss panel

50002 cell

50003 actuator

50004 first sensor

50005 second sensor

50006 control device

60000 house

60001 wall

60002 TV

60003 speaker

60004, 60005 person

The invention claimed is:

1. A diffracted sound reduction device that controls sound pressures at a plurality of control points which are positions including a listener's position, the diffracted sound reduction device comprising:

a reproduction speaker that outputs reproduced sound having properties indicated by an input signal;

at least two control speakers each of which reproduces a corresponding one of control signals which indicates properties of control sound to reduce a sound pressure of diffracted sound, the diffracted sound being a part of the reproduced sound and arriving at a corresponding one of the control points except the control point at the listener's position; and control filters, each of which filters the input signal to generate the corresponding one of the control signals, wherein the reproduction speaker faces a listener, the control speakers do not face the listener, each of the control points faces a corresponding speaker from among the reproduction speaker and the control speakers, each of the control filters generates the corresponding one of the control signals to cause a sound pressure of the diffracted sound at the corresponding one of the control points to be lower than a sound pressure of direct sound that is a part of the reproduced sound and that arrives at the control point at the listener's position, each of the control filters has a filter coefficient determined by a filter coefficient determination method including performing signal processing on the input signal to determine, for the corresponding one of the control points, a desired signal indicating properties of desired sound to be eventually reproduced at the corresponding one of the control points, in the performing of the signal processing to determine the desired signal, the desired signal is determined, for each of the control points, from the input signal by using a corresponding one of level adjusters and a corresponding one of desired property filters, for a first desired property filter from among the desired property filters, a transfer characteristic of sound transfer from the reproduction speaker to the control point at the listener's position is set, and for each of the desired property filters except the first desired property filter, a transfer characteristic of sound transfer from the reproduction speaker to the corresponding one of the control points at the positions except the listener's position is set, each of the level adjusters adjusts a gain of the input signal according to a setting value, and the filter coefficient determination method further includes:

applying, for each of the control speakers, the corresponding one of the control filters on the input signal to generate the corresponding one of the control signals to be reproduced by the each of the control speakers;

calculating, for each of the control points as an acoustic simulation, a reproduction signal indicating properties of the desired sound based on the generated corresponding one of the control signals;

synthesizing, for each of the control points, the desired signal and the reproduction signal to generate an error signal, the desired signal being an output signal in the performing of the signal processing to determine the desired signal, and the reproduction signal being an output signal in the calculating of the reproduction signal;

updating the filter coefficient of the corresponding one of the control filters to minimize the error signal, when the generated error signal is greater than or equal to a predetermined threshold value; and determining the filter coefficient of the corresponding one of the control filters to be used, when the error signal is smaller than the predetermined threshold value.

2. The diffracted sound reduction device according to claim 1, wherein one of the control speakers serves also as the reproduction speaker, and the control filters filter the input signal to cause at the control point at the listener's position, the sound pressure of the direct sound to be equal to the sound pressure of the reproduced sound which is generated by directly reproducing the input signal by the reproduction speaker without reproducing the control signals, and at each of the control points at the positions except the listener's position, the sound pressure of the diffracted sound to be lower by a predetermined amount than the sound pressure of the reproduced sound which is generated by directly reproducing the input signal by the reproduction speaker without reproducing the control signals.

3. The diffracted sound reduction device according to claim 1, wherein each of setting values of gains which are set for the level adjusters except the level adjuster corresponding to the first desired property filter is smaller than a setting value of a gain which is set for the level adjuster corresponding to the first desired property filter.

4. The diffracted sound reduction device according to claim 1, wherein the calculating the reproduction signal as the acoustic simulation includes:

applying, on each of the control signals, an acoustic simulation filter for setting a transfer characteristic of a path to corresponding one of the control points; and performing, for each of the control points, an addition operation using the control signals applied with the acoustic simulation filter to generate the reproduction signal for the each of the control points.

5. The diffracted sound reduction device according to claim 1, wherein the determining of the coefficient includes:

applying, on the input signal, an acoustic simulation filter for setting a transfer characteristic of sound from each of the control speakers to each of the control points; and when the error signal is greater than or equal to the predetermined threshold value, updating the filter coefficient of the corresponding one of the control filters based on an output signal of the acoustic simulation filter and the error signal to cause a next calculated error signal to be smaller than the error signal.

6. A diffracted sound reduction device of controlling sound pressures at a plurality of control points which are positions including a listener's position, the diffracted sound reduction device comprising:

a reproduction speaker that outputs reproduced sound having properties indicated by an input signal;

at least two control speakers each of which reproduces a corresponding one of control signals which indicates properties of control sound to reduce a sound pressure of diffracted sound, the diffracted sound being a part of the reproduced sound and arriving at a corresponding one of the control points except the control point at the listener's position;

control filters, each of which filters the input signal to generate the corresponding one of the control signals;

correction filters, each of which receives the corresponding one of the control signals generated by the corresponding one of the control filters; and an adder, wherein the reproduction speaker faces a listener, the control speakers do not face the listener, each of the control points faces a corresponding speaker from among the reproduction speaker and the control speakers, each of the control filters generates the corresponding one of the control signals to cause a sound pressure of the diffracted sound at the corresponding one of the control points to be lower than a sound pressure of direct sound that is a part of the reproduced sound and that arrives at the control point of the listener's position, the reproduction speaker is different from the control speakers, a first control speaker from among the control speakers has a diaphragm facing the listener, and the control speakers except the first control speakers do not face the listener, each of the correction filters has a correction filter coefficient to reduce a level of control sound not to affect properties of the reproduced sound at the listener's position, the control sound being generated by reproducing the control signal applied with the each of the correction filters, the adder performs, for each of the control speakers, a consolidation operation using the control signals applied with the correction filters, and provides the consolidated control signal to the each of the control speakers, and each of the control filters has a filter coefficient determined by a filter coefficient determination method, the filter coefficient determination method including:

applying, for each of the control speakers, the corresponding one of the control filters on the input signal to generate the corresponding one of the control signals to be reproduced by the each of the control speakers;

calculating, for each of the control points as an acoustic simulation, a reproduction signal indicating properties of the desired sound based on the generated corresponding one of the control signals;

synthesizing, for each of the control points, the desired signal and the reproduction signal to generate an error signal, the desired signal being an output signal in the performing of the signal processing to determine the desired signal, and the reproduction signal being an output signal in the calculating of the reproduction signal;

updating the filter coefficient of the corresponding one of the control filters to minimize the error signal, when the generated error signal is greater than or equal to a predetermined threshold value; and determining the filter coefficient of the corresponding one of the control filters to be used, when the error signal is smaller than the predetermined threshold value.

7. A filter coefficient determination method of determining filter coefficients of control filters included in a diffracted sound reduction device that controls sound pressures at a plurality of control points which are positions including a listener's position, the diffracted sound reduction device including: a reproduction speaker that faces a listener and outputs reproduced sound having properties indicated by an input signal; at least two control speakers that do not face the listener, each of which reproduces a corresponding one of control signals which indicates properties of control sound to reduce a sound pressure of diffracted sound, the diffracted sound being a part of the reproduced sound and arriving at a corresponding one of the control points except the control point at the listener's position; and the control filters, each of which filters the input signal to generate the corresponding one of the control signals to cause a sound pressure of the diffracted sound at the corresponding one of the control points to be lower than a sound pressure of direct sound that is part of the reproduced sound and that arrives at the control point at the listener's position, each of the control points faces a corresponding speaker from among the reproduction speaker and the control speakers, the filter coefficient determination method comprising:

performing signal processing on the input signal to determine, for each of the control points, a desired signal indicating properties of desired sound to be eventually reproduced at the each of the control points;

applying, for each of the control speakers, the corresponding one of the control filters on the input signal to generate the corresponding one of the control signals to be reproduced by the each of the control speakers;

calculating, for each of the control points as an acoustic simulation, a reproduction signal indicating properties of the desired sound based on the generated corresponding one of the control signals;

synthesizing, for each of the control points, the desired signal and the reproduction signal to generate an error signal, the desired signal being an output signal in the performing of the signal processing to determine the desired signal, and the reproduction signal being an output signal in the calculating of the reproduction signal;

updating a filter coefficient of the corresponding one of the control filters to minimize the error signal, when the generated error signal is greater than or equal to a predetermined threshold value; and determining the filter coefficient of the corresponding one of the control filters to be used, when the error signal is smaller than the predetermined threshold value.

8. A diffracted sound reduction method of reducing diffracted sound by a diffracted sound reduction device that controls sound pressures at a plurality of control points which are positions including a listener's position, the diffracted sound reduction device including: a reproduction speaker that faces a listener and outputs reproduced sound having properties indicated by an input signal; at least two control speakers that do not face the listener, each of which reproduces a corresponding one of control signals which indicates properties of control sound to reduce a sound pressure of diffracted sound, the diffracted sound being a part of the reproduced sound and arriving at a corresponding one of the control points except the control point at the listener's position; and control filters, each of which filters the input signal to generate the corresponding one of the control signals to cause a sound pressure of the diffracted sound at the corresponding one of the control points to be lower than a sound pressure of direct sound that is part of the reproduced sound and that arrives at the control point at the listener's position, each of the control points faces a corresponding speaker from among the reproduction speaker and the control speakers, the diffracted sound reduction method comprising:

performing signal processing on the input signal to generate a plurality of desired signals Dn;

performing signal processing on the input signal to generate a plurality of control signals Cn;

performing, as an acoustic simulation, signal processing on each of the generated control signals Cn so as to generate reproduction signals On corresponding to the control signals Cn, respectively;

synthesizing, as an arithmetic operation, each of the desired signals Dn and the reproduction signals On corresponding to the each of the desired signals Dn, so as to generate a plurality of error signals En, the desired signals Dn being output signals in the performing of the signal processing to generate the desired signals Dn, and the reproduction signals On being output signals in the performing of the signal processing to generate the reproduction signals On;

updating a filter coefficient of the corresponding one of the control filters to minimize the error signals En, when the generated error signals En are greater than or equal to a predetermined threshold value; and determining control properties of the corresponding one of the control filters as $$Cn=Dn/On$$

to cause each of the error signals En to be smaller than the predetermined threshold value.

* * * * *